US009587454B1

(12) United States Patent
Beard et al.

(10) Patent No.: US 9,587,454 B1
(45) Date of Patent: Mar. 7, 2017

(54) MODULAR ACTUATOR AND HYDRAULIC VALVE ASSEMBLIES AND CONTROL APPARATUS FOR OIL WELL BLOW-OUT PREVENTERS

(71) Applicants: Joseph Owen Beard, Fullerton, CA (US); Frode Sveen, Chino, CA (US)

(72) Inventors: Joseph Owen Beard, Fullerton, CA (US); Frode Sveen, Chino, CA (US)

(73) Assignee: PacSeal Group, Inc. PacSeal, Brea, CA (US)

( * ) Notice: Subject to any disclaimer, the term of this patent is extended or adjusted under 35 U.S.C. 154(b) by 159 days.

(21) Appl. No.: 14/161,673

(22) Filed: Jan. 22, 2014

(51) Int. Cl.
*F16K 31/163* (2006.01)
*E21B 33/06* (2006.01)

(52) U.S. Cl.
CPC ..... *E21B 33/063* (2013.01)

(58) Field of Classification Search
USPC ..... 251/58, 63.4, 249.5, 250; 137/270; 92/129, 136
See application file for complete search history.

(56) References Cited

U.S. PATENT DOCUMENTS 3,566,751 A * 3/1971 Sheppard ..... B62D 5/24 74/498
3,650,506 A * 3/1972 Bruton ..... F16K 31/1635 251/26
4,007,910 A * 2/1977 Yasuoka ..... F16K 1/221 251/229
4,046,350 A * 9/1977 Massey ..... F16K 31/1635 137/269
4,700,924 A * 10/1987 Nelson ..... E21B 21/02 166/319
4,890,645 A * 1/1990 Andersen ..... F16K 11/0743 137/625.21
5,287,881 A * 2/1994 Szatmary ..... F16K 31/54 137/312
5,887,608 A * 3/1999 Bordelon ..... F15B 15/065 137/1
6,959,913 B2 * 11/2005 Hansen ..... F15B 15/065 251/250
8,191,860 B2 * 6/2012 Eschborn ..... F16K 31/54 251/129.11

* cited by examiner

*Primary Examiner* — John Fox
(74) *Attorney, Agent, or Firm* — William L. Chapin

(57) ABSTRACT

A modular apparatus for controlling flow of pressurized hydraulic fluid to and from opening and closing hydraulic actuator cylinders of oil and gas well blow-out preventers (BOP's), utilizes novel rotary hydraulic valve/actuator assemblies, each of which uses a pair of integral double-acting pneumatic actuator cylinders that drive a rack gear coupled to a spur gear located inside the actuator housing which is fixed to a valve rotor shaft that protrudes forward from the valve housing and protrudes through an outer wall of the housing and has a manually operable handle attached thereto, thus enabling multiple valve/actuator assemblies to be mounted in a close side-by-side arrangement to an hydraulic manifold. An air control manifold panel for remotely energizing the pneumatic actuator cylinders includes opening and closing push button control valves on an air manifold connected through air hoses to the actuator cylinders.

19 Claims, 35 Drawing Sheets

Air Remote Panel, 8-Station 301U
310U
302U
123
162U
172
101
125
291U
-311U-
312U
161
299U
104
182A
318U
192
103
321U
211
322U
181A
323
191
207
324
210
212
206
213
204
166
325
326
190
168
208
322L
319
321L
311
193
299L
183A
296
313
318L
292
293
162L
294
295
126
189
312
173
291L
-311L-
303
189
290
309
310L
124
302L
301L

MODULAR ACTUATOR AND HYDRAULIC VALVE ASSEMBLIES AND CONTROL APPARATUS FOR OIL WELL BLOW-OUT PREVENTERS

BACKGROUND OF THE INVENTION

A. Field of the Invention

The present invention relates to apparatus for use in the drilling and operation of wells, particularly oil wells and geothermal wells. More particularly, the invention relates to novel modular actuator and hydraulic assemblies and a novel control apparatus for use with existing oil well blow-out preventers of the type used to prevent pressurized subterranean liquids or gases from blowing out and upwards through a well hole B. Description of Background Art In drilling for natural gas or liquid petroleum, a drill string consisting of many lengths of threaded pipes screwed together and tipped with a drill bit head is used to bore through rock and soil. The drill bit head has a larger diameter than the pipes forming the drill string above it. A rotary engine coupled to the upper end of the drill string transmits a rotary boring action to the drill bit head.

During the drilling operation, a specially formulated mud is introduced into an opening in an upper drill pipe. This mud, which typically is selected to have a high specific gravity, flows downwards through the hollow interior of the pipes in the drill string and out through small holes or jets in the drill bit head. Since the drill bit head has a larger diameter than the drill string above it, an elongated annular space is created between the drill string pipes and the bore hole wall during the drilling process. The annular space permits the mud to flow upwards to the surface. Mud flowing upwards carries drill cuttings, primarily rock chips, to the surface. The mud also lubricates the rotating drill string, and provides a downward hydrostatic pressure which counteracts pressure which might be encountered in subsurface gas pockets. A steel tubular well casing is inserted into the bore hole when the drilling operation has been completed.

In normal oil well drilling operations, it is not uncommon to encounter subsurface gas pockets whose pressure is much greater than could be resisted by the hydrostatic pressure of the elongated annular column of drilling mud. To prevent the explosive and potentially dangerous and expensive release of gas and/or liquid under pressure upwards out through the drilling hole, Blow-Out Preventers (BOP's) are used. Blow-out preventers are usually mounted to a drill pipe or well casing near the upper end of the bore hole. The blow-out preventers are mounted to drill string components such as a drill pipe or well casing tubes, and function by shutting off upward movement of a gas, liquid or drill string components which could be forced upwardly in response to pressure encountered in an oil or gas reservoir.

Typical oil or gas well drilling or production operations utilize a vertical stack of blow-out preventers of various types. The stack usually includes an annular type of blow-out preventer which is located at the upper end of a stack, located near a well-head.

Annular blow-out preventers have a resilient sealing means which can be forced by hydraulic cylinders into compressive sealing contact with the outer circumferential surface of various diameter drill string components or well casings, preventing pressure from subterranean gas pockets from blowing out material along the drill string and up the bore hole. Usually, the resilient sealing means of a blow-out preventer is so designed as to permit abutting contact of a plurality of sealing elements, when all elements of a drill string are removed from the casing. This permits complete shutoff of the well, even with all drill string elements removed. Most oil well blow-out preventers are remotely operable, as, for example, by a hydraulic pressure source near the drill hole opening having pressure lines running down to hydraulic actuator cylinders of the blow-out preventer.

Most blow-out preventer stacks also include a series of longitudinally spaced apart blow-out preventers of various types, located below an upper annular blow-out preventer. Other types of blow-out preventers include pipe ram, blind ram and shear ram. Construction and operation of blow-out preventers of the types identified above are described at http://en.wickipedia.org/wiki/blowout-preventer.

The present invention was conceived of in part to provide a modular control apparatus for oil well blow-out preventers, the apparatus including novel air actuator/hydraulic valve assemblies which are mounted to a compact hydraulic manifold, and including a novel actuator air control panel for remotely energizing pneumatic air cylinder-actuators which operate an integral hydraulic valve of each actuator/valve assembly.

OBJECTS OF THE INVENTION

An object of the present invention is to provide a modular control apparatus for controlling flow of pressurized hydraulic fluid to hydraulic actuator cylinders of oil well blow-out preventers used to control upward pressure from an oil or gas well reservoir Another object of the invention is to provide novel modular pneumatic actuator/hydraulic valve assemblies which have a small footprint that enables various numbers of the assemblies to be mounted in a close side-by-side arrangement to a hydraulic manifold and thus enable construction of compact blow-out preventer control apparatuses.

Another object of the invention is to provide a novel double-action linear pneumatic actuator for exerting torque on a rotatable shaft.

Another object of the invention is to provide a novel modular air control panel for controlling flow of pressurized air to remotely located pneumatic actuator/hydraulic valve assemblies, in which various numbers of manually operated air valves are mounted to an air manifold and used to transmit pressurized air to a pair of air actuator cylinders of individual remotely located actuator/hydraulic valve assemblies, which in turn provide pressurized hydraulic fluid to opening and closing double-action hydraulic actuator cylinders of blow-out preventers located near a well head.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved control apparatus for oil well blow-out preventers, of the type variously referred to as hydraulic power units or BOP (Blow-Out Preventer) closing units and used to remotely actuate closing and opening hydraulic actuator cylinders of blow-out preventers mounted to a drill string or well casing of an oil or gas well. The invention includes a novel double-action pneumatic actuator and integral rotatable hydraulic valve assembly, a modular hydraulic manifold assembly for mounting various numbers of actuator and valve assemblies in a smaller space than prior-art control units, and a novel remote air panel and air manifold for remote manual operational control of pairs of air cylinders of individual air actuator and valve assemblies.

Each hydraulic valve and pneumatic actuator assembly according to the present invention includes an hydraulic valve that has rectangular block-shaped hydraulic valve housing which has in a flat valve port interface base plate at the base of the valve housing inlet, outlet and return ports for pressurized hydraulic fluid. The fluid ports, which are disposed perpendicularly through the valve port interface base plate at the base of the valve housing, facilitate mounting a selected number of valve and actuator assemblies on the flat front surface of a hydraulic manifold plate which has therein complementary manifold ports that are used to make fluid pressure-tight connections to the ports in the valve port interface base plate. Optionally, the hydraulic valve ports may be located in sides of a modified valve port interface base plate bolted to the valve housing, for in-line applications in which hydraulic lines are threadingly tightened into the in-line, side ports.

According to the invention, each hydraulic valve has within its housing a circular cylindrically-shaped rotor which is rotatably supported within the housing by an annular ring-shaped bearing race and ball bearings in an outer circumferential wall surface of the rotor. The rotor is fixed to the lower end of a shaft which protrudes perpendicularly upwards from the center of the rotor. The shaft is rotatably supported within a bearing located in an upper part of the valve housing, and protrudes upwardly from the upper surface of the valve housing.

A novel double-action linear pneumatic air actuator for the hydraulic valve includes a housing which has a central block-shaped part that has a flat lower mounting surface that seats on the flat upper surface of the valve housing. The actuator housing encloses a pair of collinear, diametrically opposed air cylinders located within a pair of rectangular outer cross-section housing extensions which extend equal distances outwards from the central block-shaped part of the housing and from the valve rotor shaft. The actuator housing is secured to the valve housing with bolts, and extends equal distances outwards from opposite sides of the valve housing.

According to the invention, ports of a manifold used to mount various numbers of valve and actuator assemblies in a side-by-side relation are arranged so that the pneumatic actuator cylinders are oriented in a parallel, side-by-side configuration. For example, for a manifold which has a vertically oriented, flat front ported face, the ports in the valve port interface base plate at the base of the valve housing are arranged so that the pneumatic actuator housing bases of adjacent actuator/valve assemblies are oriented in a side-by-side arrangement in a vertical plane, with upper and lower parts of each actuator which contain the upper and lower actuator air cylinders, respectively, extending above and below the upper and lower surfaces, respectively, of the valve housing, in a side-by-side, parallel arrangement. This arrangement enables valve and actuator assemblies to be arranged so that the width of a manifold on which the assemblies are mounted can be reduced from that required by prior-art control units in which adjacent actuator cylinders are arranged in-line on a single horizontal axis.

The novel pneumatic actuator according to the present invention includes a rotor shaft bore which is disposed perpendicularly through upper and lower surfaces of the actuator housing. The bore through the actuator cylinder housing has bearings which receive and rotatably support an upper part of the valve rotor shaft, which protrudes upwardly from the upper surface of the actuator cylinder housing and has attached thereto a handle for manual rotational operation of the valve. The handle is provided for emergency manual back-up operation of the valve.

According to the invention, the central axis of the rotor shaft bore through the actuator housing for the valve rotor shaft is centered in the block-shaped central portion of the actuator housing which is offset laterally, e.g., to the right, of the common longitudinal center lines of the upper and lower actuator cylinders. Thus, the rotor shaft axis is offset laterally from a longitudinal center line of the pneumatic actuator housing, e.g., closer to a right-hand vertical side of the housing than the left hand side. The lateral offset is provided to enable an inner, e.g., left hand side of a spur gear, which receives through a central flatted bore thereof a flatted portion of the valve rotor shaft, to mesh with a linear rack gear which is laterally centered within the pneumatic actuator housing. The rack gear is joined at opposite ends, e.g., upper and lower ends for a vertically oriented actuator cylinder housing, to upper and lower actuator piston rods. The upper and lower piston rods extend downwardly and upwardly, respectively, from upper and lower air pistons. The pistons are slidably mounted in air pressure-tight seals within the upper and lower air cylinders within the actuator housing extensions.

With the foregoing construction, when the upper cylinder is pressurized with air, the upper piston and piston rod, and the rack gear are forced downwards, thus rotating the spur gear, valve rotor shaft, and valve rotor in a counterclockwise sense. In a counterclockwise limit position, hydraulic fluid-flow channels within the body of the cylindrical valve rotor align with ports in the valve port interface base plate and manifold to thus permit flow of pressurized hydraulic fluid from a pressure source through a hydraulic line to an OPENING hydraulic actuator cylinder of a remote blow-out preventer, which retracts blow-out preventer seals from sealing contact with a drill string component.

Conversely, when the lower pneumatic actuator cylinder is pressurized with air, the lower piston and piston rod, and rack gear are forced upwardly, thus rotating the spur gear, valve rotor shaft and valve rotor to a clockwise limit position. In this position, ports of hydraulic fluid-flow channels within the body of the cylindrical valve rotor align with ports in the valve port interface base plate and manifold to thus permit flow of pressurized hydraulic fluid from a pressure source through a hydraulic line to a CLOSING hydraulic actuator cylinder of a remote blow-out preventer, which extends blow-out preventer seals into sealing contact with a drill string component.

Manually operating the hydraulic valve control handle to a central neutral position causes the valve rotor shaft and attached spur gear to be rotatably centered in a NEUTRAL position between counterclockwise and clockwise limit positions. This NEUTRAL position causes ports and channels of the valve rotor to align with valve port interface base plate and manifold ports in a manner which enables flow of hydraulic fluid which may have accumulated within the valve housing during a previously pressurized BOP hydraulic opening or closing operation to return to a reservoir.

According to the invention, the pneumatic actuators for the hydraulic valves are preferably operated by a remotely located air control remote panel and station. The air control remote panel and station includes a pair of separate manually operated push-button air valves for each of the two cylinders of each pneumatic actuator of an actuator/valve assembly. Each air valve has an inlet port connected through a flexible tube to a source of pressurized air, and an outlet port connected through a separate flexible tube to an inlet port of either the upper or lower cylinder of a pneumatic valve actuator. Thus, a first OPEN push-button operated air valve is connected to the upper, opening air cylinder of an actuator, and the second, CLOSE push-button operated air valve is connected to the lower, closing air cylinder of that actuator.

According to the invention, the push-button air valves are mounted on the front vertical surface of an air manifold. The air manifold has a multiplicity of control ports which are connected at one end to outlet ports of individual push-button air valves. The air manifold also has a multiplicity of pressurized air ports which mate with inlet ports of individual push-button air valves. The air manifold air valve air pressure source ports are in turn connected to a source of pressurized air such as an air compressor by a single pressurized air supply tube. An opposite end of each air valve control port is connected by a separate air tube to a remotely located upper or lower cylinder of the pneumatic actuator of an actuator/hydraulic valve assembly.

DESCRIPTION OF THE PREFERRED EMBODIMENTS

Novel features and advantages of a Modular Actuator And Hydraulic Valve Assemblies And Control Apparatus For Oil Well Blow-Out Preventers (BOP's) according to the present invention may best be understood by considering briefly the construction and function of a typical prior-art blow-out preventer control apparatus, of the type shown in FIGS. 1-5B.

Figure 1:
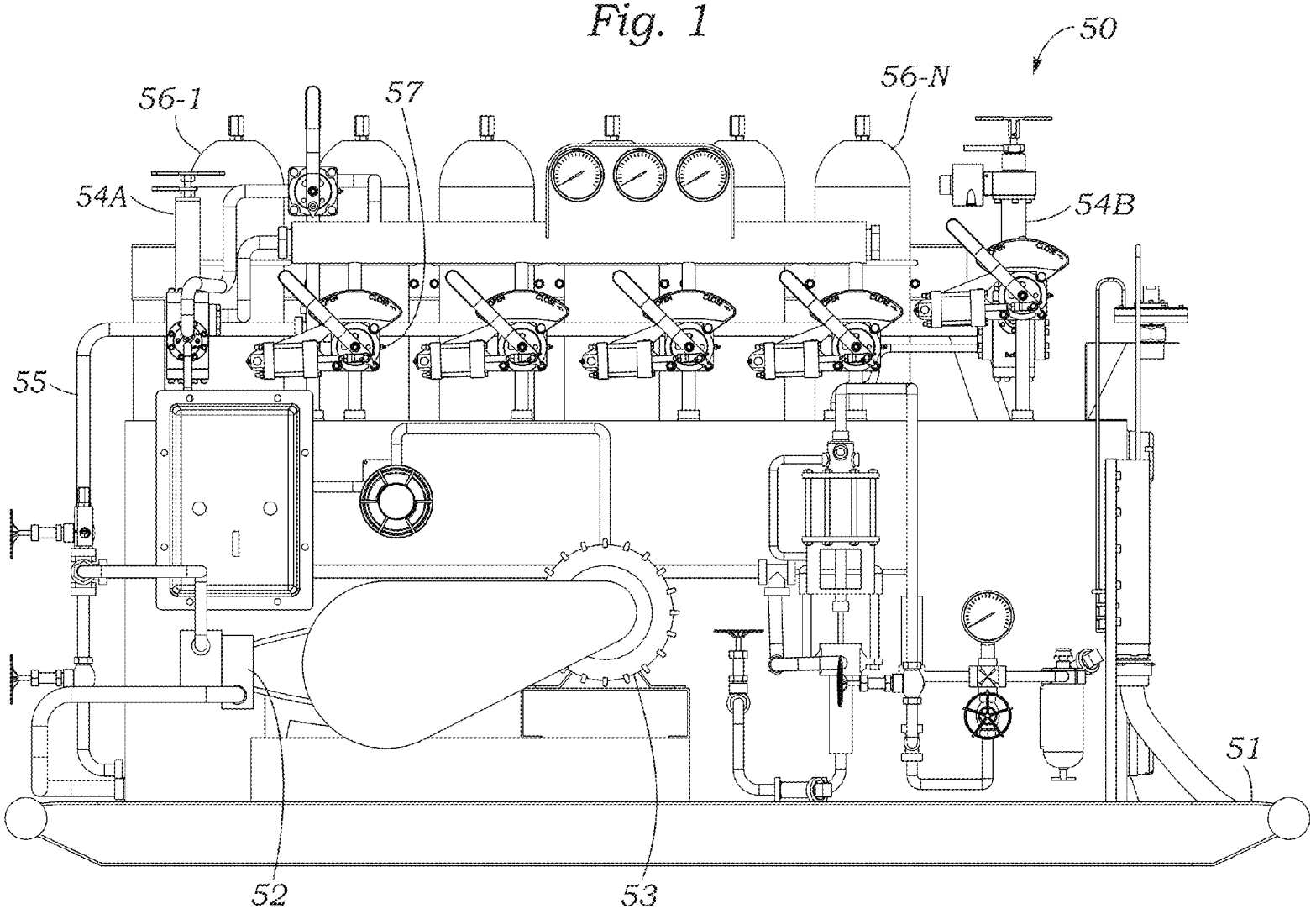
FIG. 1 is a front elevation view of a prior-art hydraulic closing unit for oil well blow-out preventers showing each of the hydraulic control valves thereof in a counterclockwise limit position in which hydraulic fluid may be conducted through the valve to an opening hydraulic actuator cylinder of an oil well Blow-Out Preventer (BOP).
Figure 4:
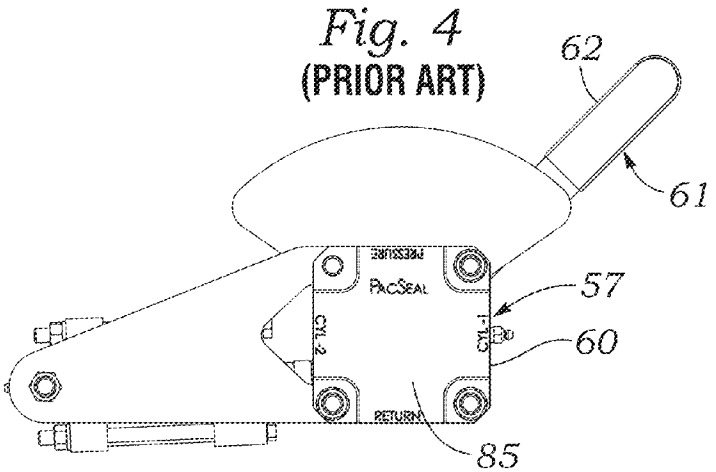
Fig. 4 (PRIOR ART)
FIG. 4 is a rear elevation view of the prior-art valve and actuator of FIG. 3.

Referring to FIG. 1, it may be seen that an example of a prior-art hydraulic power unit or control apparatus 50 for oil well blow-out-preventers (BOP's) includes various mechanical components which are mounted on a skid 51 that is transportable to a location near an oil well head. The apparatus 50 includes a hydraulic pump 52 which is driven by an electric, pneumatic, or hydraulic motor 53 which provides pressurized hydraulic fluid through various pressure regulators and conduits 54A, 54B, 55 to a multiplicity of individual hydraulic pressure accumulators 56, e.g., accumulators 56-I through 56-N. Typically, apparatus 50 includes a bank of hydraulic pressure accumulators 56-I through 56-N connected to a common manifold. The accumulators provide pressurized hydraulic fluid for the OPENING hydraulic actuator and the CLOSING hydraulic actuator of each one of a multiplicity of separate blow-out preventers (not shown) which are mounted to an oil well drill string at a well head located some distance from the control apparatus 50.

As shown in FIG. 1, blow-out preventer control apparatus or hydraulic power unit 50 includes a multiplicity of hydraulic control valves 57. As shown in FIG. 5B, each hydraulic control valve 57 is typically a rotary, three-position type valve which has an internal rotor 58, coupled to a shaft 59 which protrudes forward from the valve housing 60. The outer end of valve rotor shaft 59 is fastened to a lever arm 61 which has a handle bar 62 that extends radially outwards from the shaft and serves as a manually operable handle for rotating the shaft. Lever arm 61 also has a short flat bar-shaped actuator lever extension 63 that extends radially outwards from the valve rotor shaft 59, in a direction diametrically opposed to handle bar 62.

Figure 2:
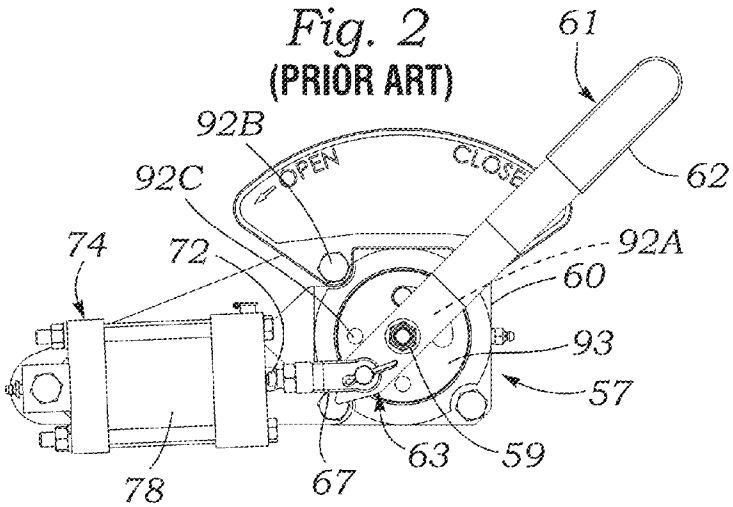
Fig. 2 (PRIOR ART)
FIG. 2 is a fragmentary view of the prior-art apparatus of FIG. 1, showing a valve thereof in a clockwise limit position in which hydraulic fluid may be conducted through the valve to a closing hydraulic actuator cylinder of a blow-out preventer.
Figure 5A:
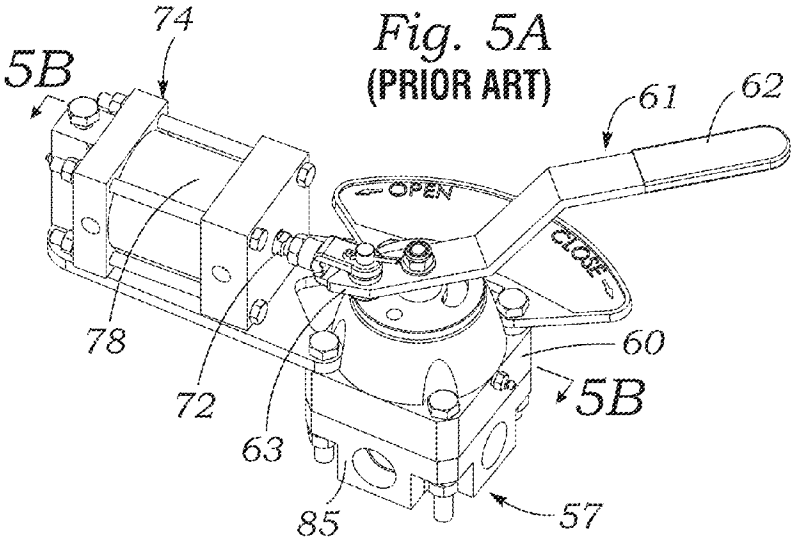
Fig. 5A (PRIOR ART)
FIG. 5A is a front perspective view of the prior-art valve and actuator of FIG. 4.
Figure 3:
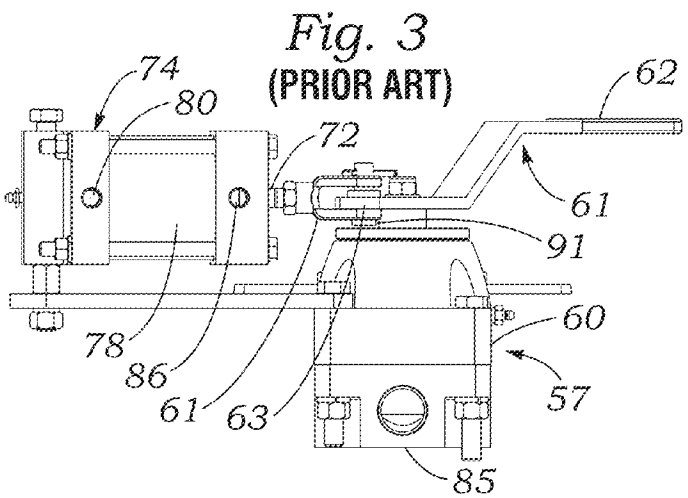
Fig. 3 (PRIOR ART)
FIG. 3 is a lower plan view of a prior-art hydraulic valve and pneumatic actuator air cylinder of the apparatus of FIG. 1.
Figure 5B:
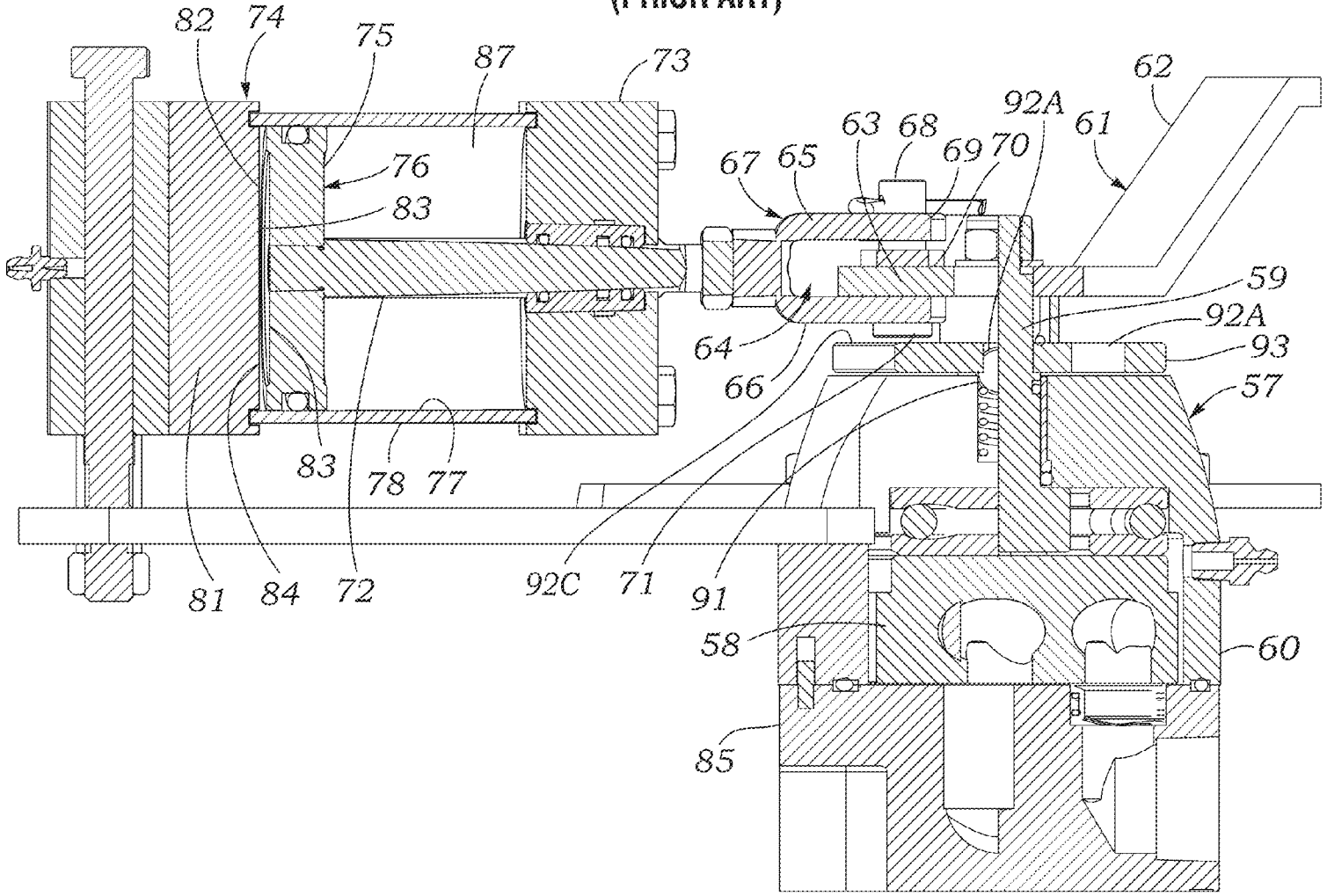
Fig. 5B (PRIOR ART)
FIG. 5B is a longitudinal sectional view of the prior-art valve and actuator of FIG. 5A, taken in the direction 5B-5B.

As may be seen best by referring to FIGS. 2, 5A and 5B, a radially outwardly located end of valve actuator lever extension 63 is received in a gap 64 between the sheaves 65, 66 of a clevis 67, and is pivotably joined to the sheaves by a pivot pin 68 disposed perpendicularly through aligned holes 69, 70, 71 in the upper sheave, actuator lever extension, and lower sheave, respectively.

As shown in FIG. 5B, clevis 67 is fastened at an outer end thereof to the outer end of a piston rod 72. Piston rod 72 extends outwardly from the bulkhead 73 of a pneumatic air actuator 74. The inner end of piston rod 72 is fastened to the base 75 of a piston 76 which is longitudinally slidable in pneumatically sealing contact with the inner cylinder wall surface 77 of an air cylinder 78 within pneumatic actuator 74.

As may be envisioned by referring to FIGS. 1, 2 and 5B, when pressurized air is introduced through a port 80 through cylinder head 81 of actuator cylinder 78 into the head space 82 between the inner surface 83 of the cylinder head and the head 84 of piston 76, the piston 76 and piston rod 72 are forcibly extended away from cylinder head 81. In turn, outward motion of piston rod 72 and clevis 67 forces counterclockwise orbital motion of valve actuator lever 63 and counterclockwise rotation of valve rotor shaft 59 from a CLOSED position shown in FIG. 2 to an OPEN position shown in FIG. 1.

In the CLOSED position of a valve 57 shown in FIG. 2, pressurized hydraulic fluid is conducted from the outlet port of a manifold supplied with pressurized hydraulic fluid from a bank of accumulators 56-I through 56-N to a PRESSURE inlet port in body 85 of the valve, and through rotor 58 and an output port of the valve to a hydraulic pressure line which is connected to the CLOSING hydraulic actuator cylinder of a distant blow-out preventer.

Similarly, pneumatic actuator cylinder 78 is used to orbit turn control lever 59 to a clockwise-limit, CLOSED position by retracting piston 76 and piston rod 72. Retraction of piston 76 and piston rod 72 is accomplished by introducing pressurized air through a port 86 through bulkhead 73 of actuator cylinder 78 into a space 87 between the bulkhead and base 75 of piston 76. In this configuration of valve 57, pressurized hydraulic fluid is conducted from the output port of a manifold connected to a bank of accumulators, 56-I, through 56-N, to the pressure inlet port in valve body 85, and through valve rotor 58 to an OPENING outlet port which is connected to a hydraulic pressure line which is in turn connected to the OPENING hydraulic actuator cylinder of a distant blow-out preventer.

Although it is not shown in FIGS. 1-5B, each hydraulic control valve 57 has a third, NEUTRAL position in which valve handle lever 62 is oriented in an upright vertical position, midway between the counterclockwise OPEN limit position and clockwise CLOSED limit position.

As may be seen by referring to FIGS. 5A and 5B, each valve 57 has a spring loaded detent ball 91 which lodges under spring tension into one of three circumferentially spaced apart detent depressions 92A, 92B, 92C in an upper cover plate 93 of the valve body 85. In this NEUTRAL position, the pressure inlet port and opening and closing outlet ports are blocked.

As shown in FIG. 1, the prior-art arrangement of multiple hydraulic valves in which a pneumatic actuator cylinder for each valve lies along a common laterally disposed axis, combined with the relatively long handle lever arms 62, which are required for manual backup operability of the valves required by safety standards, results in a substantially wide, and correspondingly heavy control apparatus. The design and construction of various components of a modular actuator and hydraulic valve and control apparatus according to the present invention affords, among other advantages, a reduction in the size and weight of the control apparatus, as will now be described.

FIGS. 6-38 illustrate details of a novel Modular Actuator And Hydraulic Valve Assemblies And Control Apparatus For Oil Well Blow-Out Preventers according to the present invention. Certain standard components of the apparatus which are known to those skilled in the art, and/or which have been described above in the discussion of the prior-art, are omitted for clarity of the ensuing description.

Figure 6:
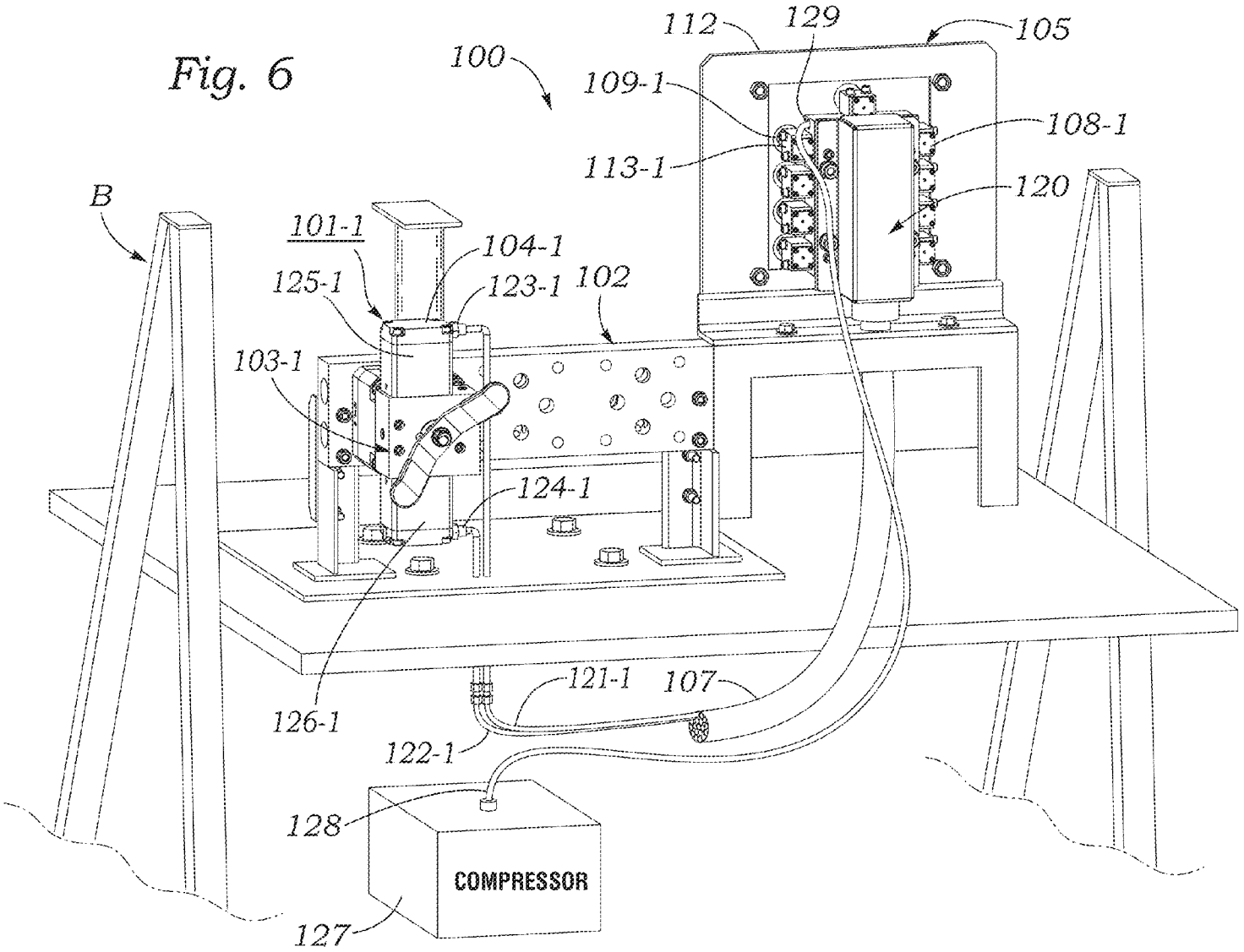
FIG. 6 is a fragmentary perspective view of a modular pneumatic actuator and hydraulic control valve apparatus for oil well blow-out preventers according to the present invention, showing novel components of the apparatus including a rear view of a remote air controller component of the apparatus and a front view of a manifold and a single hydraulic valve and pneumatic actuator mounted on the manifold.
Figure 7:
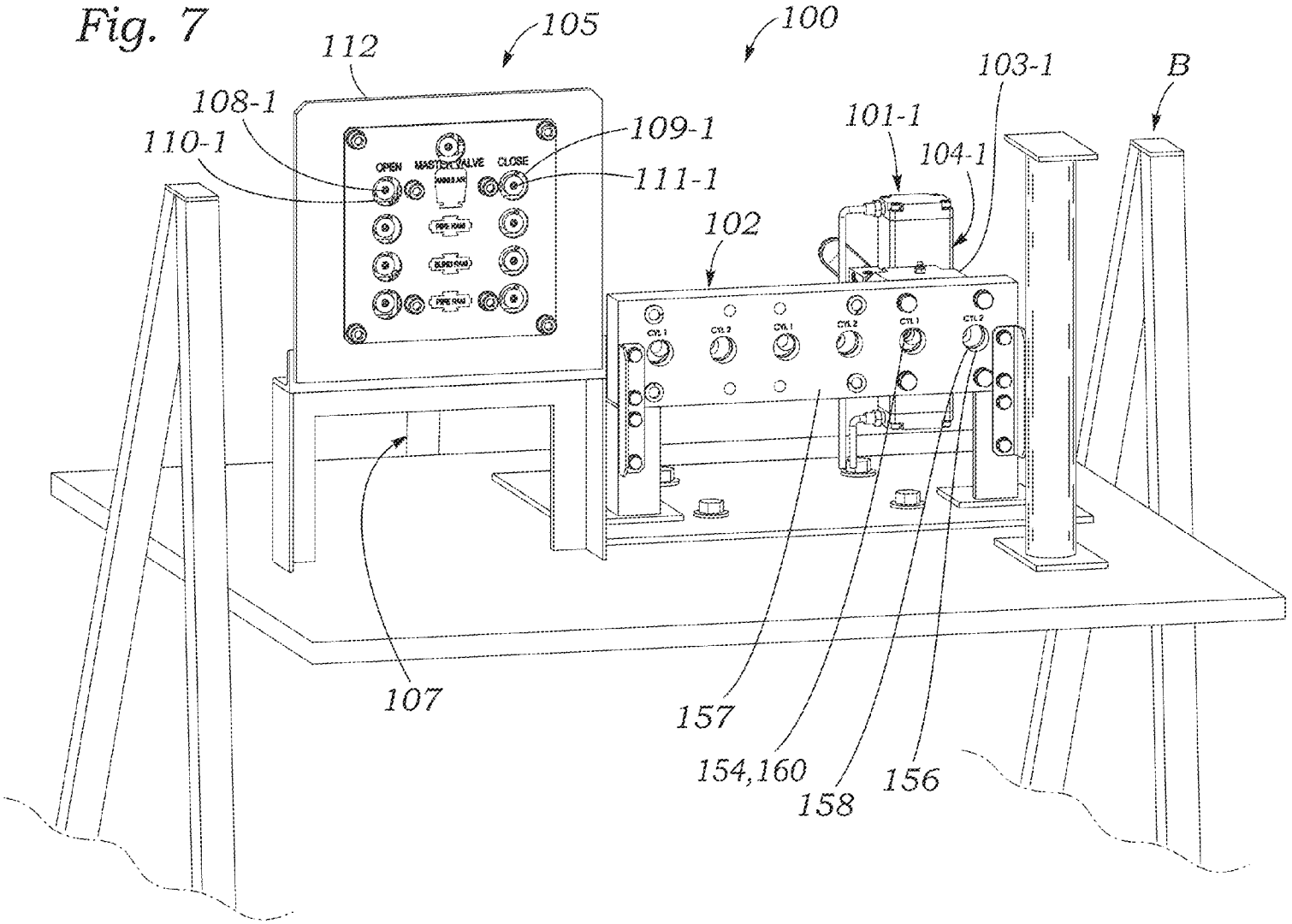
FIG. 7 is a rear perspective view of the apparatus of FIG. 6.
Figure 8:
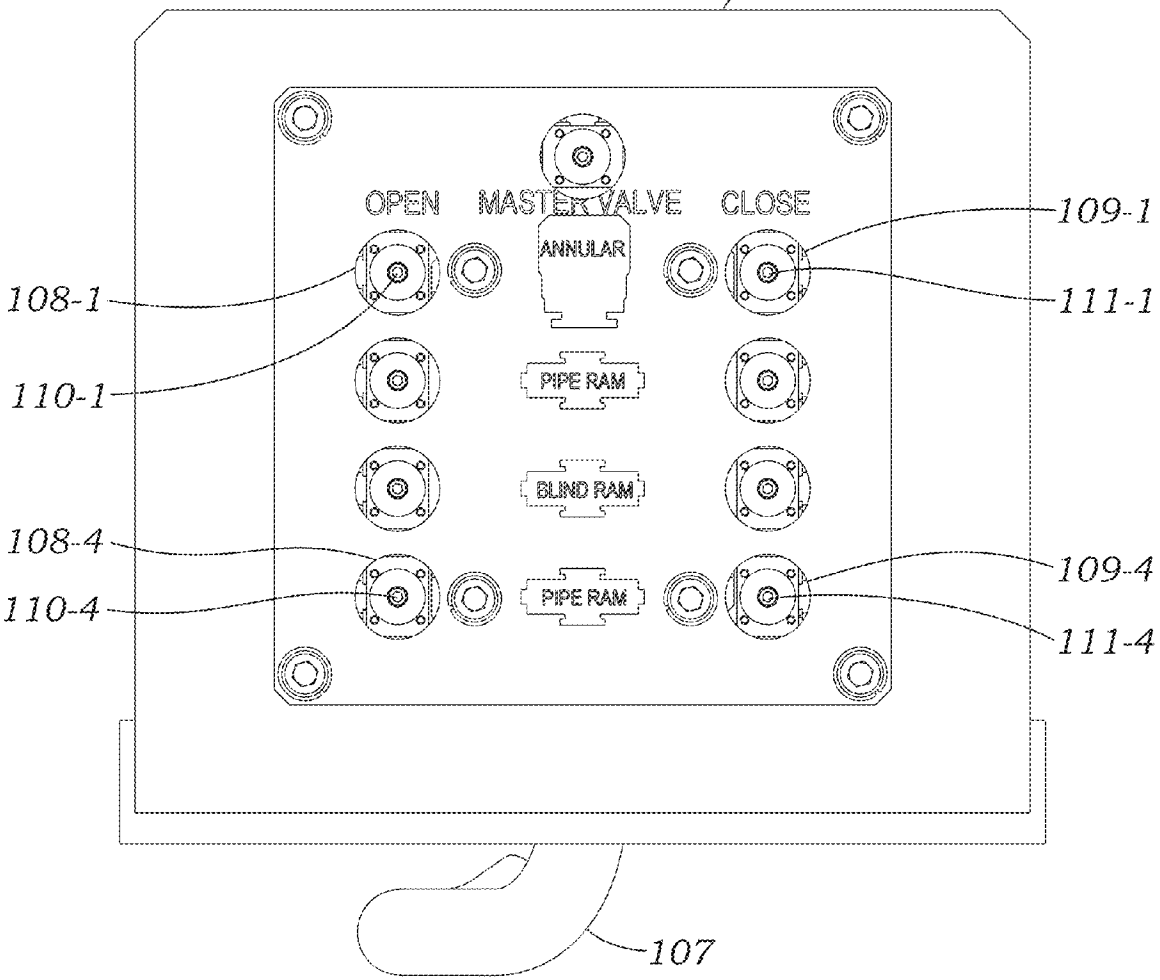
FIG. 8 is a fragmentary view of the apparatus of FIG. 6, showing a remote air controller component of the apparatus.
Figure 9:
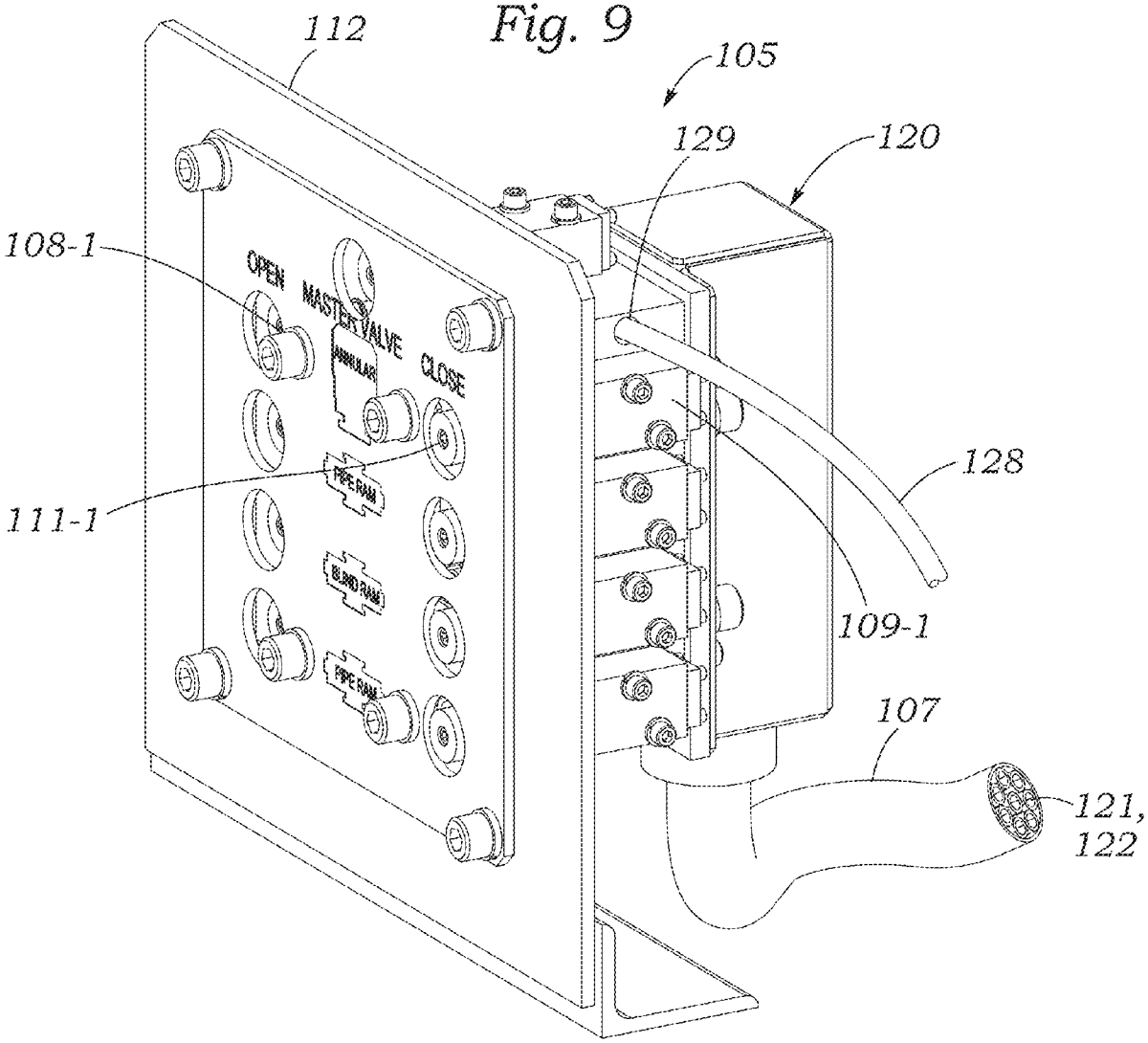
FIG. 9 is a right side perspective view of the remote air controller of FIG. 8.

FIGS. 6 and 7 are fragmentary views showing major components of a Modular Actuator And Hydraulic Valve Assemblies And Control Apparatus for Oil Well Blow-Out Preventers according to the present invention, in which major components of the apparatus which in actual use may be separated by substantial distances, are mounted close together on a demonstration bench or test bench B.

As shown in FIGS. 6 and 7, a Modular Actuator And Hydraulic Valve Assemblies And Control Apparatus For Oil Well Blow-Out Preventers 100 according to the present invention includes one or more pneumatic actuator and hydraulic valve assemblies 101 mounted on a hydraulic manifold 102. Each actuator/valve assembly 101 consists of an hydraulic valve 103 to which is mounted an integral double-action pneumatic actuator 104. Both the valve and actuator are described in detail below. Apparatus 100 includes a remotely locatable air control panel unit 105 which is connectable to individual pneumatic actuators 104 by separate air tubes 121, 122, 128 that are contained in a larger diameter flexible coaxial tubular jacket 107.

As shown in FIGS. 6-10C, air panel control unit 105 includes pairs of manually operable OPENING and CLOSING push-button valves 108-1 through 108-4, and 109-1 through 109-4, respectively. Opening valves 108 are arranged in a left-hand vertical column in horizontal alignment with closing valves 109, which are located in a right-hand vertical column.

Each valve 108, 109 has a push-button 110, 111 which protrudes through a panel 112 of the air panel control unit. Each valve 108, 109 has a rectangular block-shaped rear housing 113, 114 which has in an inner vertical side thereof a valve outlet port. Valves 108, 109 are mounted to opposite vertical sides of a valve manifold 120A, with valve outlet ports and in hermetic sealing contact with aligned ports in the valve manifold.

Figure 10A:
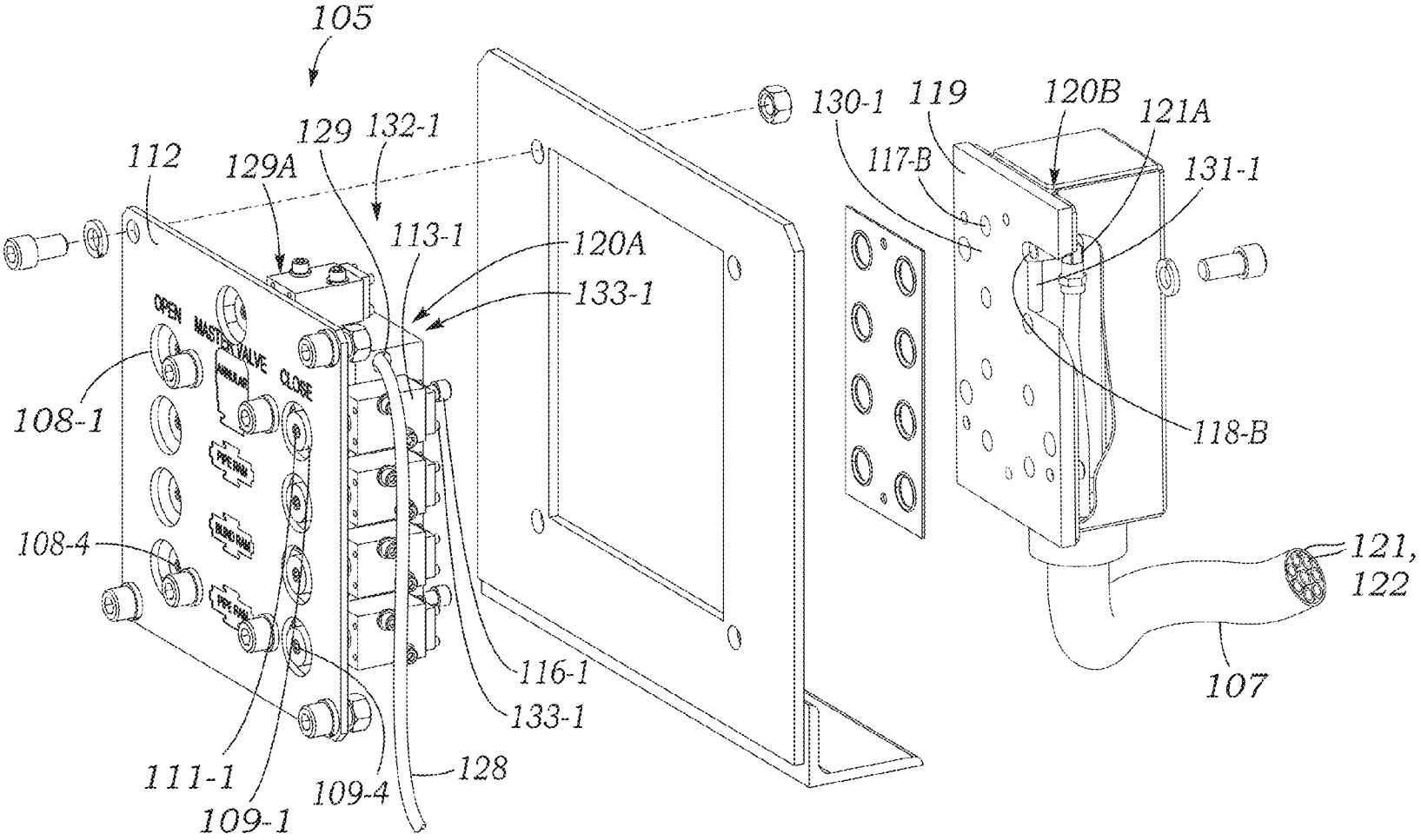
FIG. 10A is an exploded front perspective view of the air controller of FIG. 8.
Figure 10B:
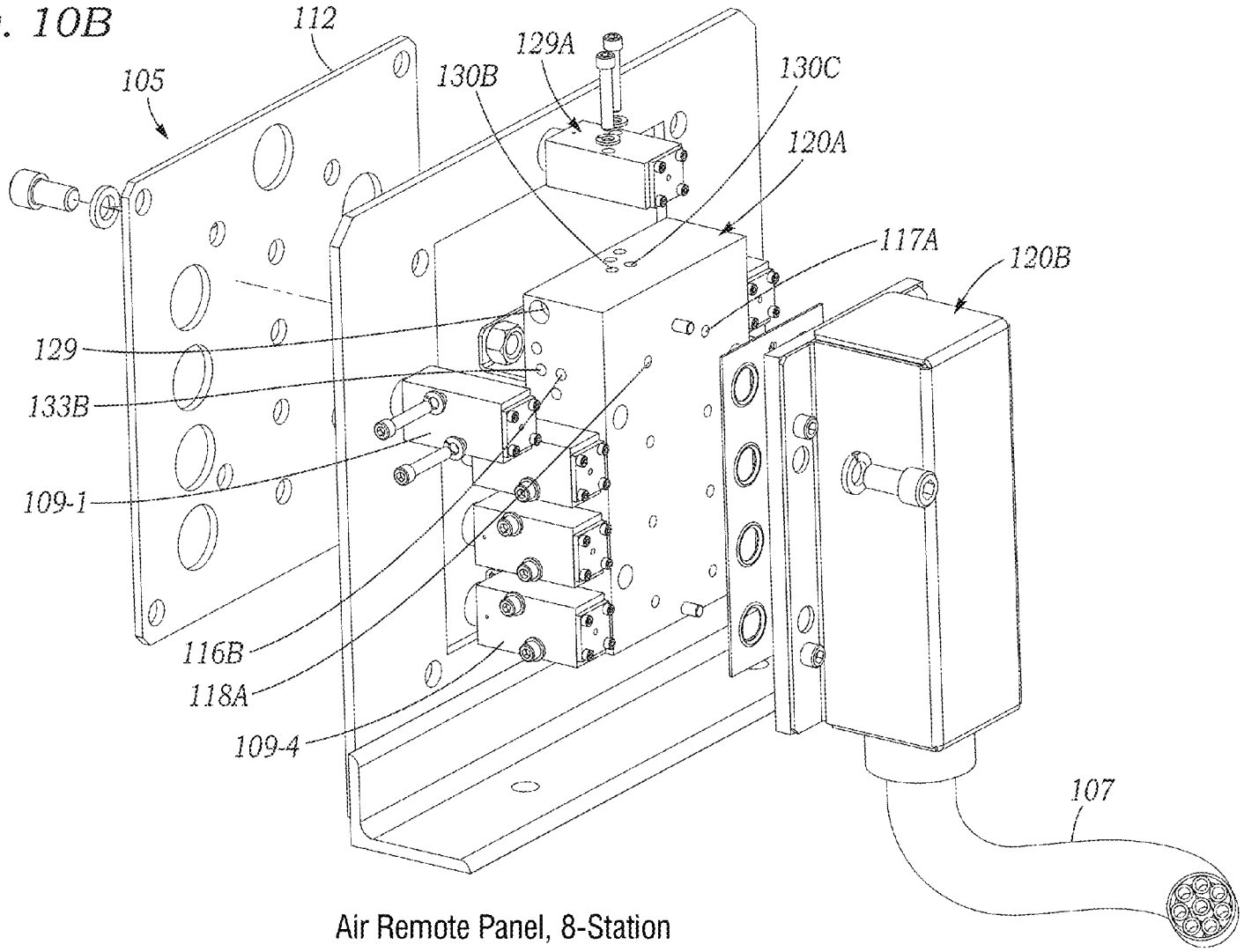
FIG. 10B is an exploded right rear perspective view of the air controller of FIG. 10A.
Figure 10C:
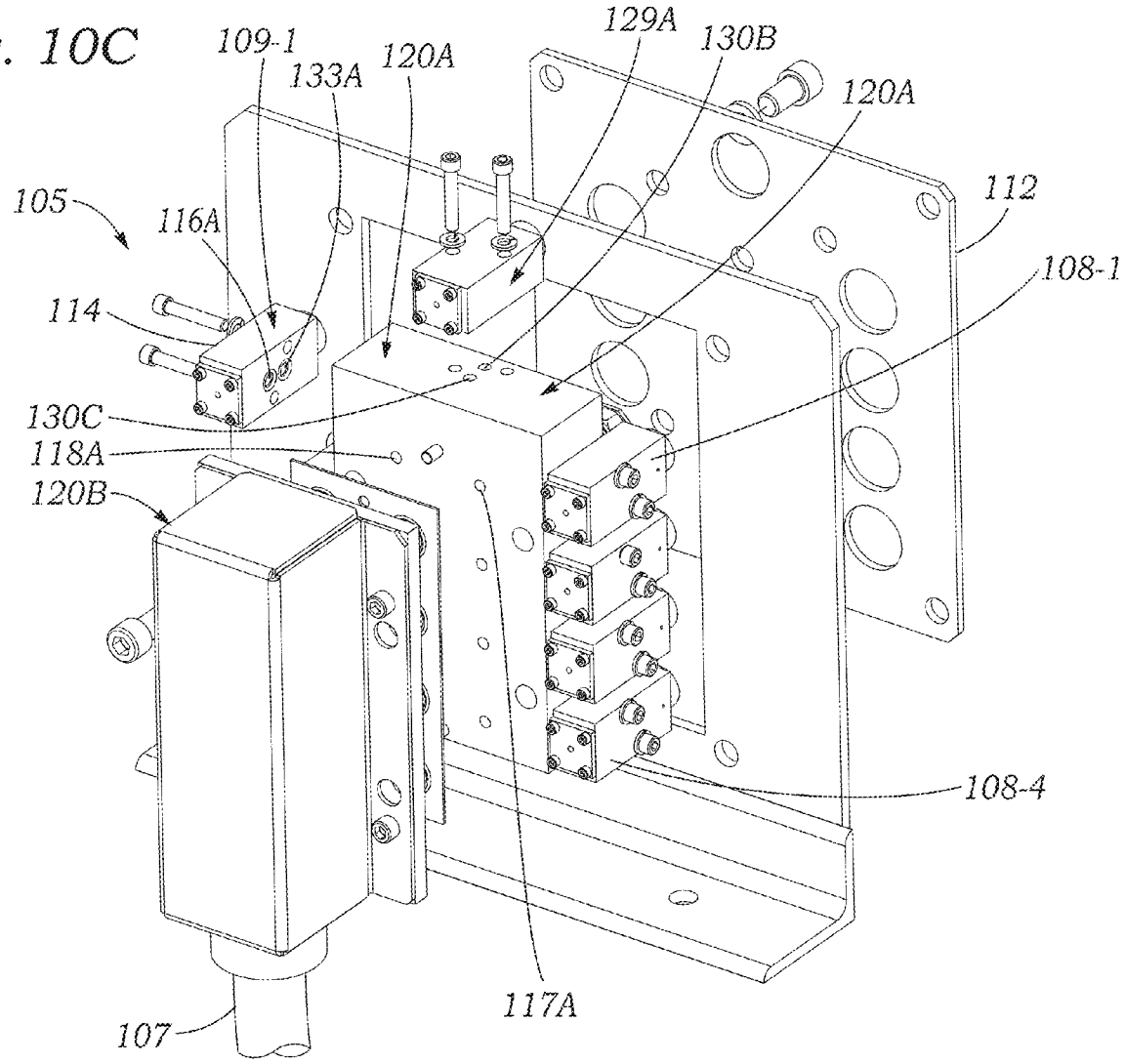
FIG. 10C is an exploded left rear perspective view of the air controller of FIG. 10A.

FIGS. 10B and 10C illustrate how a typical push-button valve, such as the upper right-hand CLOSING valve 109-1, is attached in pneumatic sealing contact to the right-hand vertical side of valve manifold 120A. As shown in FIGS. 10B and 10C, valve 109-1 has in an inner, left vertical side thereof an air outlet port 116A which fastens in hermetically sealing contact to port 116B in the right side of valve manifold 120A. Valve 109-1 also has an air inlet port 133A which fastens in hermetically sealing contact to port 133B in the right side of valve manifold 120A. As may be best understood by referring to FIG. 10C, left-hand OPENING valves, such as the upper left OPENING valve 108-1, are fastened in hermetically sealing contact with a portion of the left-hand vertical side of valve manifold 120A in an exactly analogous fashion.

Valve manifold 120A has internal air passageways (not shown) which connect a valve ports (not shown) in its left side wall and 116B in its right side wall with rear valve manifold ports 117A, 118A located in the rear face of valve manifold 120A.

As may be understood by referring to FIGS. 10A-10C, valve manifold outlet ports 117A, 118A in the rear face of valve manifold 120A are longitudinally aligned with inlet ports 117B, 118B in the front face of an air manifold 120B located rearward of valve manifold 120A. Air manifold 120B has internal air passages, such as the elbow 121A shown in FIG. 10A, which connect each inlet port 117B, 118B to a separate air outlet tube 121, 122. The distal ends of each pair of air outlet tubes 121, 122 are in turn connected to input ports 123, 124 of upper and lower air cylinders 125, 126 of a pneumatic actuator 104.

When front valve manifold 120A is bolted to rear air manifold 120B with rear and front faces thereof in hermetic sealing contact, aligned outlet-inlet port pairs 117A-117B, 118A-118B provide paths for pressurized air conducted through valves 108, 109 to air outlet tubes 121, 122.

As shown in FIGS. 6, 9, and 10A-C, apparatus 100 also includes a source of pressurized air such as an air compressor 127 which supplies pressurized air through a tube 128 to a pressurized air source inlet port 129 located in a side wall of valve manifold 120A.

As shown in FIGS. 10A and 10B, air panel control unit 105 includes a master air valve 129A which has an air inlet port 129B located in a bottom wall of a housing of the master air valve. Master air valve 129A also has an air outlet port 129C located in the bottom wall of the valve housing. The two ports in the housing of master air inlet valve 129A are vertically alignable with, and hermetically sealable to, corresponding ports in the upper wall of valve manifold 120A, when the master air valve 129A is bolted to the valve manifold. Thus valve manifold 120A has located in its upper wall a first, air supply inlet port 130B which is alignable with air inlet port 129B of master air valve 129A. Air inlet port 130B is connected through an internal passageway (not shown) within valve manifold 120A to pressurized air inlet" port 129 of the valve manifold.

Valve manifold 120A also has located in its upper wall a second, air supply outlet port 130C which is alignable with air outlet port 129C of master valve 129A. As may be understood by referring to FIGS. 19B and 10C, air outlet port 130C is connected through internal passageways (not shown) within valve manifold 120A through outlet ports 132B (not shown) and 133B to inlet ports 132A (not shown) and 133A of push button valves 108, 109. With this construction, pressurized air may be conducted through outlet ports 115A, 116A of push button valves 108, 109 and thence through valve manifold/air manifold port pairs 117A-117B, 118A-118B to air outlet tubes 121, 122 only when master air valve 129A is manually actuated to an ON position.

The example embodiment of air panel control unit 105 shown in FIGS. 10A-10C has in left and right, OPENING and CLOSING columns four OPENING valves 108-1 through 108-4 and four CLOSING valves 109-1 through 109-4. However, the modular design of air panel control unit may use fewer valves, in which case unused ports of valve manifold 120A would be plugged.

FIGS. 11A through 18 illustrate certain external structural features which determine form-factors, i.e., geometrical shapes, of the novel pneumatic actuator and hydraulic valve assemblies 101 according to the invention. Those figures also show how the novel construction of the actuator/valve assembles 101 facilitates mounting various numbers of the assemblies to a hydraulic manifold 102 in close proximity to thus construct a compact modular blow-out control apparatus 100.

Figure 15A:
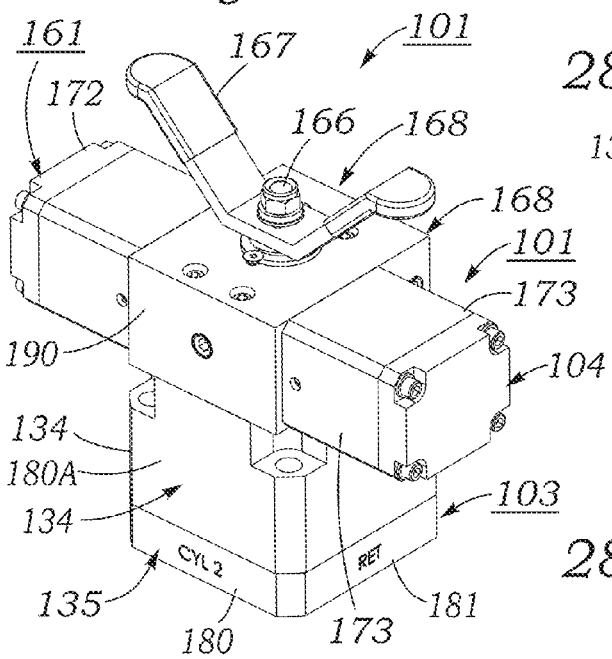
FIG. 15A is a left side perspective view of a single manifold-ported hydraulic valve and pneumatic actuator according to the present invention.
Figure 16:
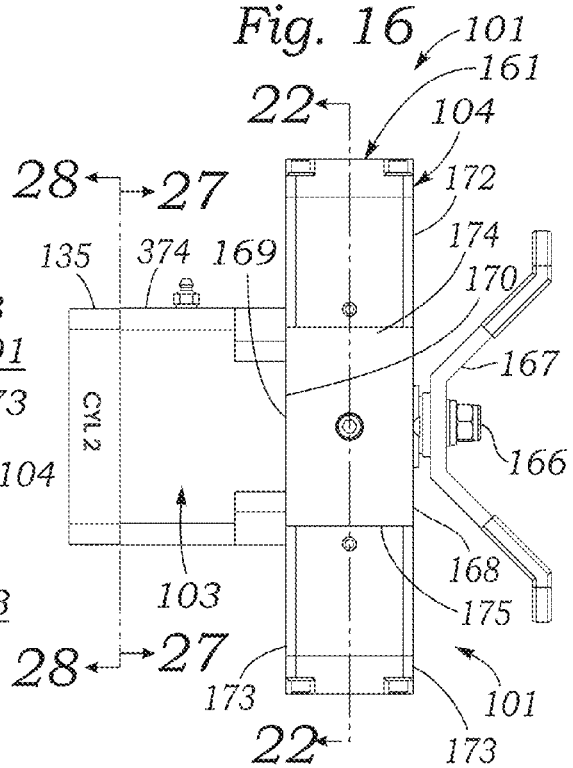
FIG. 16 is a left side elevation view of the valve and actuator of FIG. 15A.
Figure 17:
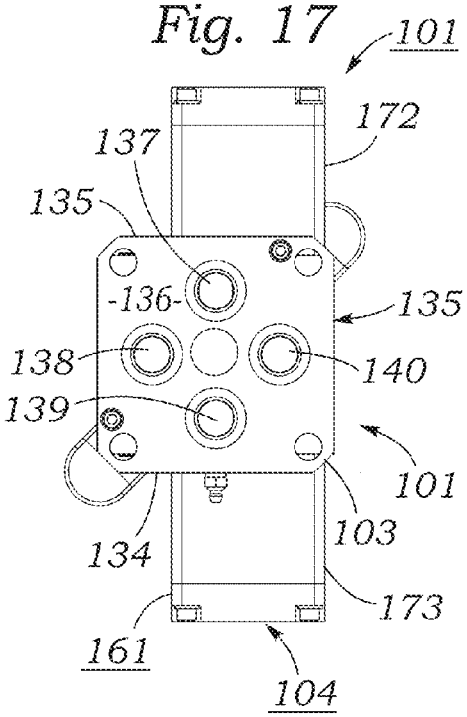
FIG. 17 is a rear elevation view of the valve and actuator of FIG. 15A.

Referring to FIGS. 11A-18, it may be seen that each actuator and hydraulic valve assembly 101 includes an hydraulic valve 103 which has a rectangular block-shaped housing 134. As shown in FIGS. 16 and 17, a base end of hydraulic valve housing 134 is fixed to a relatively thin, square cross-section valve port interface base plate 135. As shown in FIG. 17, a lower flat mounting surface 136 of valve port interface base plate 135 is penetrated by four hydraulic fluid ports which are spaced circumferentially apart at 90-degree intervals. The hydraulic fluid ports include a first, PRESSURE inlet port 137 for receiving pressurized hydraulic fluid. Inlet port 137 located at a 0-degree, twelve o'clock or top position.

As viewed from the front of valve 103, rather than from the rear view of FIG. 17, valve port interface base plate 135 of hydraulic valve 103 also has at a 90-degree, three-o'clock, or right-side position a second, Cylinder 1 (OPENING) hydraulic fluid outlet port 138 for connection to the OPENING hydraulic actuator cylinder of a blow-out preventer.

As is also shown in FIG. 17, mounting surface 136 of valve port interface base plate 135 is penetrated by a third, hydraulic fluid RETURN outlet port 139, which is located at a 180-degree, six-o'clock or bottom position relative to pressurized hydraulic fluid inlet port 137. The RETURN port is provided for connection through a RETURN hydraulic line to a hydraulic fluid reservoir.

Valve port interface base plate 135 has a fourth, Cylinder 2 CLOSING hydraulic fluid outlet port 140 which is located at a 270-degree, nine-o'clock or left-side position relative to the first, pressurized fluid inlet port 137. The Cylinder 2, CLOSING port 140 is provided for connection to the CLOSING hydraulic actuator cylinder of a blow-out preventer.

As may be understood by referring to FIGS. 11A-13 and 17, the hydraulic fluid ports 137, 138, 139 and 140 in valve port interface base plate 135 of valve housing 134 facilitate mounting hydraulic valve 103 on the flat front surface 141 of hydraulic manifold 102.

Figure 11A:
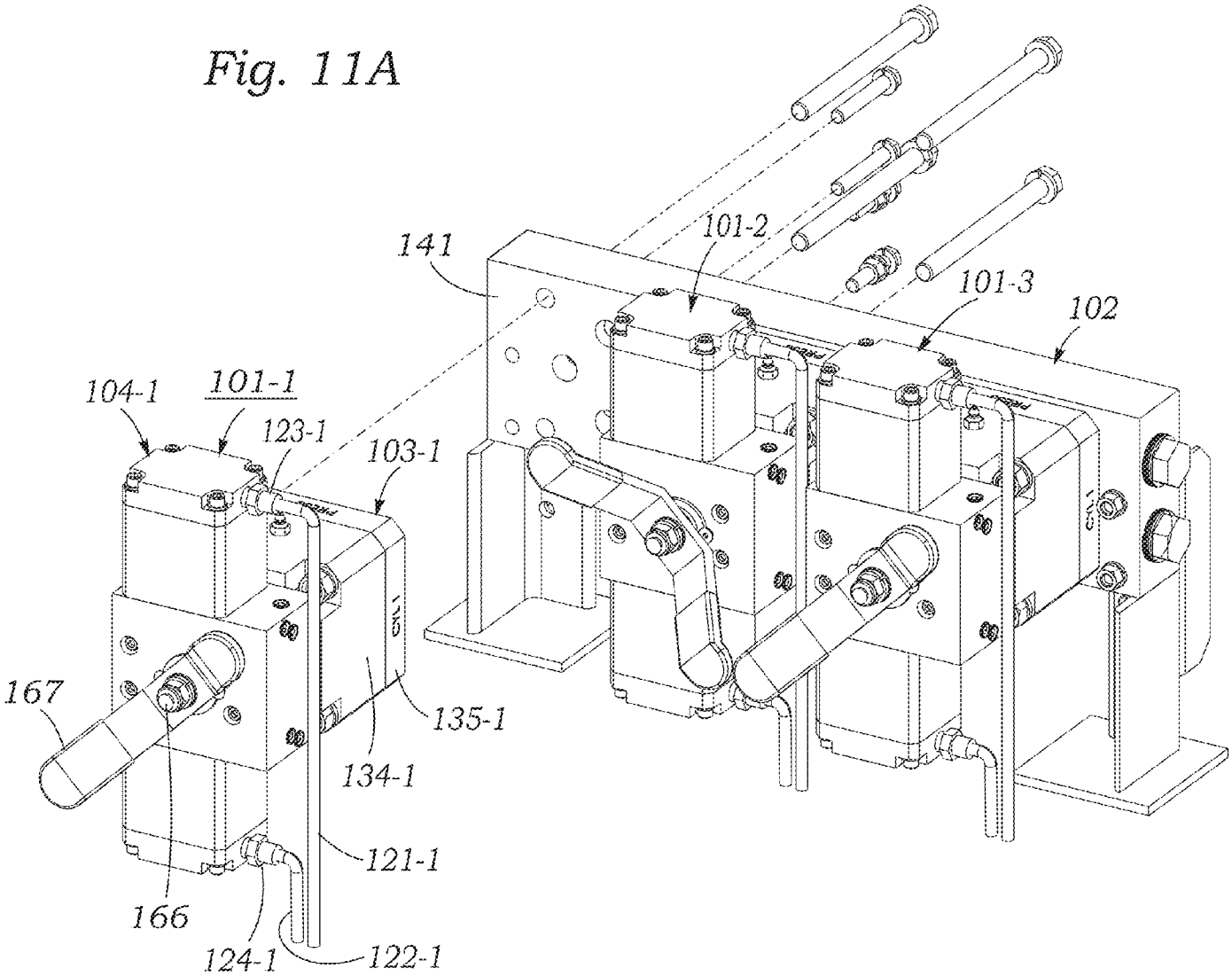
FIG. 11A is a right side front perspective view of a manifold, hydraulic valve and pneumatic actuator assembly of the control apparatus of FIG. 6, showing one valve and actuator module thereof removed from the manifold.
Figure 11B:
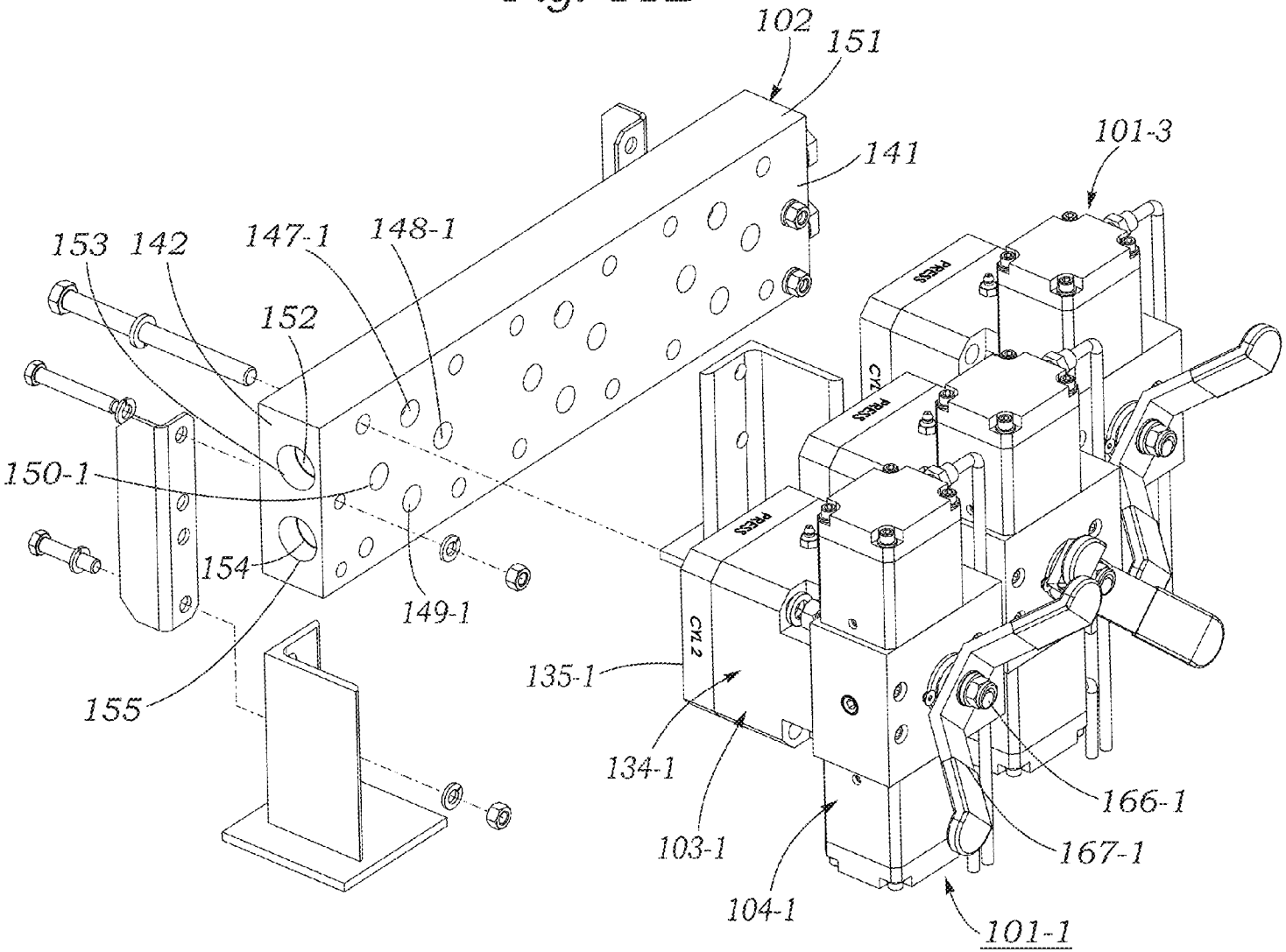
FIG. 11B is a left perspective view similar to that of FIG. 11A, showing three valve actuators assemblies removed from the manifold.
Figure 13:
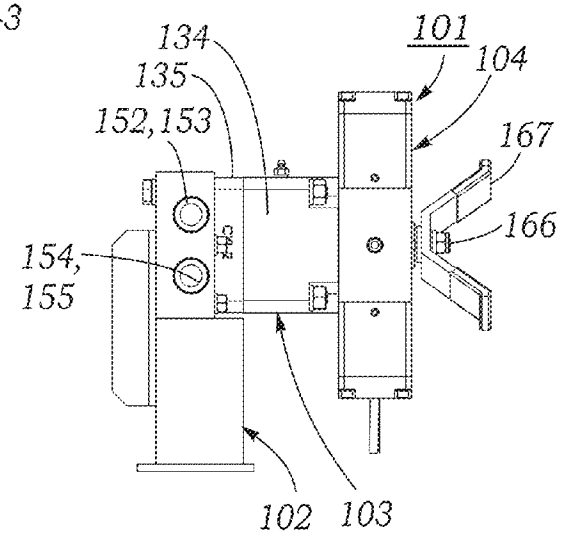
FIG. 13 is a right side elevation view of the assembly of FIG. 11.

As may be seen best by referring to FIG. 11B, manifold 102 has hydraulic fluid ports which are alignable with the hydraulic fluid ports 137-140 in valve port interface base plate 135 of the housing of a hydraulic valve 103. Thus, for example, as shown in FIG. 11B, manifold 102 has in a front surface 141 thereof near a left-hand side 142 of the manifold a first set of four ports, 147-1, 148-1, 149-1, 150-1, which are alignable with ports 137-1, 138-1, 139-1 and 140-1, respectively, of a first, left-hand valve and actuator assembly 101-1.

As may be envisioned by referring to FIG. 11B, manifold port 147-1, which is located at a twelve o'clock position, is connectable in a fluid pressure-tight connection to aligned port 137-1 of hydraulic valve 103-1 when the housing 134-1 of that valve is bolted onto manifold 102. Within the block-shaped body 151 of manifold 102 is located a first, upper manifold runner tube channel 152 which has an inlet port 153 that is connectable to a source of pressurized hydraulic fluid, such as a single hydraulic accumulator or a bank of accumulators.

Referring still to FIG. 11B, it may be understood that manifold port 149-1, which is located at a six-o'clock position is connectable in a fluid pressure-tight connection to aligned port 139-1 of hydraulic valve 103-1 when the housing 134-1 of that valve is bolted onto manifold 102. Within the body 151 of manifold is located a second, lower manifold runner tube 154 which has an outlet port 155 that is connectable to a reservoir for hydraulic fluid.

Figure 14:
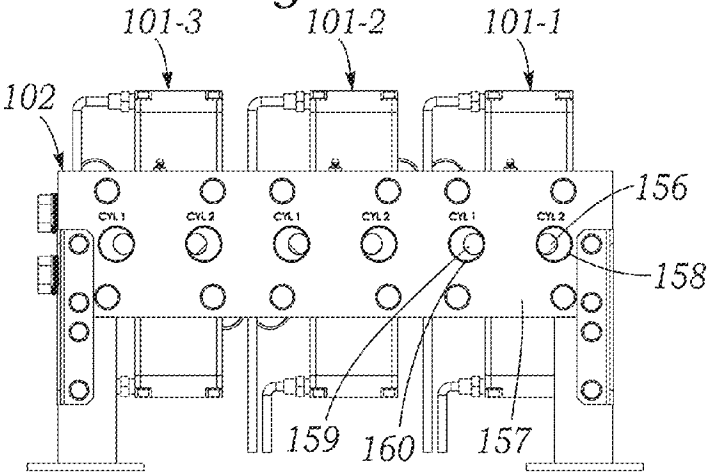
FIG. 14 is a rear elevation view of the assembly of FIG. 11.

Referring to FIGS. 11B and 17, it may be seen that manifold port 148-1, which is located at a three-o'clock position, is connected in a fluid pressure-tight connection to aligned port 138-1 of hydraulic valve 103-1 when the housing 134-1 of that valve is bolted onto manifold 102. As shown in FIG. 14, body 151 of manifold 102 has disposed therethrough a passageway 159 which penetrates the rear surface 157 of the body and has a CYLINDER 1, OPENING port 160 which is connectable by a hydraulic pressure line to the OPENING hydraulic actuator of a blow-out preventer. When handle 167 and rotor 166 of valve 103 are rotated 45 degrees counterclockwise from a center NEUTRAL position to an OPEN position, pressurized hydraulic fluid inlet to PRESSURE inlet port 137 is conducted through valve 103 to OPENING outlet port 160.

As may also be understood by referring to FIGS. 11B and 17, manifold port 150-1, which is located at a nine-o'clock position, is connected in a fluid pressure-tight connection to aligned port 140-1 of hydraulic valve 103 when the housing 134-1 of that valve is bolted onto manifold 102. Body 151 of manifold 102 has disposed therethrough a passageway 156 which penetrates the rear surface 157 of the body and has a CYLINDER 2, CLOSING port 158 which is connectable by a hydraulic pressure line to the CLOSING hydraulic actuator of a blow-out preventer. When handle 167 and rotor 166 of valve 103 are rotated 45 degrees clockwise from a center NEUTRAL position to a CLOSED position, pressurized hydraulic fluid inlet to PRESSURE inlet port 137 in conducted through valve 103 to CLOSING outlet port 158.

As shown in FIGS. 11A-18B and is described in detail below with reference to FIGS. 19-26, the pneumatic actuator 104 of each actuator/valve assembly 101 has within a longitudinally elongated rectangular cross-section prism-shaped housing 161 thereof upper and lower air cylinders 125, 126, which are pressurizable by upper and lower air inlet lines 121, 122, respectively. As is described below, air cylinders 125, 126 are contained within upper and lower housings 172, 173 that extend upwardly and downwardly, respectively from a central block-shaped section 168 of housing 161 of actuator 104.

Figure 18A:
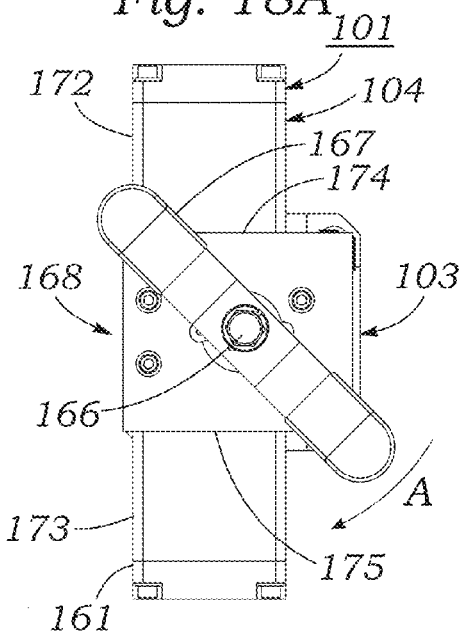
FIG. 18A is a front elevation view of the valve and actuator of FIG. 15A, showing the valve in a counterclockwise limit position.

As will be described in detail below, actuator/valve assembly 101 is constructed in a manner which causes a valve rotor shaft 166 and manual control handle 167 of valve 103 to rotate to a counterclockwise OPEN position when upper air cylinder 125 is pressurized with air through upper actuator air inlet line 121, as shown in FIG. 18A.

Figure 12:
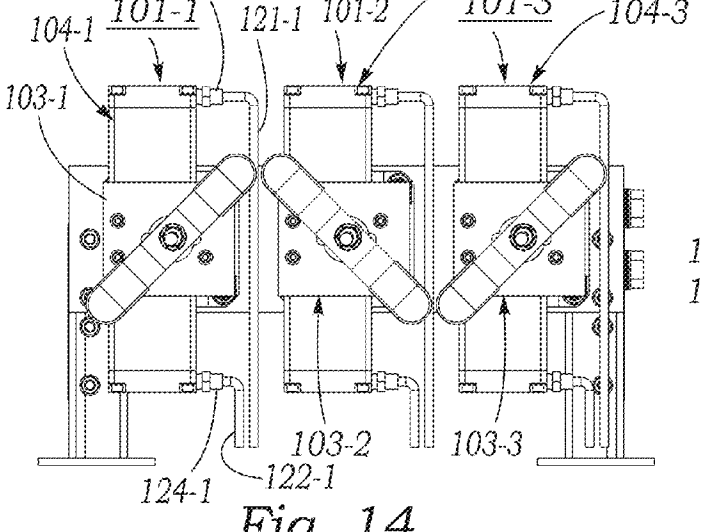
FIG. 12 is a front elevation view of the assembly of FIG. 11.

Conversely, when lower air cylinder 173 is pressurized with air through lower actuator air inlet line 122, valve rotor shaft 166 and manual control handle 167 are rotated to a clockwise CLOSED position, as shown for actuator/valve assembly 101-1 in FIGS. 11A, 11B and 12.

As shown in FIGS. 15A and 16, valve handle 167 may be manually operated to orient valve rotor 176 to a NEUTRAL position parallel to the longitudinal axes of the upper and lower cylinders.

As shown in FIGS. 15A-18B, the housing 161 of actuator 104 of each actuator/valve assembly 101 has a flat, square rear face 169 that seats on and is bolted to the square, flat, front face 170 of valve housing 134 by bolts 171.

The construction and function of upper and lower pneumatic actuator air cylinders 125, 126, in upper and lower housing extensions 172, 173, respectively, of actuator 104 are described in detail below.

Referring still to FIGS. 15A-18B, it may be seen that valve housing 134, which extends congruently upwards from relatively thin, square cross-section valve port interface base plate 135, contains a valve rotor 176. As shown in the figures, valve port interface base plate 135 has a flat, square upper face 177 which is fastened in abutting contact to a lower flat, square face 178 of valve housing 134.

As is also shown in the figures, valve port interface base plate 135 has through lower flat surface 136 thereof the hydraulic fluid ports 137, 138, 139, 140 which were described previously. Also, valve port interface base plate 135 has depending perpendicularly upwards from lower flat surface 136 thereof a left side 180 inscribed with CYLINDER 2, a right side 181 inscribed with CYLINDER 1, and upper side 182 inscribed with PRESSURE, and a lower side 183 inscribed with RETURN. As shown in FIGS. 15-18B, valve housing 134 has sides 180A, 181A, 182A and 183A which are co-planar extensions of corresponding sides 180, 181, 182 and 183 of valve port interface base plate 135.

As may be seen best by referring to FIGS. 15A-18B and 23, central square cross-section block-shaped section 168 of actuator housing 161 has a left side wall 190 which is approximately co-planar with left side 180A of valve housing 134. Central block-shaped section 168 of actuator housing 161 also has a right side 191 which is parallel to but recessed inwardly slightly from right side 181A of valve housing 134. Also, central block-shaped housing section 168 of actuator housing 161 has an upper side face 174 and a lower side face 175 which are parallel to but recessed inwardly from upper and lower sides 182A and 183A, respectively, of valve housing 134.

FIGS. 15B and 19-38 illustrate in further detail the construction and function of a novel pneumatic actuator and hydraulic valve assembly 101 according to the present invention, consisting of a pneumatic actuator 104 and hydraulic valve 103.

As shown in FIGS. 15B, 19-21 and 27, rotor 176 of valve 103 has generally the shape of a relatively thick circular disk or short right-circular cylinder. Rotor 176 is rotatably located within a cylindrically-shaped well 192 which extends perpendicularly inwards from lower square face 178 of valve housing 134, and is supported by a ring-shaped ball bearing race 196 which holds therein a multiplicity of spherical ball bearings 197 that rollingly contact a circular annular ring-shaped groove 198 formed in the upper end portion of well 192.

Figure 20:
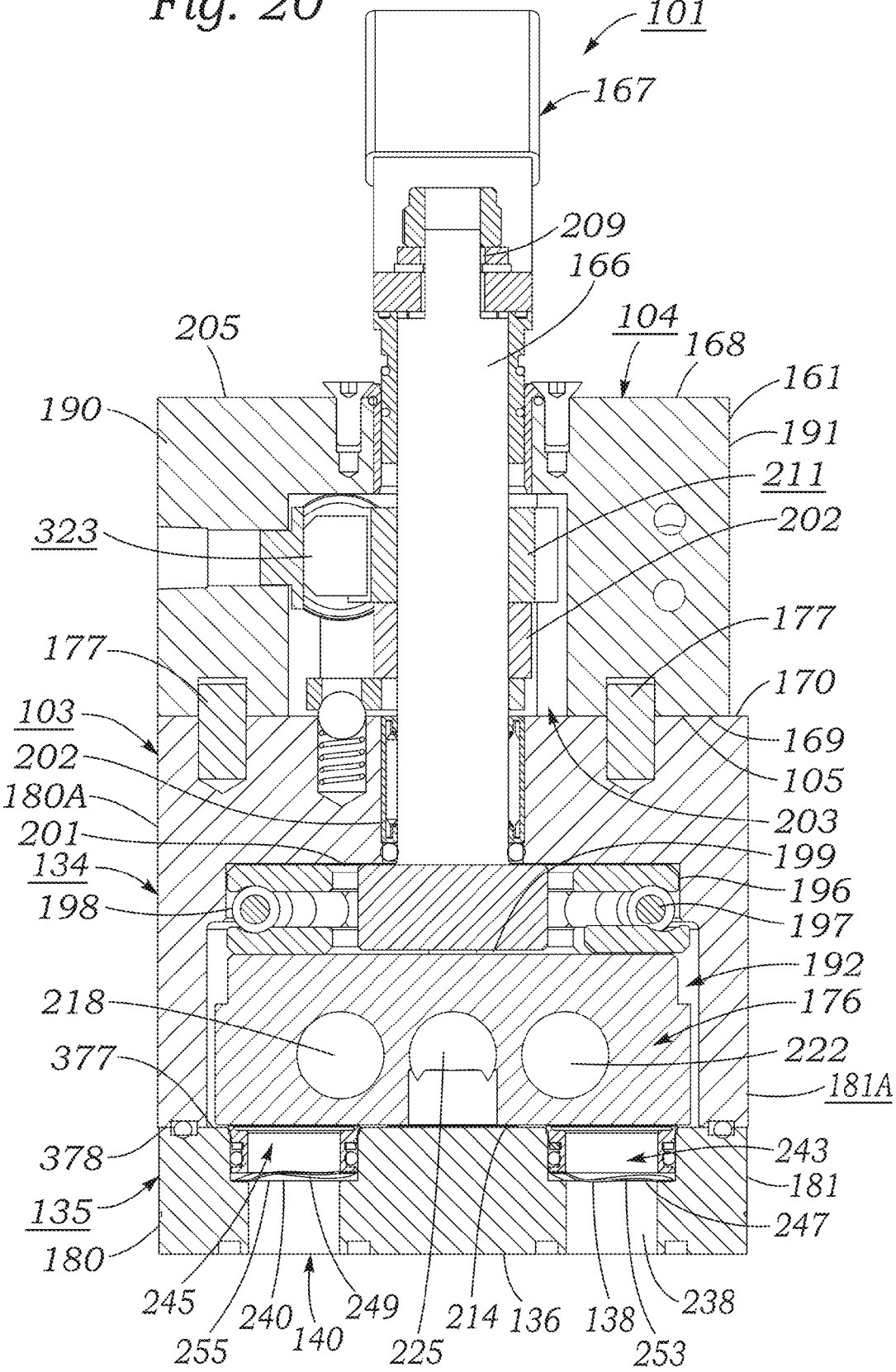
FIG. 20 is a horizontal longitudinal sectional view of the valve and actuator of FIG. 18, taken in the direction of line 20-20.
Figure 21:
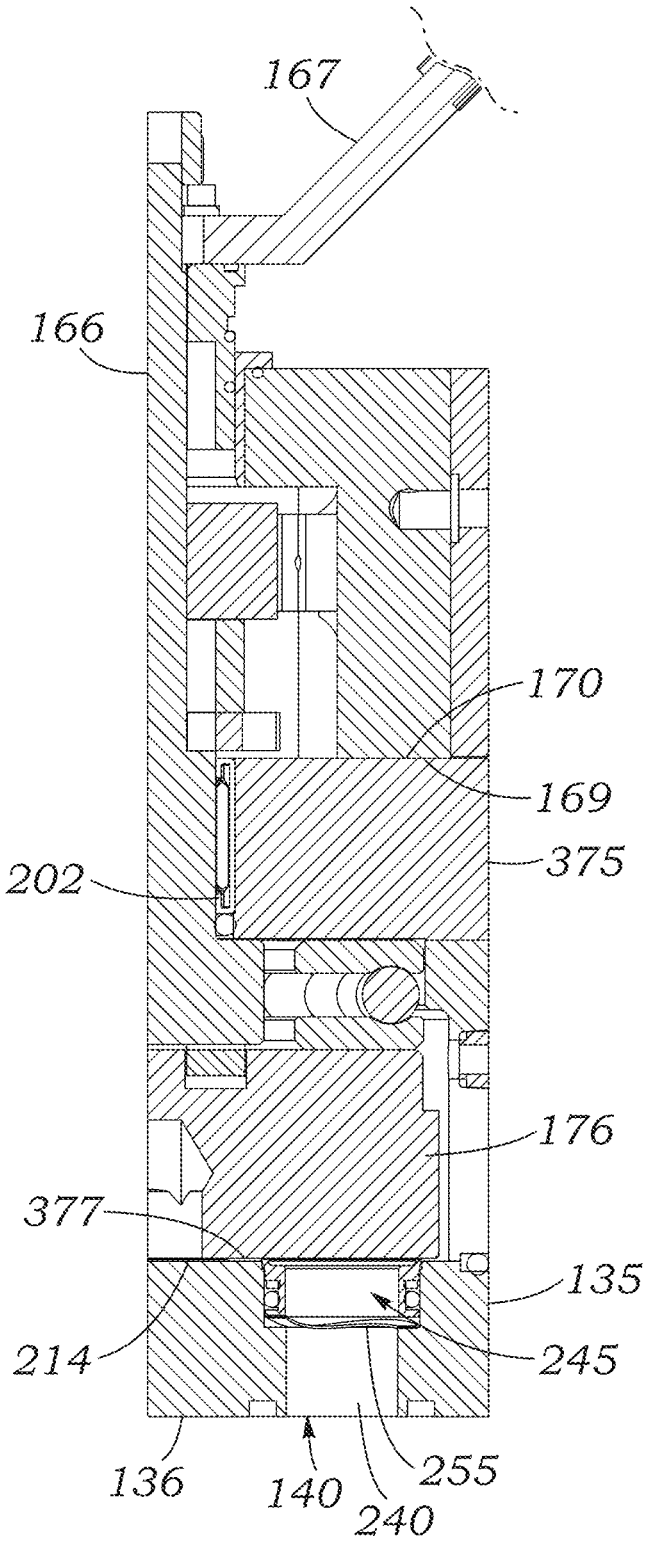
FIG. 21 is another vertical longitudinal sectional view of the valve and actuator of FIG. 18, taken in the direction of line 21-21.
Figure 22:
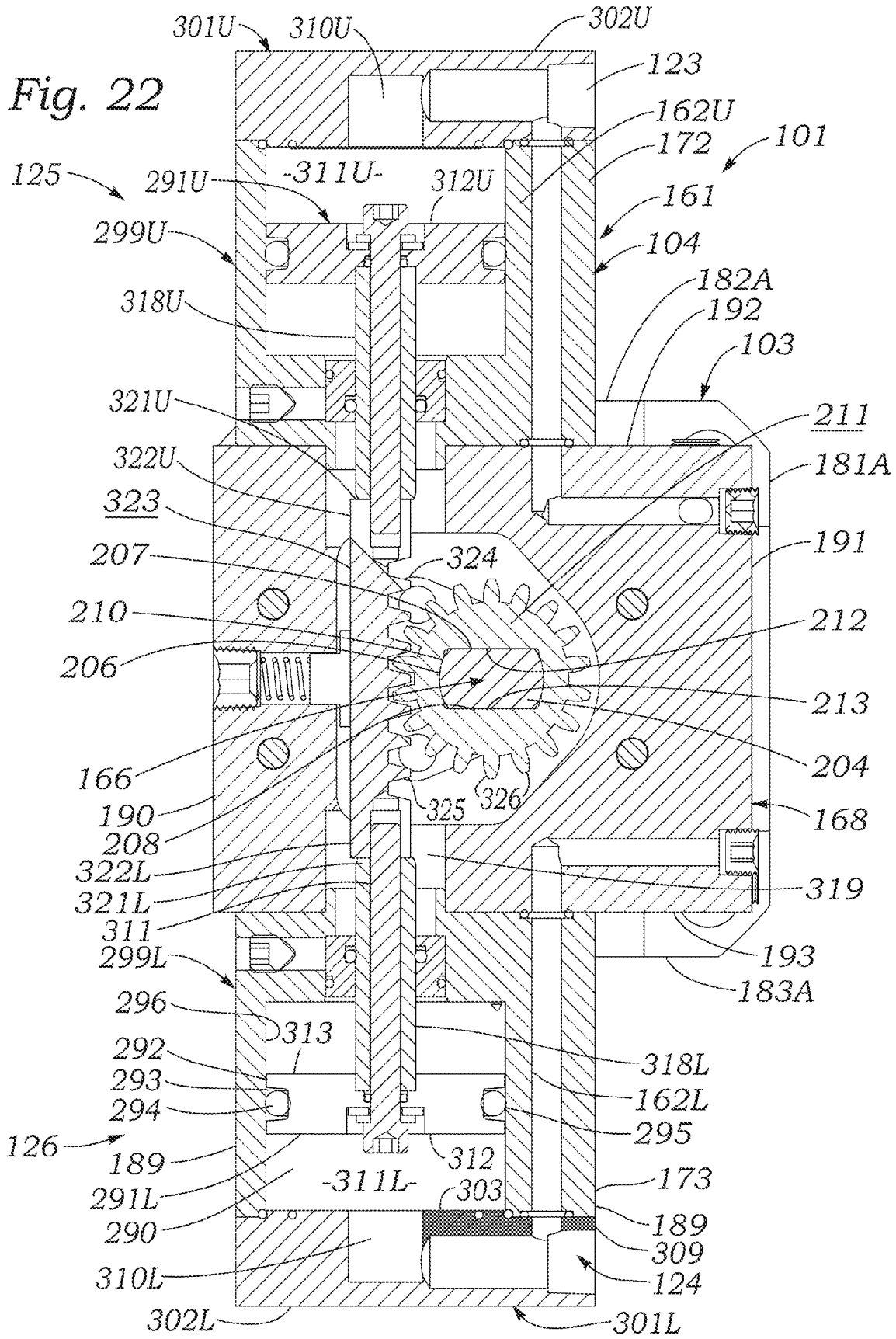
FIG. 22 is a transverse sectional view of the valve and actuator of FIG. 16, taken in the direction of line 22-22.
Figure 23:
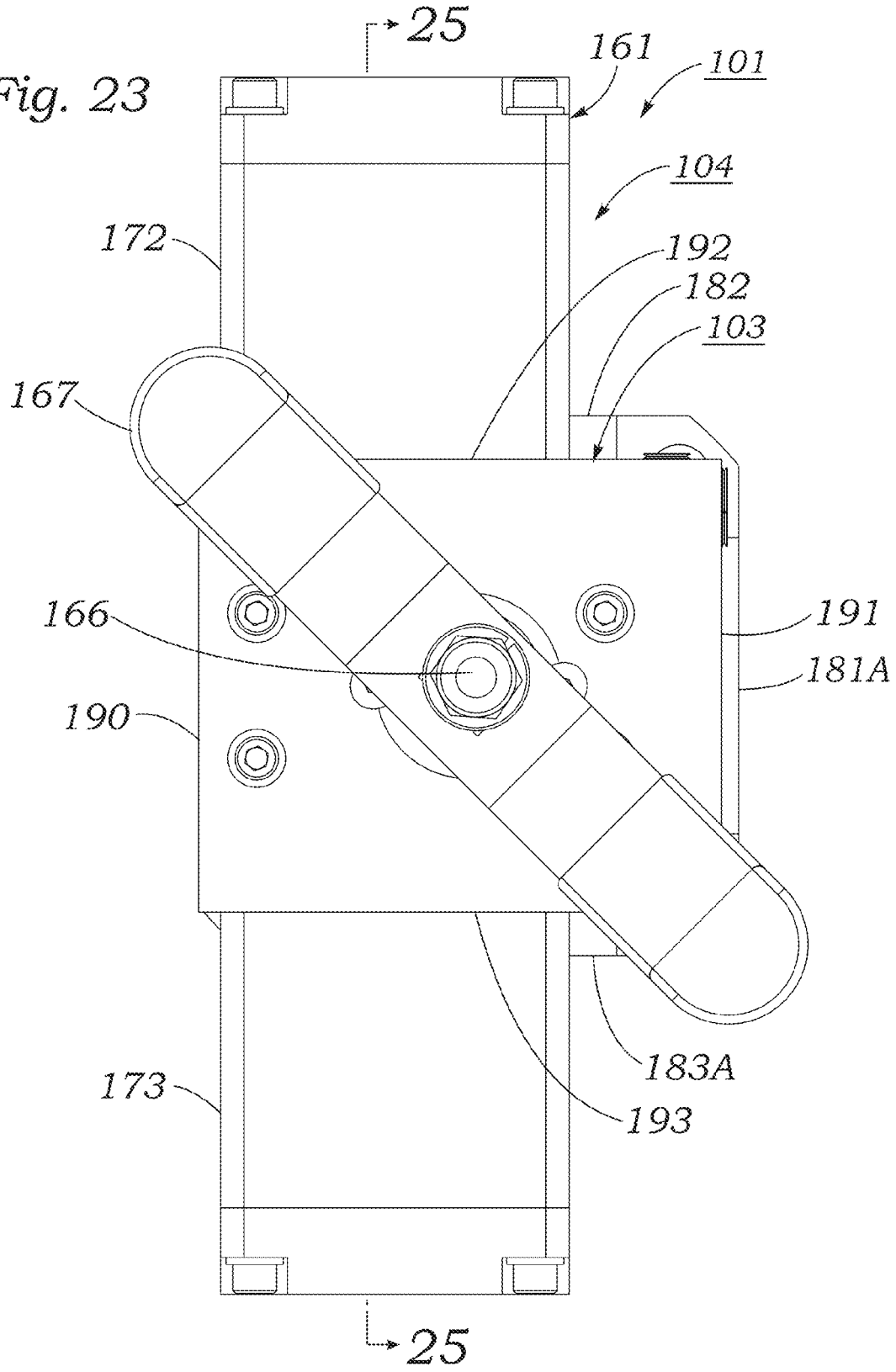
FIG. 23 is a front elevation view of the valve and actuator of FIG. 18B, showing the valve in an OPEN counterclockwise limit position in which hydraulic fluid may be routed through the valve to the opening hydraulic actuator cylinder of a BOP.
Figure 24:
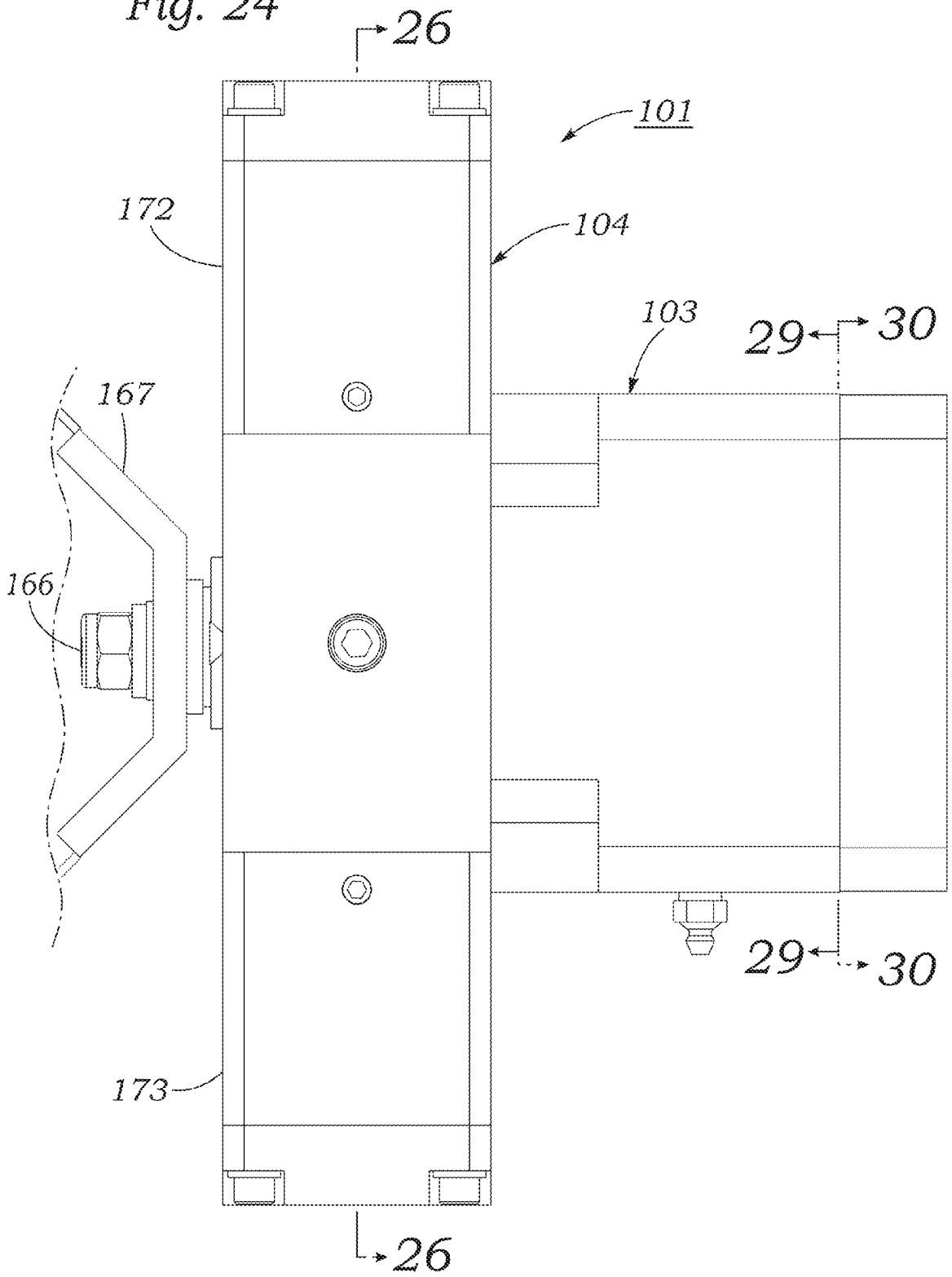
FIG. 24 is a right-side elevation view of the valve and actuator of FIG. 23.

As shown in FIGS. 20-22, valve rotor 176 has extending perpendicularly upwards from upper surface 199 thereof an elongated circular cross section coaxial rotor shaft 166. Rotor shaft 166 is disposed through a vertically disposed bore 201 through valve housing 134, and is rotatably supported within the bore by a sleeve bearing or bushing 202. As shown in FIG. 20, valve rotor shaft 166 extends upwardly through upper face 170 of valve housing 134, and through a bore 203 disposed upwardly into lower face 169 of actuator housing center section 168 and extends upwardly from upper face 205 of the actuator housing center section.

As may be seen best by referring to FIGS. 20-22, an upper part of valve rotor shaft 166 has formed in opposite sides of the outer circumferential wall surface 206 of the shaft a pair of parallel, diametrically opposed flats 207, 208 that form an upper flatted or keyed shaft section 209. The upper keyed section 209 of valve rotor shaft 166 is received in a central keyed hole 210 through a spur gear 211 located in actuator 104. Keyed hole 210 through spur gear 211 has the shape of a circle which has indented flat, parallel diametrically opposed sides 212, 213, and thus comprises a keyway which has a shape complementary to the outer transverse cross-sectional shape of the keyed section 209 of valve rotor shaft 166. The flat inner sides 212, 213 of the keyed hole 210 conformally receive the flat sides 207, 208 of the valve rotor shaft. Optionally, shaft 166 may have a circular cross-section which has a slot for receiving a key that fits into a keyway in spur gear 211 to facilitate transmission of torque from the rack gear to valve rotor shaft 166.

Referring to FIGS. 20, 21, 27, 33 and 34, it may be seen that valve rotor 176 has disposed perpendicularly upwards from lower circular face 214 thereof a series of circular cross-section bores which are rotatably alignable with bores 137, 138, 139 and 140 through valve port interface base plate 135 of valve 103.

Figures 27, 28:
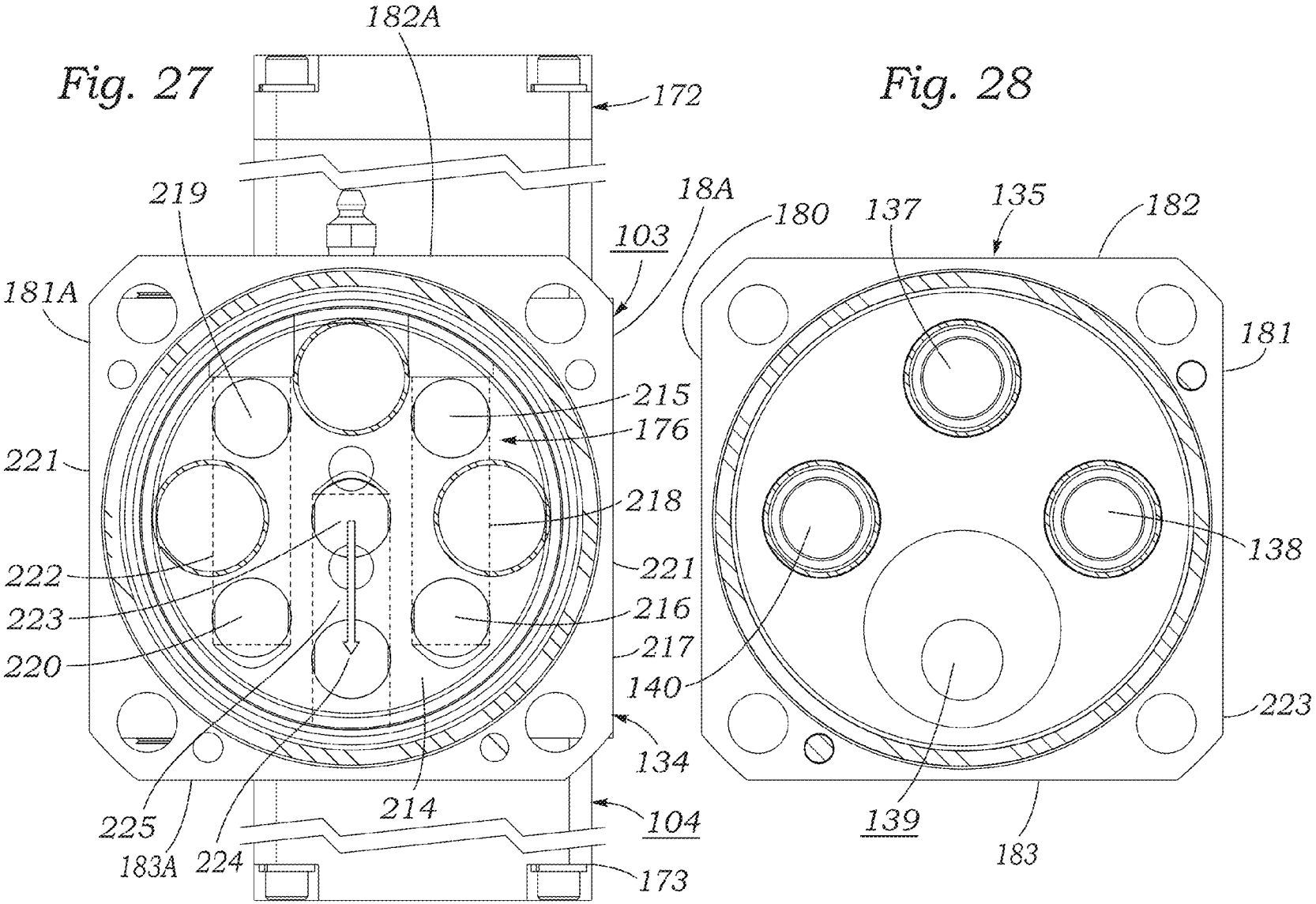
FIG. 27 is a forward-looking transverse sectional view of the valve and actuator in the NEUTRAL position of FIG. 16, taken in the direction of line 27-27.
FIG. 28 is a rearward-looking transverse sectional view of the valve of FIG. 16, taken in the direction of line 28-28.
Figure 30:
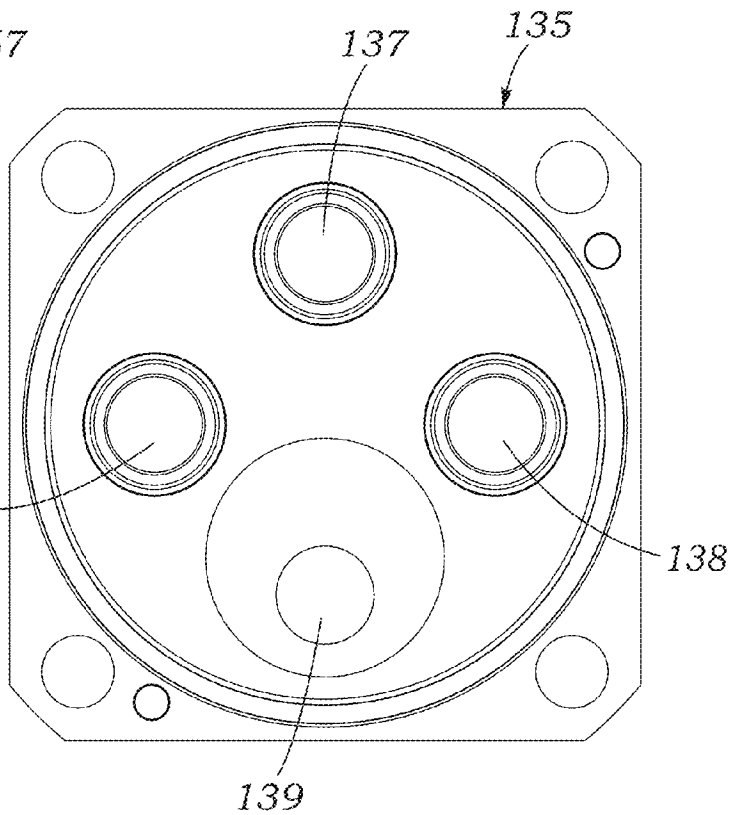
FIG. 30 is a rearward-looking transverse sectional view of the valve of FIGS. 23 and 24, taken in the direction of line 30-30.

FIG. 27 is a lower plan view of valve housing 134, which shows the various ports and passageways for hydraulic fluid within the valve rotor 176, with the rotor oriented at a zero-degree, NEUTRAL rotation angle relative to valve housing 134. Thus, as shown in FIG. 27, rotor 176 has in a lower face 214 thereof a first, left-side pair of ports 215, 216 which are located on a chord of the rotor near the left side 217 of valve housing 134, equidistant from a horizontal diameter of the rotor disposed perpendicularly to the chord. Left-side ports 215, 216 are located at upper and lower ends, respectively, of a first, left-side tubular passageway 218 within valve rotor 176.

Referring still to FIG. 27, valve rotor 176 has in lower face 214 thereof a second, right-side pair of ports 219, 220 which are mirror symmetric, through a longitudinal vertical plane of valve housing 134, with left-side ports 215, 216. Thus, right-side ports 219, 220 are located on a chord of rotor 176 near the right side 221 of valve housing 134, equidistant from a horizontal diameter of the rotor disposed perpendicularly to the chord. Ports 219, 220 are located at upper and lower ends, respectively, of a second, right-side tubular passageway 222 within valve rotor 176.

As is also shown in FIG. 27, valve rotor 176 has in lower face 214 thereof a third, center-line pair of upper and lower ports 223, 224, located at upper and lower ends of a third, center-line tubular passageway 225 through the rotor. Upper port 223 of center-line passageway 225 is coaxially centered on the longitudinal axis of rotor 176, and port 224 is located near the lower end of a vertical radius of the rotor.

Left, right and center-line passageways 218, 222 and 225 within rotor 176 are used to conduct hydraulic fluid between various ports 137, 138, 139 and 140 for various rotational orientations of valve rotor 176, as will now be described. Thus, as shown in the figures, with valve rotor 176 oriented at a zero-degree, NEUTRAL rotation angle, center-line passageway 225 provides a path for excess hydraulic fluid which may be trapped between the lower surface 214 of valve rotor 176 and upper surface 227 of valve port interface base plate 135. In this position of the valve rotor 176 relative to the valve port interface base plate 135, excess hydraulic fluid is conducted from upper, inlet port 223 to lower, outlet port 224, out through lower port 139 through valve port interface base plate 135 and into a RETURN port 149 in front face 141 of hydraulic manifold 102.

Figure 29:
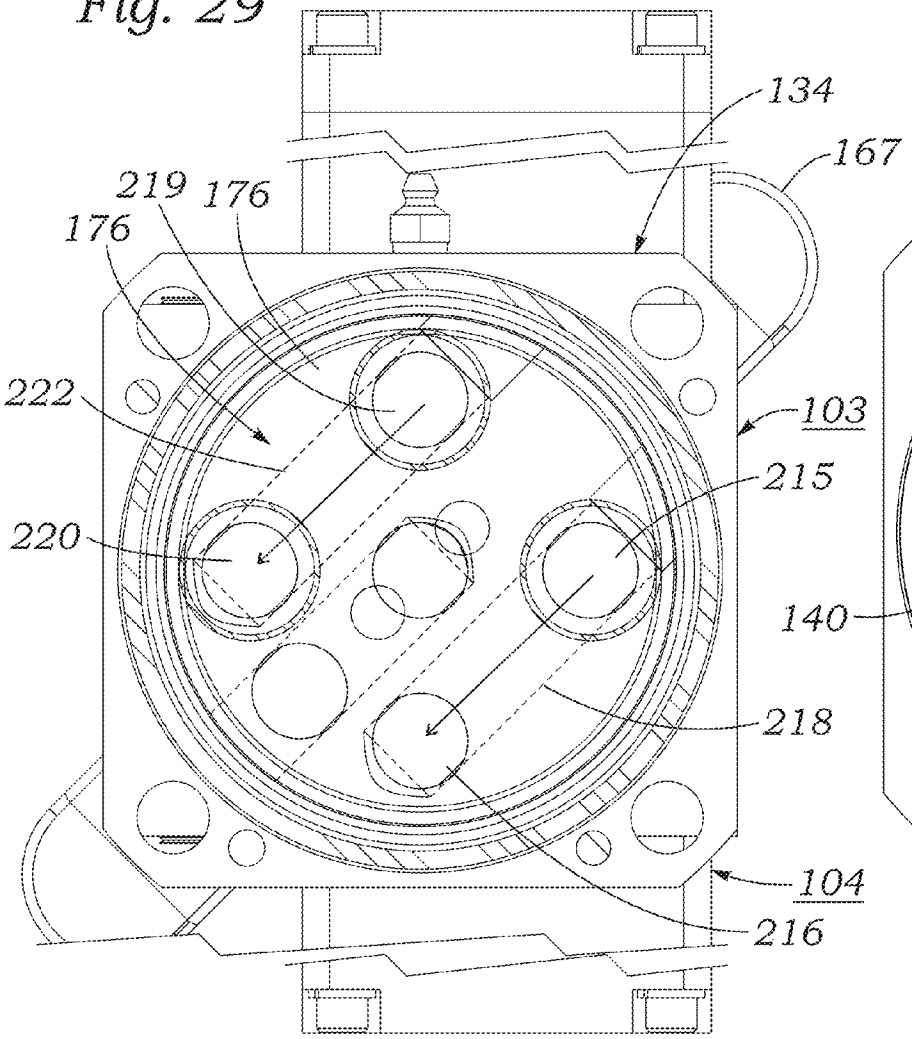
FIG. 29 is a forward-looking transverse sectional view of the valve and actuator in the open position shown in FIGS. 23 and 24, taken in the direction of line 29-29.
Figure 32:
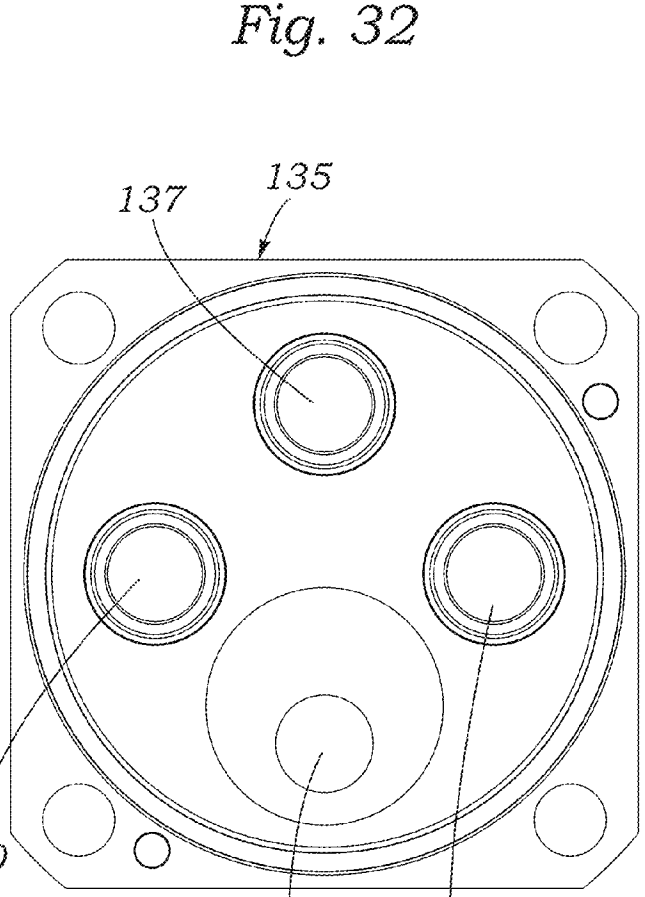
FIG. 32 is a rearward-looking transverse sectional view similar to that of FIG. 28 but showing the valve rotor turned to the clockwise limit position as in FIG. 31.
Figure 35:
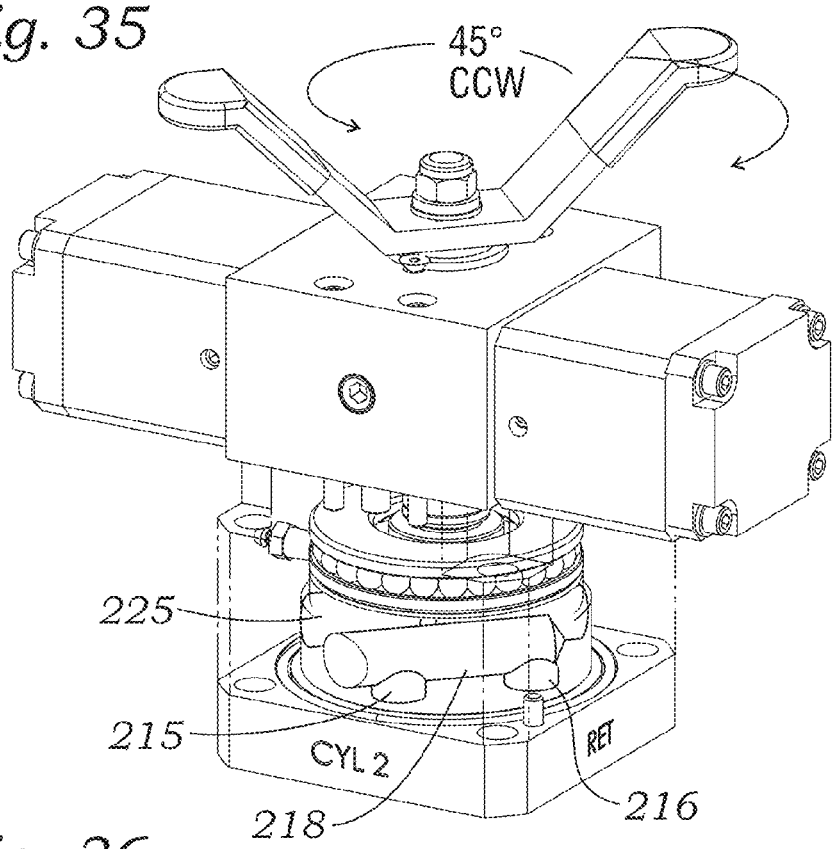
FIG. 35 is a view similar to that of FIG. 33, but showing the valve and actuator in a counterclockwise, OPEN position.
Figure 36:
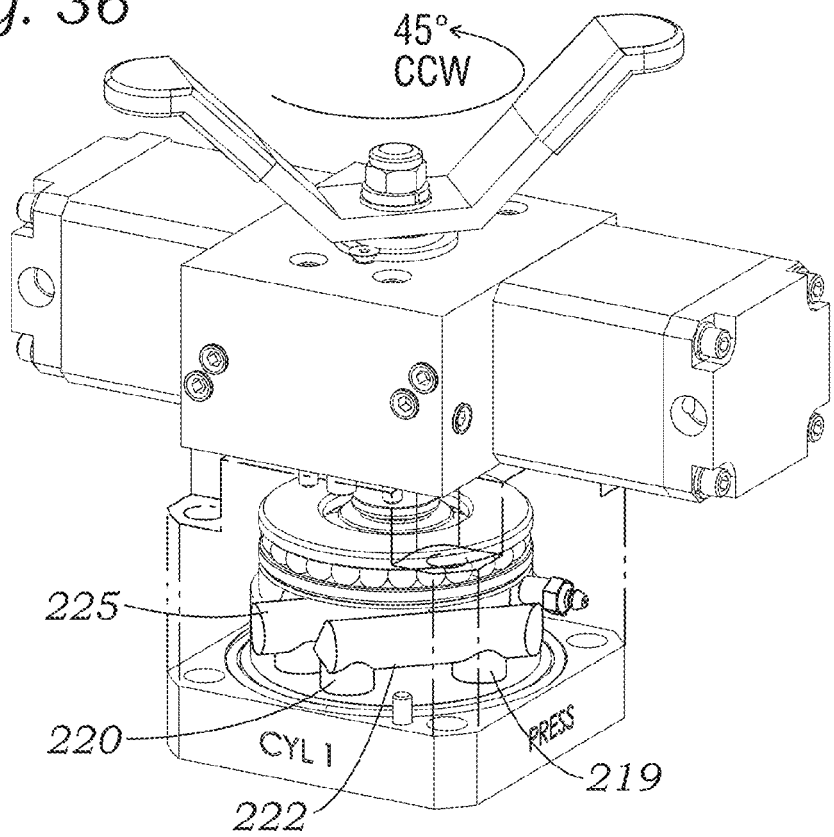
FIG. 36 is a right side perspective view of the valve and actuator of FIG. 35.

When valve rotor 176 is rotated 45 degrees counterclockwise relative to valve port interface base plate 135, as shown in FIGS. 29, 35, and 36, upper port 219 of right-side valve rotor passageway 222 becomes aligned with fluid PRESSURE inlet ports 137 and 147 of valve port interface base plate 135 and hydraulic manifold 102, respectively. In this position, pressurized hydraulic fluid may be introduced into upper port 219 of right-side passageway 222, conducted through that passageway to lower, outlet port 220 of the right-side passageway, and conducted through CYLINDER 1, OPENING cylinder valve outlet port 138 and an aligned port 148 of the hydraulic manifold 102, and thence through a hydraulic line to the OPENING inlet port of a hydraulic actuator cylinder of a remote blow-out preventer.

In the 45-degree counterclockwise orientation of valve rotor 176, upper port 215 of left-side valve rotor passageway 218 is aligned with CYLINDER 2 ports 140, 150 of valve port interface base plate 135 and manifold 102, respectively. Also in this 45-degree counterclockwise orientation, lower outlet port 216 of left-side passageway 218 aligns with RETURN outlet ports 139, 149 of the valve port interface base plate 135 and manifold 102, allowing fluid flow from CYLINDER 2 to a fluid reservoir.

Figure 31:
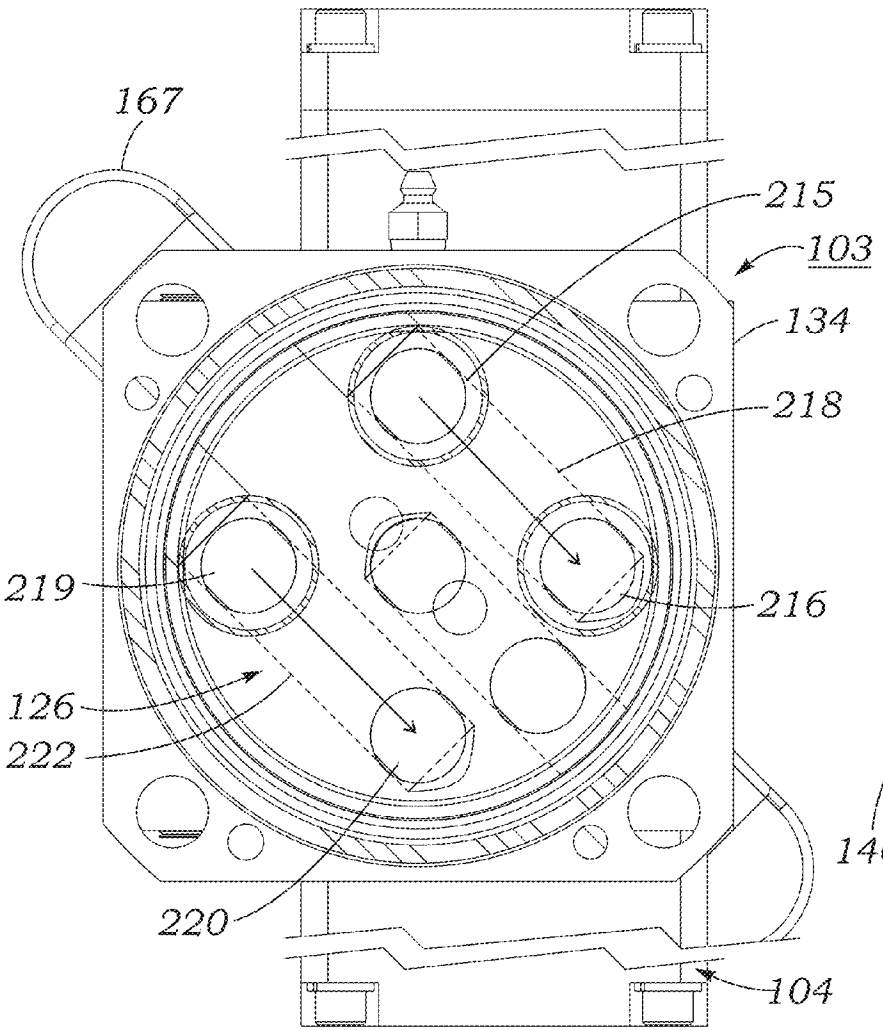
FIG. 31 is a forward-looking transverse sectional view similar to that of FIG. 27, but showing a rotor of the valve turned to a CLOSED clockwise limit position, in which hydraulic flow can be conducted through the valve to the closing hydraulic actuator cylinder of a blow-out preventer.
Figure 33:
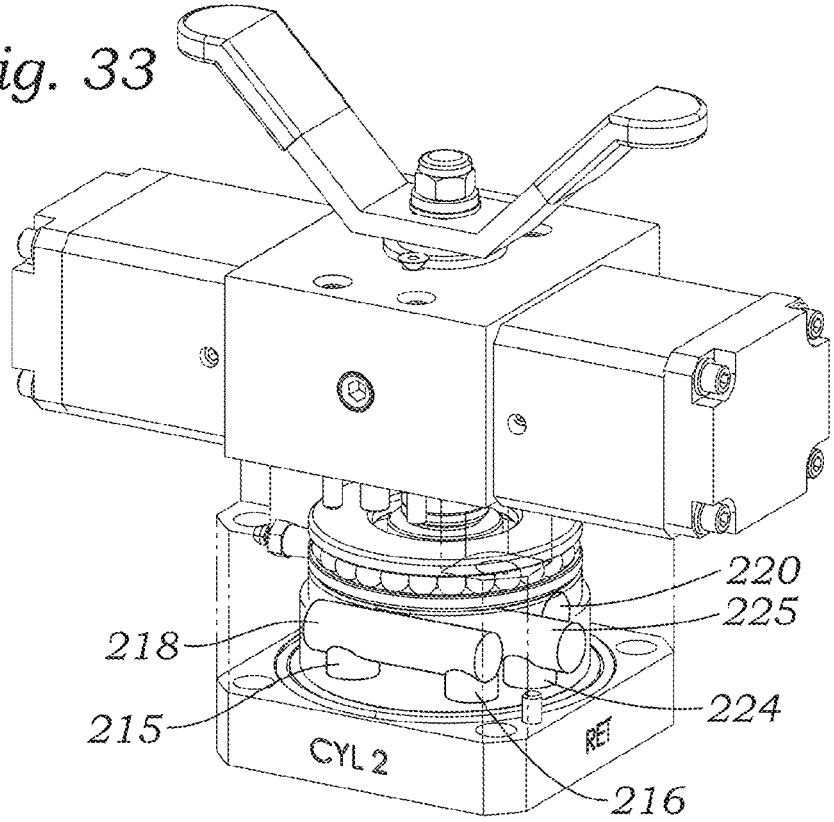
FIG. 33 is a partly diagrammatic skeletal left side view of the valve and actuator of FIG. 15, showing the valve rotor in a NEUTRAL position in which both cylinder 1 and cylinder 2 ports of the valve are blocked.
Figure 34:
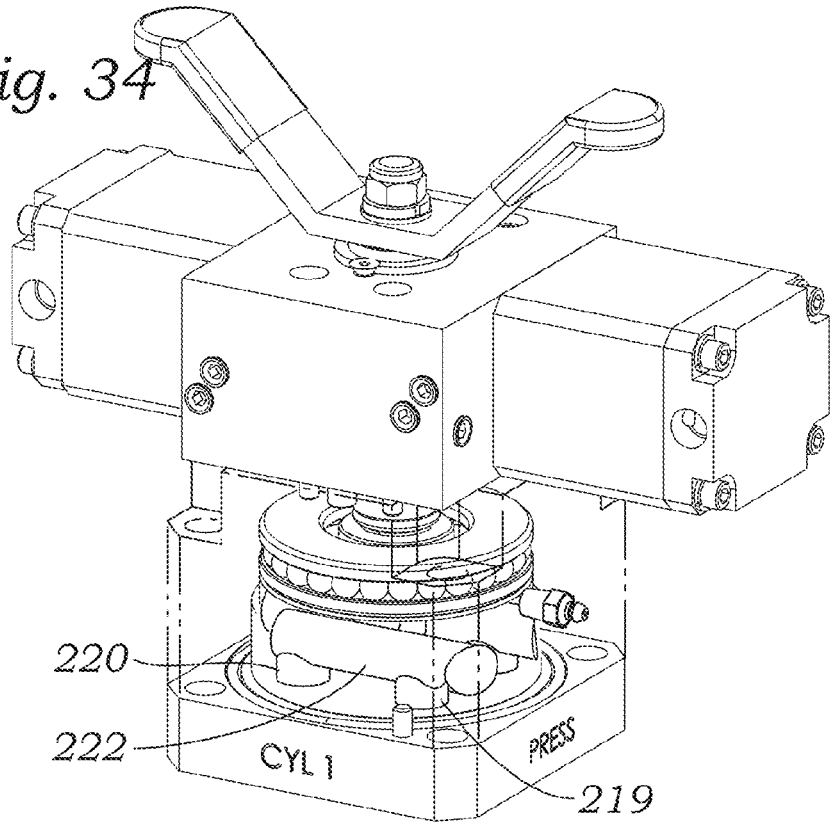
FIG. 34 is a right side perspective view of the valve and actuator of FIG. 33.
Figure 37:
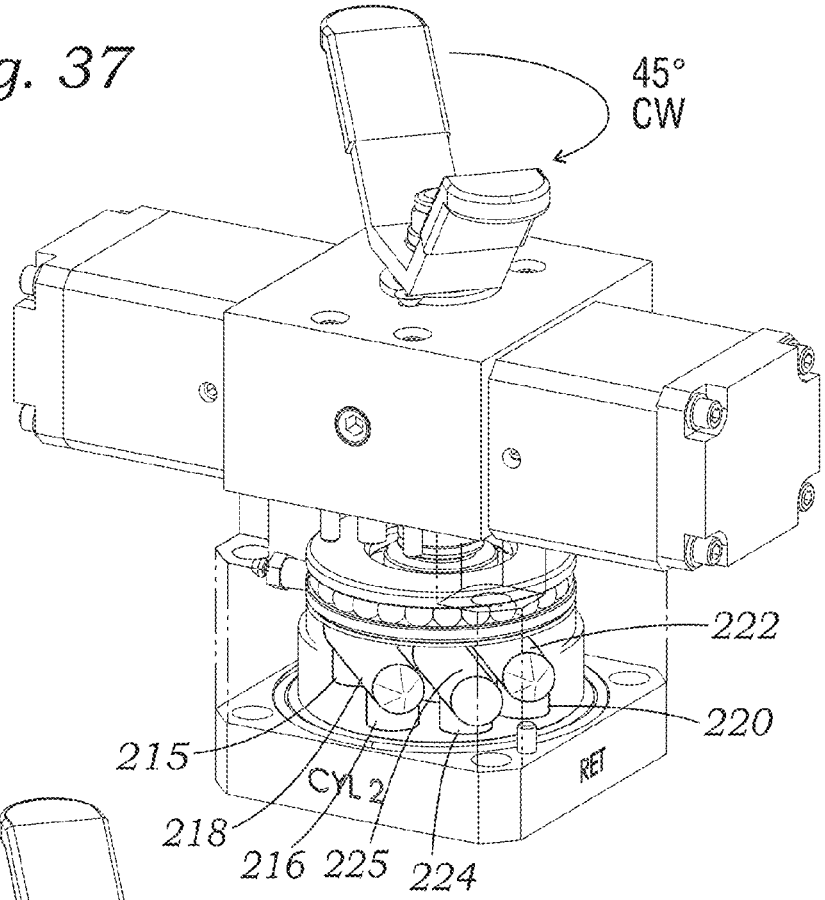
FIG. 37 is a view similar to that of FIG. 33, but showing the valve and actuator in a clockwise, CLOSED position.
Figure 38:
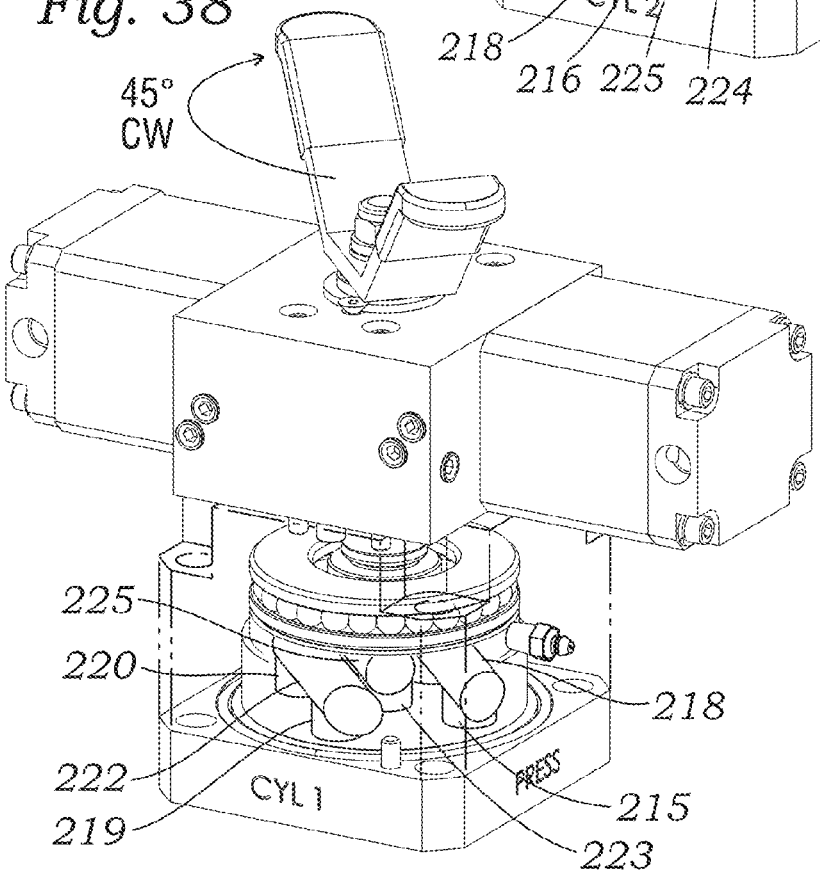
FIG. 38 is a right side perspective view of the valve and actuator of FIG. 37.

In an exactly analogous fashion, when valve rotor 176 is rotated 45 degrees clockwise from the NEUTRAL position shown in FIGS. 33 and 34 to the CLOSED position shown in FIGS. 31, 37 and 38, upper port 215 of left-side valve rotor passageway 218 becomes aligned with fluid PRESSURE inlet ports 137 and 147 of valve port interface base plate 135 and hydraulic manifold 102. In this position, pressurized hydraulic fluid may be introduced into left-side passageway 218 and conducted through that passageway to lower, outlet port 216 of the left-side passageway, conducted through CYLINDER 2, CLOSING valve outlet port 140 and an aligned port 150 of hydraulic manifold 102, and thence through a hydraulic line to the CLOSING inlet port of a hydraulic actuator cylinder of a remote blow-out preventer.

In the 45-degree clockwise orientation of valve rotor 176 upper port 219 of right-side valve rotor passageway 222 is aligned with CYLINDER 1 ports 138, 148 of valve port interface base plate 135 and manifold 102, respectively. Also in this 45-degree clockwise orientation, lower outlet port 220 of right-side passageway 222 aligns with RETURN outlet ports 139, 149 of the valve port interface base plate 135 and manifold 102, respectively, allowing return of hydraulic fluid to the fluid reservoir As may be seen best by referring to FIGS. 20 and 21, each hydraulic fluid port which extends inwardly from lower face 136 of valve port interface base plate 135 has a cylindrically-shaped entrance bore. Thus, port 137 has an entrance bore 237, port 138 has an entrance bore 238, port 139 has an entrance bore 239, and port 140 has an entrance bore 240. As shown in the figures, the upper end of each entrance bore which penetrates upper face 377 of valve port interface port, base plate 135 is penetrated by a circular cross-section counter-bore 242, 243, 244, 245. Each counterbore through which hydraulic fluid under high pressure is conducted receives conformally therein a cylindrically-shaped metal sealing ring 246, 247 and 249 which has a beveled upper surface. The beveled upper surface of each sealing ring is urged into sealing contact with lower surface 214 of rotor 176 by individual annular ring-shaped wave springs 252, 253, 255, located in counter-bores 242, 243 and 245, respectively.

As may be seen best by referring to FIGS. 15B, 20 and 33-38, each fluid passageway 218, 222, 225 through valve rotor 176 includes a transverse bore 258, 262, 265 which is made through the outer circumferential wall surface 266 of valve rotor body 267. The entrance openings of transverse bores 258 and 262 are plugged after the bores are made. Each fluid passageway 218, 222, 225 also has at opposite ends of transverse bores 258, 262, 265 end sections which extend downwardly into axially disposed tubular end sections.

Details of the construction and function of pneumatic actuator 104 may be further understood by referring to FIGS. 15B, 19-22. As shown in FIG. 22, the center of block-shaped central section 168 of actuator housing 161 is offset laterally, e.g., to the right, of the common longitudinal center-line of upper actuator cylinder 125 in housing extension 172 and lower actuator cylinder 126 in lower cylinder housing extension 173. Thus, as shown in FIG. 22, the common axial center-line of valve rotor shaft 166 and attached spur gear 211 is offset to the right of the cylinders' center-line.

Figure 15B:
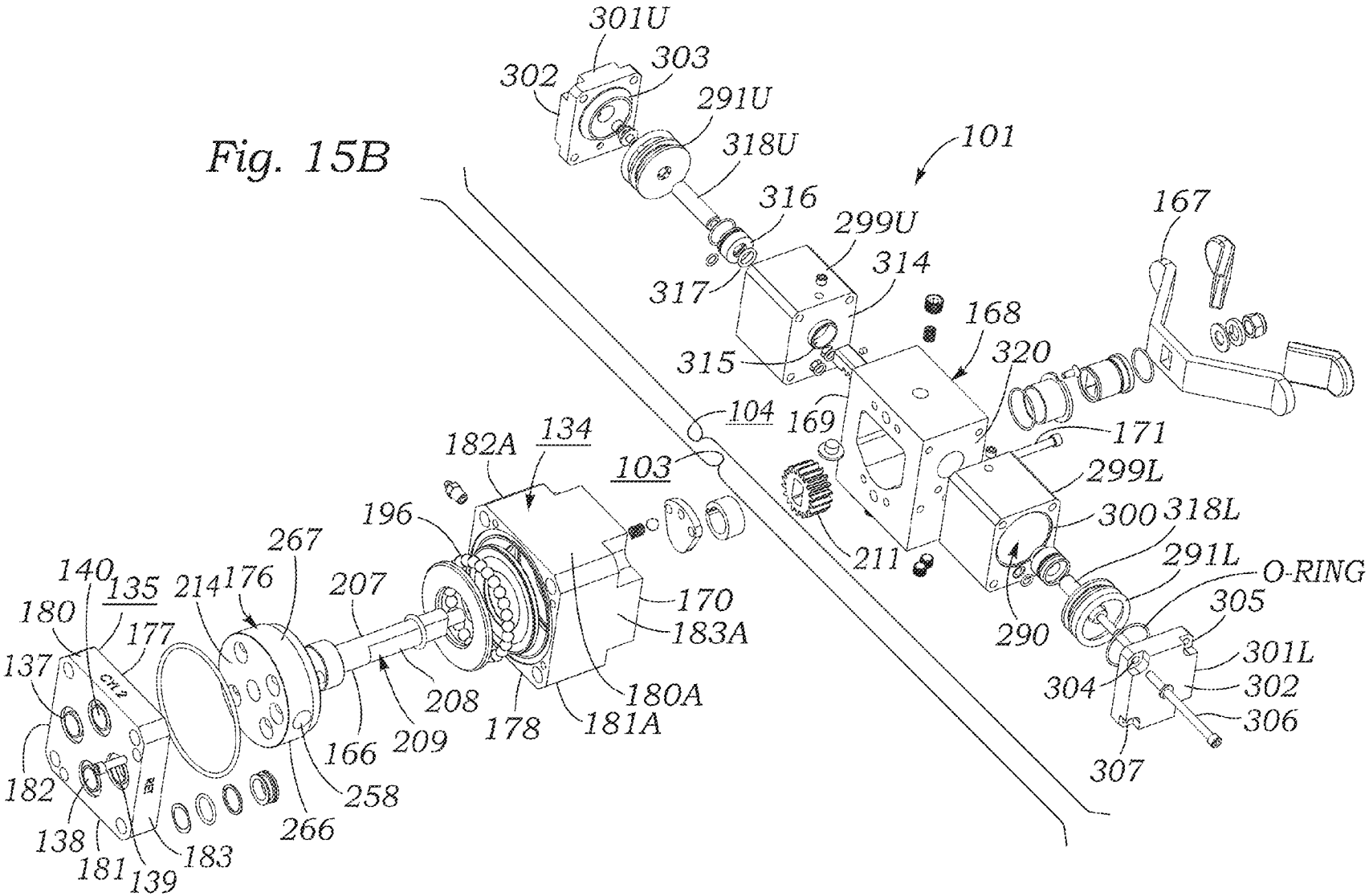
FIG. 15B is an exploded view of the valve and actuator of FIG. 15A.
Figure 18B:
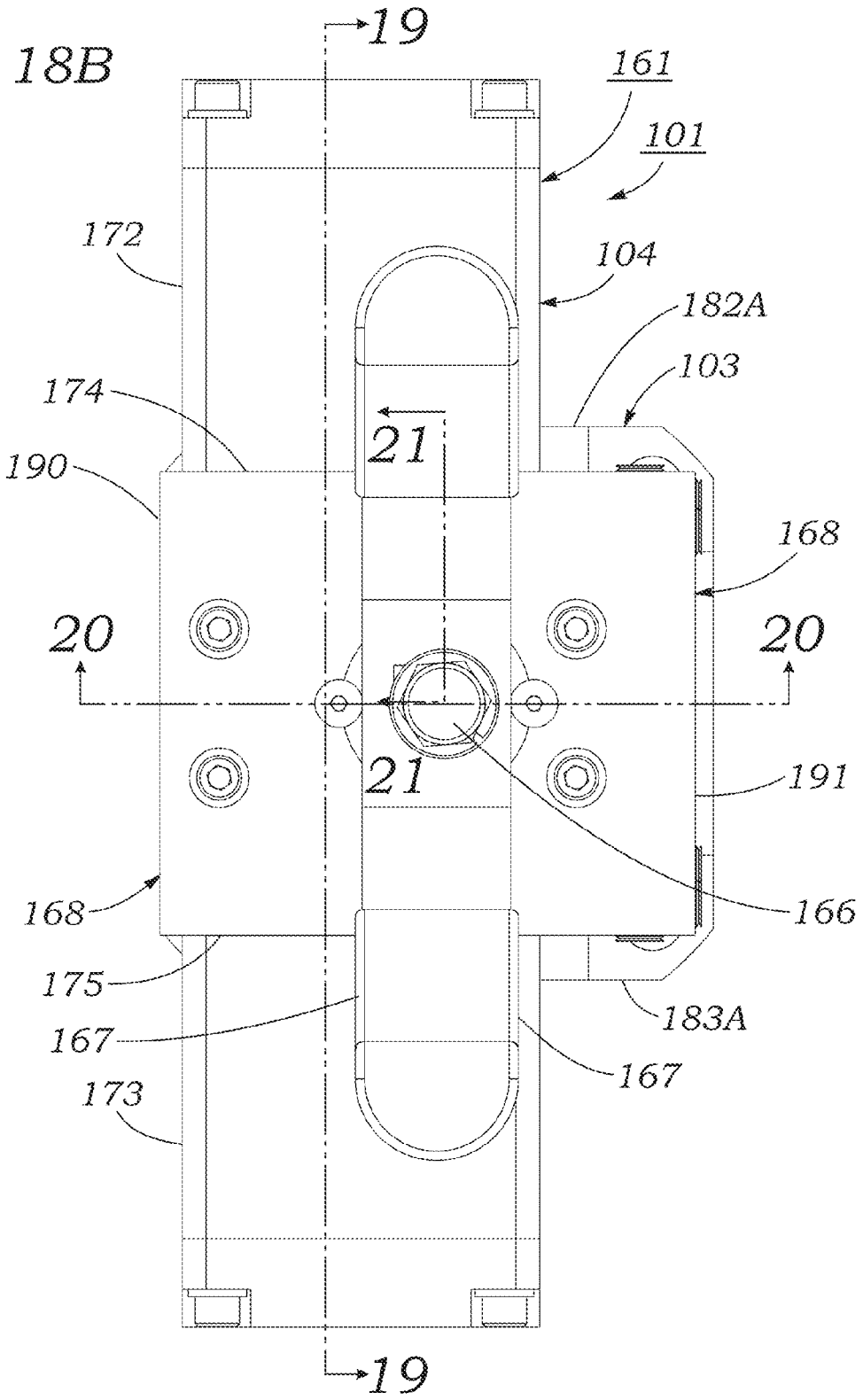
FIG. 18B is a front elevation view of the valve and actuator of FIG. 15A, on an enlarged scale, showing the valve in a centered, NEUTRAL position.
Figure 19:
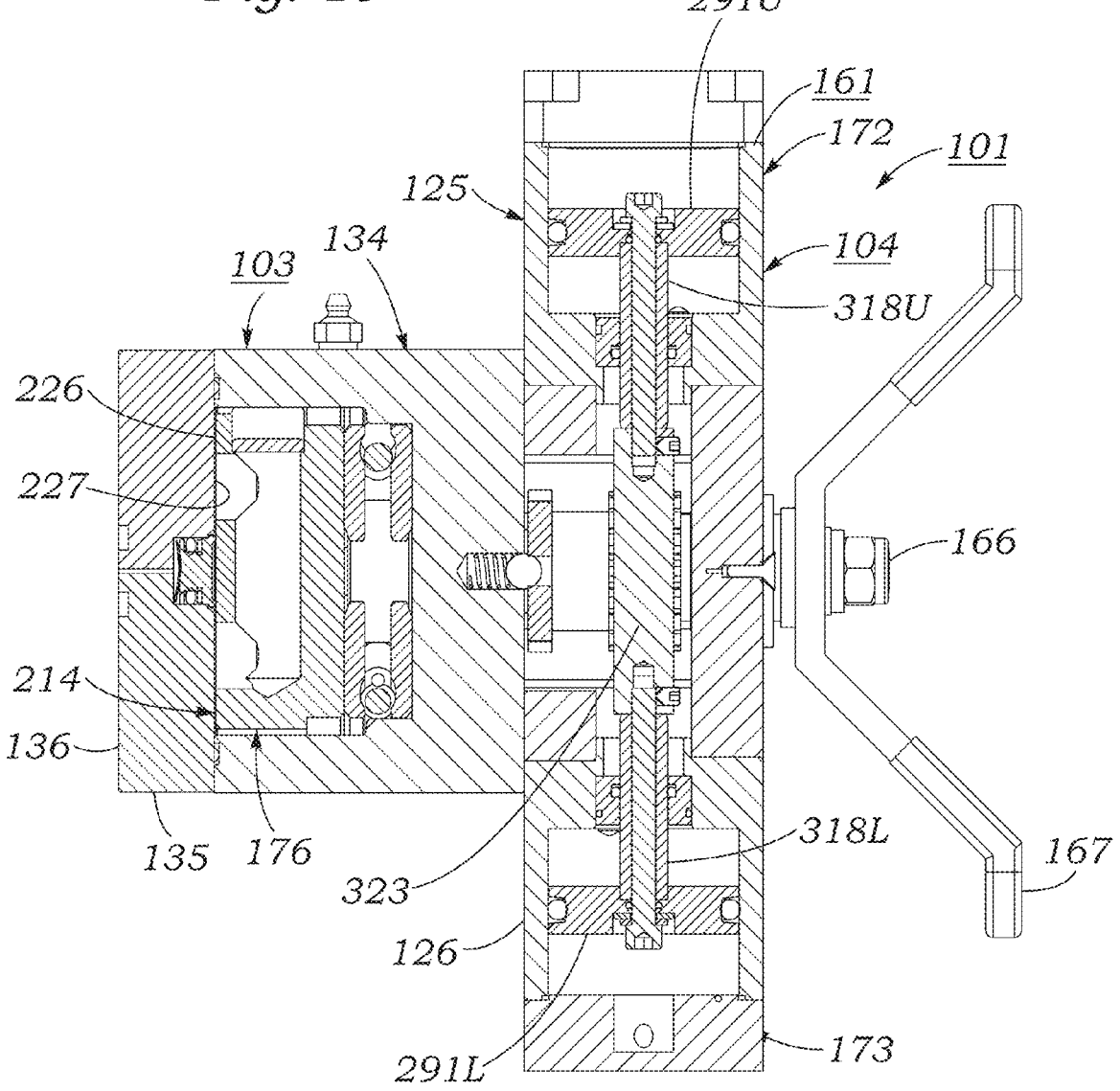
FIG. 19 is a vertical longitudinal sectional view of the valve and actuator of FIG. 18, taken in the direction of line 19-19, and showing the valve in a NEUTRAL position.

As shown in FIGS. 15B, 19 and 22 and stated above, upper and lower housing extensions 172, 173 of pneumatic actuator 104 contain therein identically constructed actuator air cylinders 125, 126, respectively. Each air cylinder 125, 126 includes a circular cross-section cylinder bore 290U, 290L which holds longitudinally slidably therewithin a piston 291U, 291L. Each piston 291U, 291L has generally the shape of a short right-circular cylinder or disk which has an outer circumferential wall surface 292 in which is formed an annular ring-shaped groove 293 that holds therein an elastically deformable O-ring type piston ring 294. The outer circumferential wall surface 295 of piston ring 294 longitudinally slidably contacts in hermetically sealing contact the inner cylindrical wall surface 296 of air cylinder bore 290.

As shown in FIGS. 15B and 22, each air cylinder 125, 126 has generally the shape of a longitudinally elongated rectangular cross-section cylinder block 299 which has a flat outer transversely disposed end face 300 that is penetrated by cylinder bore 290. Each cylinder 125, 126 also has a thin rectangular plate-shaped cylinder head 301 which has an outer flat face transversely disposed face 302 and a parallel inner transversely disposed face 303. Cylinder head 301 is secured to cylinder block 299 of cylinder 162 with inner face 303 of the cylinder head in flat, pneumatically sealing abutting contact with outer end face 300 of cylinder block 299 by bolts 304, 305, 306, 307 at the corners of the cylinder block and cylinder head 301.

As may be seen best by referring to FIG. 22, upper and lower cylinder heads 301U, 301L have radially disposed inlet ports 123, 124, respectively, for pressurized air which penetrates a side wall 309 of the cylinder head. Each inlet port 123 or 124 communicates at a radially inwardly located end thereof with longitudinally disposed air passageway 310 that is coaxial with and communicates with an outer portion of cylinder bore 290 that forms a head space 311. Head space 311 is located between the head face 312 of piston 291 and the inner face 303 of cylinder head 301.

Referring still to FIGS. 15B and 22, it may be seen that cylinder block 299 has at an inner end thereof a flat, rectangular cross-section bulkhead web 314. Cylinder block bulkhead 314 has through its thickness dimension an axially disposed piston rod bore 315 which is coaxial with cylinder bore 290. Piston rod bore 315 receives therein a cylindrically-shaped piston rod bearing bushing 316. Piston rod bearing bushing 316 holds longitudinally slidably through a central coaxial bore 317 therethrough a piston rod 318 which extends coaxially outwards from the inner transverse face 313 of piston 291.

As may be seen best by referring to FIG. 22, an inner axial end of piston rod 318 extends inwardly through piston rod bearing bushing 316 into an enlarged, triangular cross-section bore 319 which is disposed through upper and lower outer faces 320U, 320L of central block-shaped section 168 of actuator housing 161.

As shown in FIG. 22, opposed inner ends 321U, 321L of piston rods 318U, 318L are fastened to opposite ends 322U, 322L of a linear rack gear 323. Rack gear 323 has on a longitudinally disposed right-side 324 thereof gear teeth 325 which mesh with gear teeth 326 in the outer circumferential wall surface 327 of spur gear 211.

Figure 25:
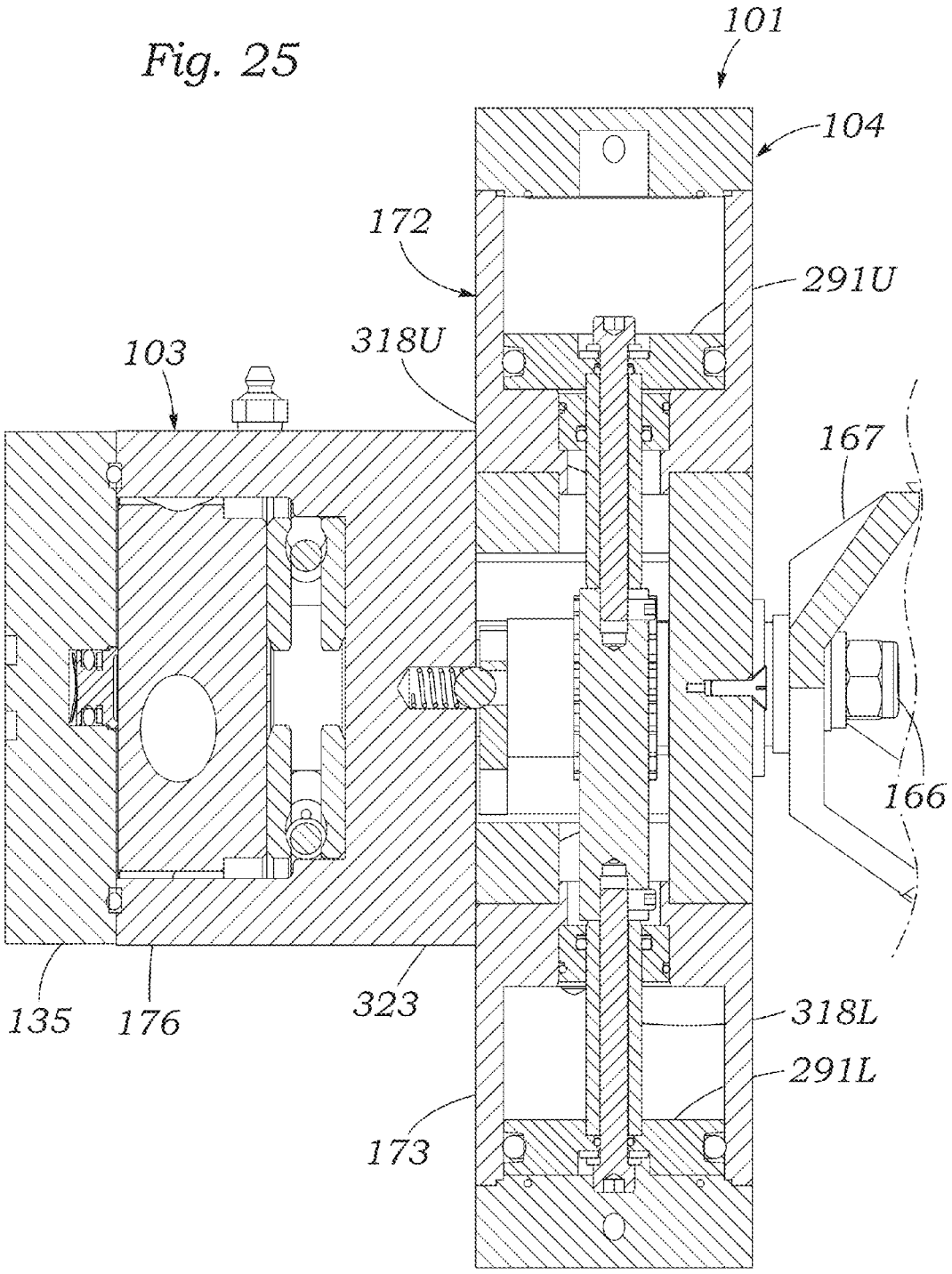
FIG. 25 is a vertical longitudinal sectional view of the valve and actuator of FIG. 23, taken in the direction of line 25-25.
Figure 26:
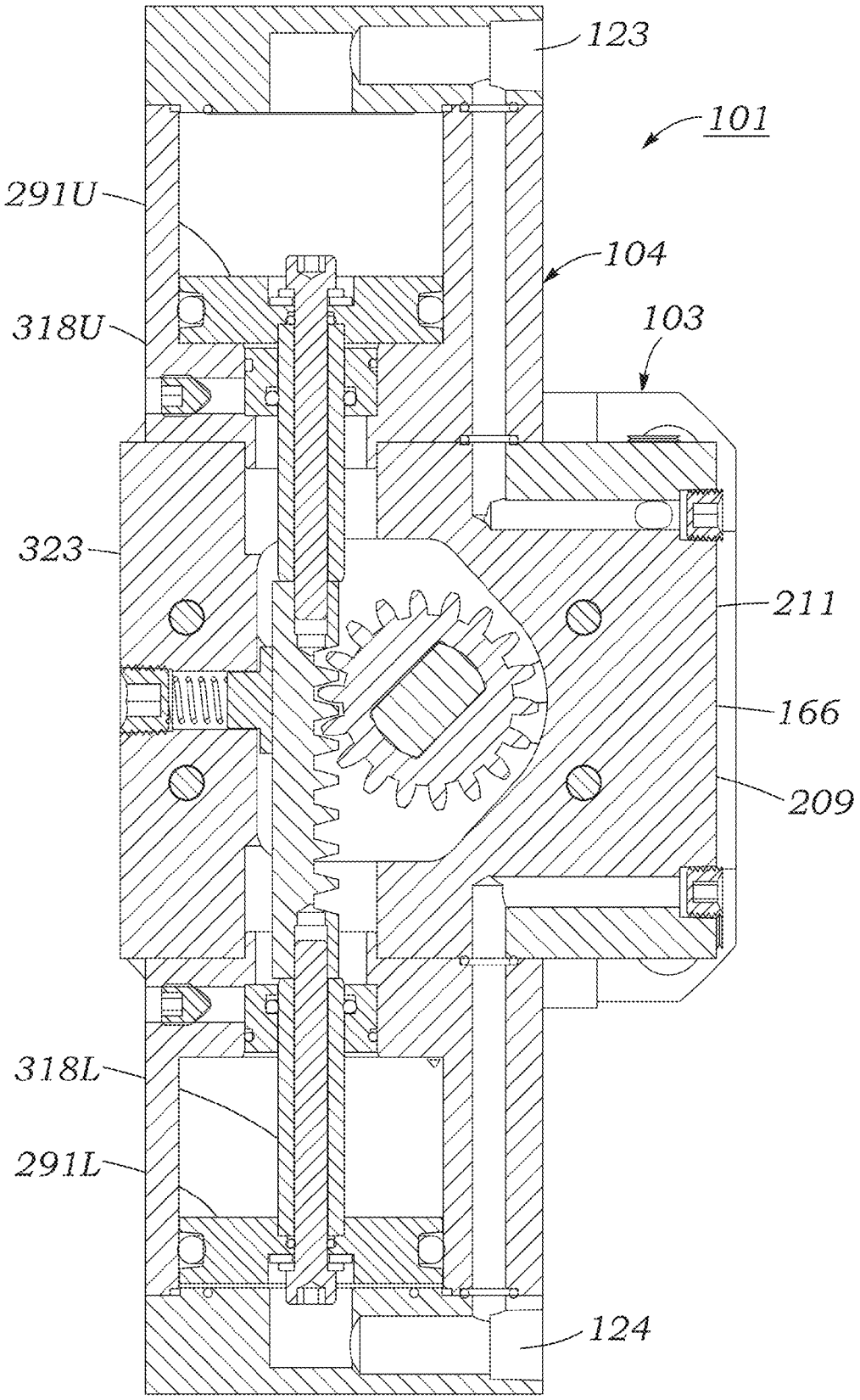
FIG. 26 is a transverse sectional view of the valve and actuator of FIG. 24, taken in the direction of line 26-26.

From the foregoing description of the construction of actuator 104, it should be clear that when pressurized air is introduced into upper air inlet port 123 of upper cylinder 125, upper piston 291U is forced downwardly within the bore 290U of upper cylinder housing 172U, from the NEUTRAL position shown in FIG. 22, to a downward limit position as shown in FIGS. 25 and 26. It should also be clear that downward motion of upper piston 291U causes upper piston rod 318U and rack gear 323 to be forced downwardly. Downward motion of rack gear 323 in turn causes spur gear 211 to be rotated to a counterclockwise limit position, and thus also cause valve rotor shaft 166 and valve rotor 176 to be rotated to counterclockwise limit positions in which hydraulic valve 103 is in an OPEN position.

Conversely, when pressurized air is introduced into lower air inlet port 124 of lower cylinder 126, lower piston 291L is forced upwardly, causing rack gear 323 to be forced upwardly. Upward motion of rack gear 323 in turn causes spur gear 211 to rotate to a clockwise limit position, and thus also rotate valve rotor shaft 166 and valve rotor 176 to a clockwise limit position. In this position valve 103 is in a CLOSED position.

As those skilled in the art of oil well blow-out preventers will know, the hydraulic pressures required for operating blow-out preventers are quite large, ranging up to 2,000 to 3,000 psi or more. Also, as has been described above, hydraulic valve 103 according to the present invention must be capable of conducting hydraulic fluid through mating parts on the lower surface of the valve rotor 176 and upper surfaces of sealing rings 246, 247, 248 in valve port interface base plate 135. Consequently, it can be readily appreciated that rotating, sliding contact forces between the lower surface of valve rotor 176 and the upper surfaces of sealing rings 246, 247 and 249 protruding from the upper surface of valve port interface base plate 135 must be relatively high to minimize leakage of highly pressurized hydraulic fluid in radial directions from aligned ports in the rotor base and valve port interface base plate 135.

Thus, contacting pressures required between the face of the valve rotor 176 and the upper faces of sealing rings 246, 247, 249 in valve interface base plate 135 can be as high as 3000-4000 psi. Therefore, the torque required to turn valve rotor shaft 166 between open, closed and neutral positions can be as high as 45 foot pounds, for a shaft diameter of ⅞ inch, and correspondingly higher torque values for larger shaft diameters used for larger capacity valves. In view of the foregoing facts, it can be readily appreciated that the linear forces between contacting teeth of the rack gear 323 and spur gear 211 can be as high as 64 pounds. And it can also be appreciated that each time rotor 176 of valve 103 is rotated, there can be a certain degree of surface wear caused by ablation of contact surfaces of the rack gear 323 and spur gear 211. Eventually, such wear of the meshing teeth of the rack gear and spur gear will result in an unacceptably large amount of free-play, or gear-train back-lash.

Advantageously, the novel design and construction of actuator 104 according to the present invention can essentially double the useful service life of spur gear 211, by utilizing the following procedure. Spur gear 211 is mirror symmetric about a plane perpendicular to its flat, upper and lower surfaces and centered between and parallel to the flats bordering the rotor shaft bore through the spur gear. Therefore, when wear-caused gear train back lash reaches a pre-determined value, valve 103 may be disassembled sufficiently far for spur gear 211 to be removed from valve rotor shaft 166 rotated 180 degrees or "flipped" about a diameter of the spur gear located midway between parallel flats of the spur gear rotor shaft bore, and replaced on the rotor shaft, thus placing a new half of the spur gear in meshing contact with the rack gear.

Although actuator/valve assemblies 101 are preferably oriented with the long axis of each actuator 104 vertically oriented as shown in FIGS. 11 and 14, the actuators may optionally be oriented with the long axis horizontally oriented. Also, actuator body 161 may optionally have a unitary, single piece construction in which central square block-shaped housing section 168 and upper and lower cylinder housing extensions 172, 173 are integrated into a single body 161.

Also, actuator assemblies 101 may optionally utilize pressurized hydraulic fluid rather than pressurized air to achieve larger actuation forces.

FIGS. 39-49 illustrate a modification of the pneumatic actuator and valve assembly 101 used in modular control apparatus 100 described above. Modified modular pneumatic actuator and hydraulic valve assembly 401 includes a modified pneumatic actuator 404, which has a unitary, monolithic housing body 461 in which opposed air cylinders and air passageways for supplying pressurized air to the cylinders are machined from a single block of a durable material such as aluminum or other metal.

As shown in FIGS. 39-44, modified actuator/valve assembly 401 includes a modified pneumatic actuator 404 which is attached to a hydraulic valve 403. As shown in FIGS. 39-44, hydraulic valve 403 has hydraulic fluid ports located in the sides of the valve base 435, rather than in the lower surface of the manifold-mount valve 103 described above.

Thus as shown in FIGS. 39-44, hydraulic valve 403 has four hydraulic fluid ports 437, 438, 439 and 440 located in side walls of base 435 of the valve. Those ports are exactly analogous in structure and function to ports 137, 138, 139 and 140 of hydraulic valve 103 described above. Optionally, modified pneumatic actuator may optionally be attached to and used with a manifold-mount valve 103.

FIGS. 45-49 illustrate details of the construction and function of modified pneumatic actuator 404.

As shown in FIGS. 45-49, modified pneumatic actuator 404 has a construction and function similar to that of pneumatic actuator 104 described above. However, actuator 404 has a monolithic construction in which a single rectangularly shaped metal block which has a longitudinally elongated rectangular prism shape is machined to form a housing 461 that includes a central section 468 analogous to central section 168 of actuator 104. Housing 461 also has left and right housing sections 472 and 473 which extend left-ward and right-ward from central housing section 468, which are analogous to upper and lower housing sections 172, 173 of pneumatic actuator 104.

As shown in FIGS. 46-49, left and right housing sections 472, 473 contain therewithin left and right air cylinders 425, 426, respectively, which are pressurizable by left and right inlet ports 423, 424, respectively.

Figure 47:
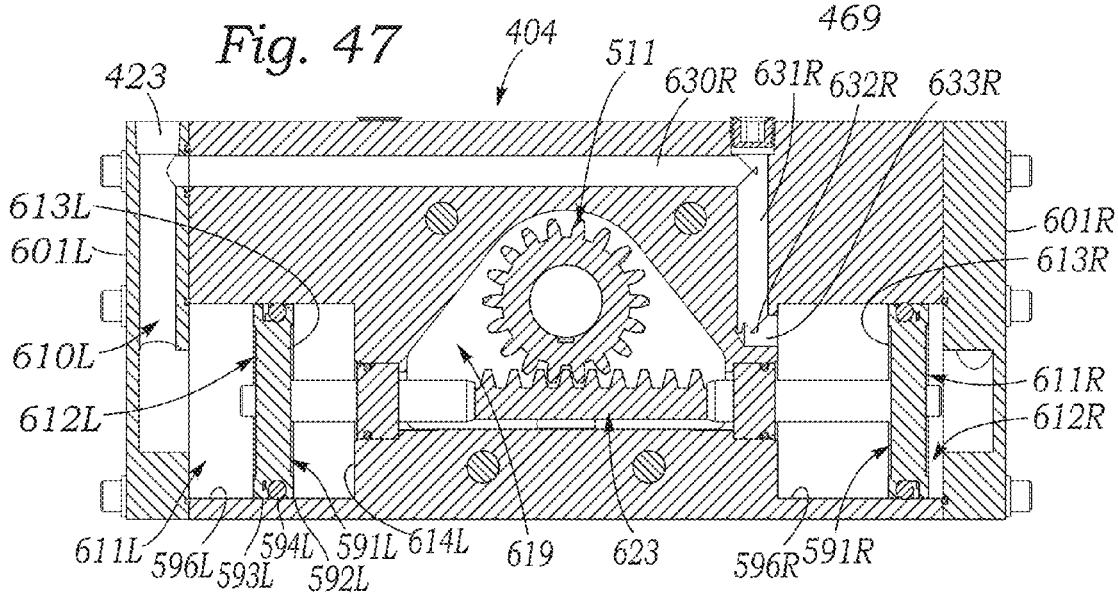
FIG. 47 is a lower sectional view of the actuator of FIG. 43, taken in the direction of line 47-47.

In a manner exactly analogous to that described above for actuator/valve assembly 101, actuator/valve assembly 401 is constructed in a manner which causes a valve rotor shaft 466 and manual control handle 467 of hydraulic valve 403 to rotate to a counterclockwise OPEN position when right-hand air cylinder 426 is pressurized with air through right-hand air inlet port 424, as shown in FIG. 47.

Conversely, when left-hand air cylinder 472 is pressurized with air through left-hand actuator air inlet port 423, valve rotor shaft 466 and manual control valve 467 are rotated to a clockwise CLOSED position.

Figure 40:
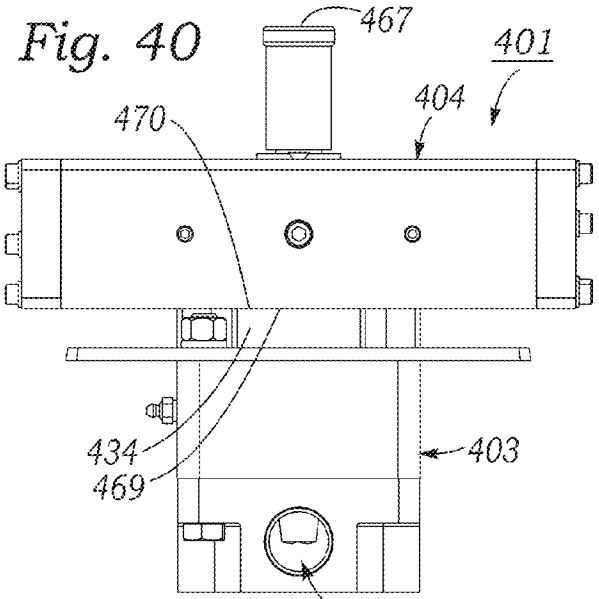
FIG. 40 is a front elevation view of the valve and actuator assembly of FIG. 39.
Figure 42:
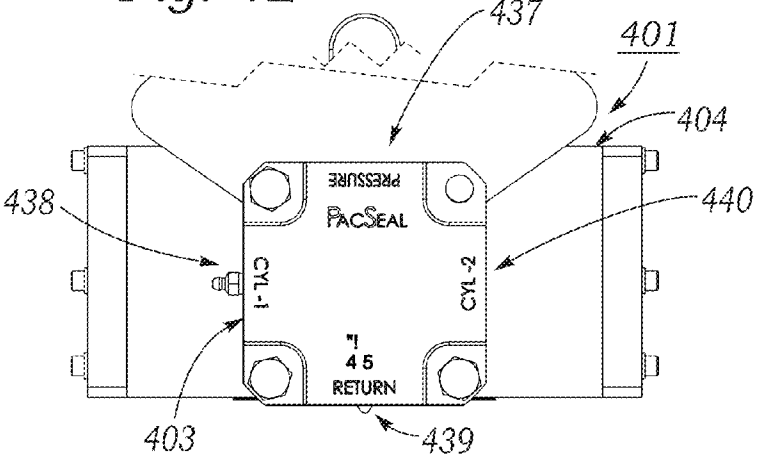
FIG. 42 is a lower plan view of the valve and actuator assembly of FIG. 39.
Figure 39:
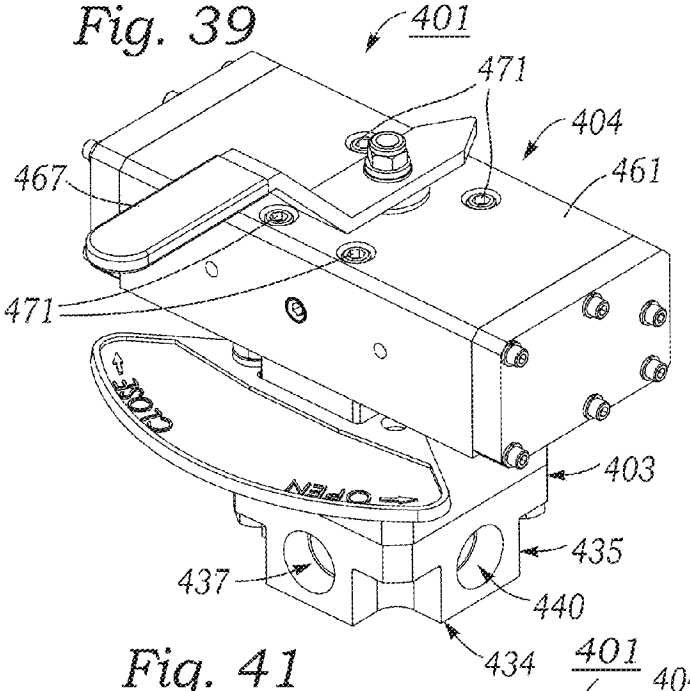
FIG. 39 is a perspective view of a modified valve and actuator assembly according to the present invention, which includes a side-ported hydraulic valve and a modified pneumatic actuator that has a monolithic construction in which opposed cylinder bores and air passageways thereof are machined from a single aluminum block.
Figure 41:
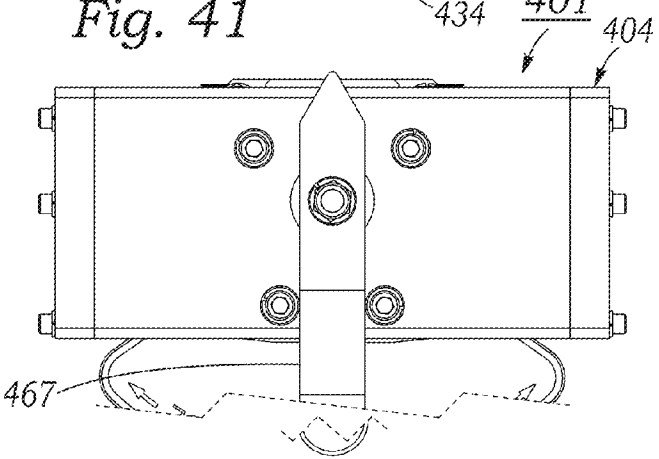
FIG. 41 is an upper plan view of the valve and actuator assembly of FIG. 39.

As shown in FIGS. 39-43, housing 461 of actuator 404 of actuator/valve assembly 401 according to the present invention includes a central square cross-section, block-shaped section 468 which has a flat, square lower face 469 that seats on and is bolted to square, flat upper face 470 of valve housing 434 by bolts 471, as shown in FIGS. 39 and 40.

Figure 43:
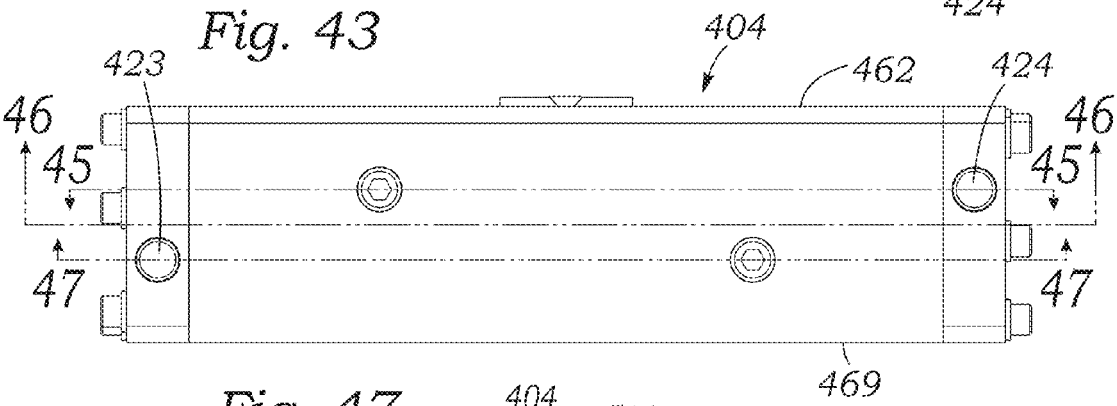
FIG. 43 is a fragmentary rear view of the valve and actuator assembly of FIG. 39, showing the actuator disassembled from the valve.
Figure 46:
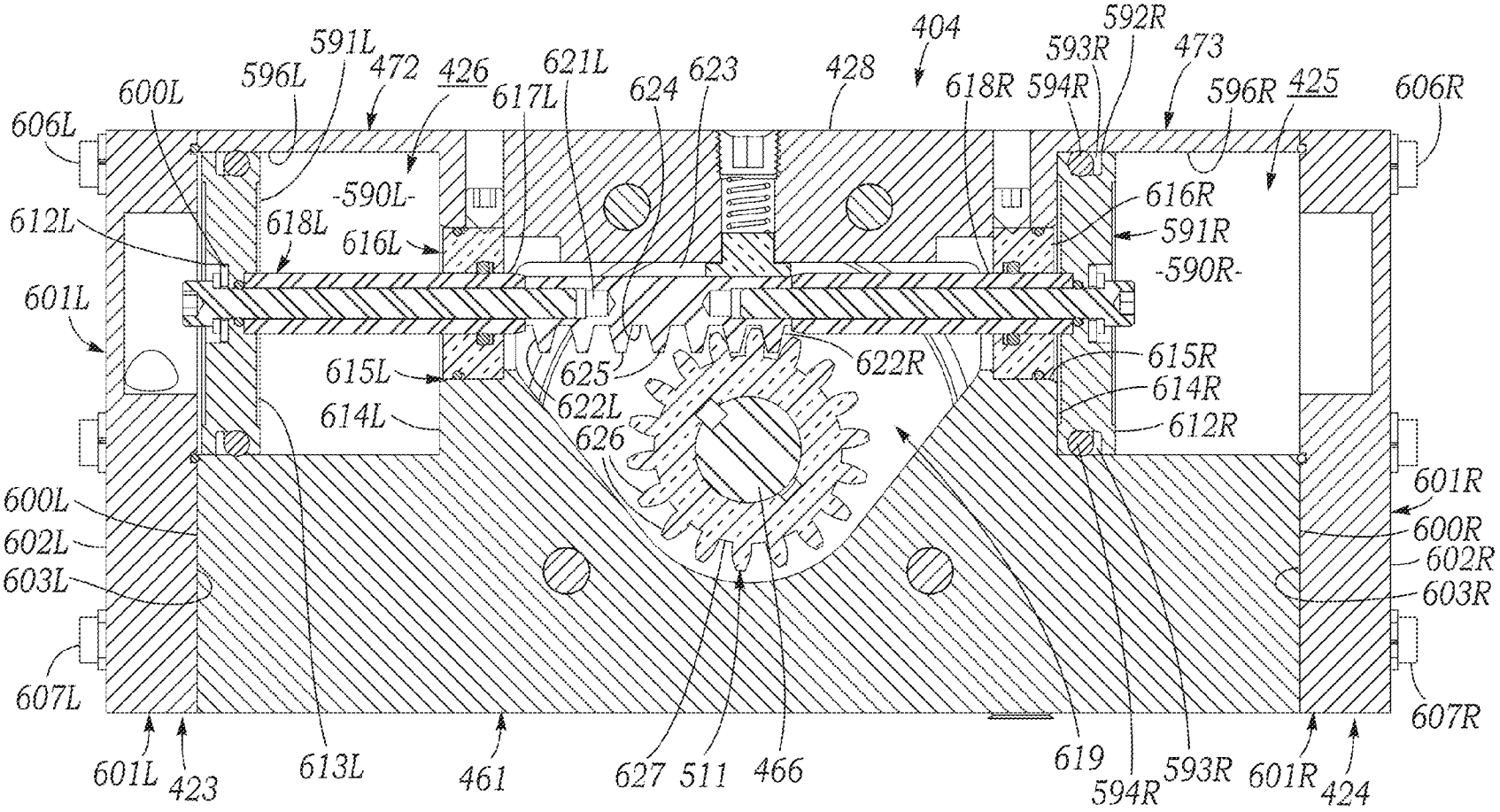
FIG. 46 is a medial longitudinal sectional view of the actuator of FIG. 43 showing the actuator in a leftward limit position.
Figure 49:
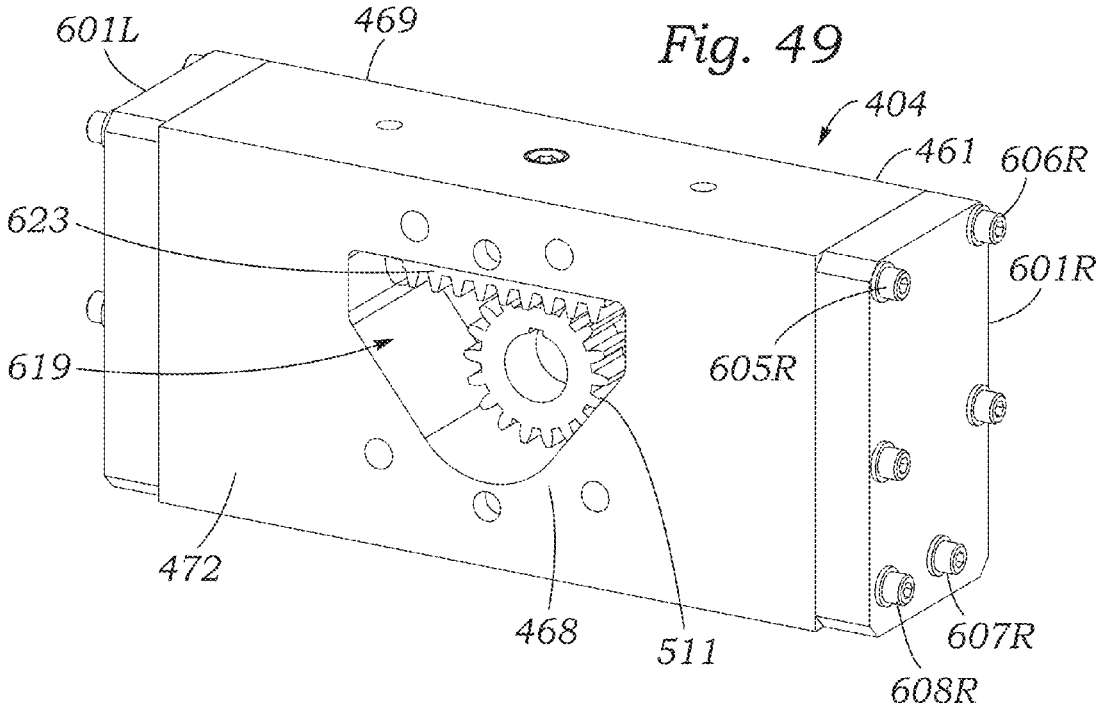
FIG. 49 is a perspective view of the actuator of FIG. 48, with an upper cover plate thereof removed.

As shown in FIGS. 43 and 46, central block-shaped section 468 of pneumatic actuator housing 461 has formed therein a cavity 619 in which is located a spur gear 511. Spur gear 511 is pinned to the upwardly protruding end of rotor shaft 466 of hydraulic valve 403, as shown in FIG. 46.

As shown in FIGS. 46, 47, and stated above, left and right housing sections 472, 473 of housing 461 of pneumatic actuator 404 contain therein identically constructed left and right actuator air cylinders 425, 426, respectively. Each air cylinder 425, 426 includes a circular cross-section cylinder bore 590R, 590L machined into housing block 461.

The cylinder bores 590R, 590L of left and right air cylinders 425, 426 each hold longitudinally slidably therewithin a piston 591L, 591R, respectively. Each piston 591L, 591R has generally the shape of a short right-circular cylinder or disk which has an outer circumferential wall surface 592 in which is formed an annular ring-shaped groove 593 that holds therein an elastically deformable O-ring type piston ring 594. The outer circumferential wall surface 595 of piston ring 594 longitudinally slidably contacts in hermetically sealing contact the inner cylindrical wall surface 596 of air cylinder bore 590.

As shown in FIGS. 45-48, the bore 590L, 590R of each air cylinder 425, 426 penetrates one of a pair of opposed parallel transverse outer end faces 600L, 600R of housing 461. Each cylinder 425, 426 also has a thin rectangular block-shaped cylinder head 601L, 601R which has an outer flat transversely disposed face 602L, 602R and a parallel inner transversely disposed face 603L, 603R. Each cylinder head 601L, 601R is secured to housing 461 with inner face 603L, 603R of the cylinder head in flat, hermetically sealing abutting contact with outer face 600L, 600R of the housing 461 by bolts 604L, 605L, 606L, 607L; 604R, 605R, 606R, 607R at the corners of the housing and cylinder heads 601L, 601R, respectively.

As may be seen best by referring to FIGS. 43-45 and 47-51, left and right cylinder heads 601L, 601R include inlet ports 423, 424, respectively, for receiving pressurized air. The ports penetrate short sides 609L, 609R of cylinder heads 601L, 601R, respectively. Each air inlet port 423, 424 communicates at a radially inwardly located end thereof with a transversely disposed air passageway 610L, 610R. Each air passageway 610L, 610R communicates at an inner end thereof with an outer portion of a cylinder bore 590L, 590R that forms a cylinder head space 611L, 611R. Cylinder head space 611L, 611R is located between the head face 612L, 612R of piston 591L, 591R and the inner face 603L, 603R of a cylinder head 601L, 601R.

Figure 45:
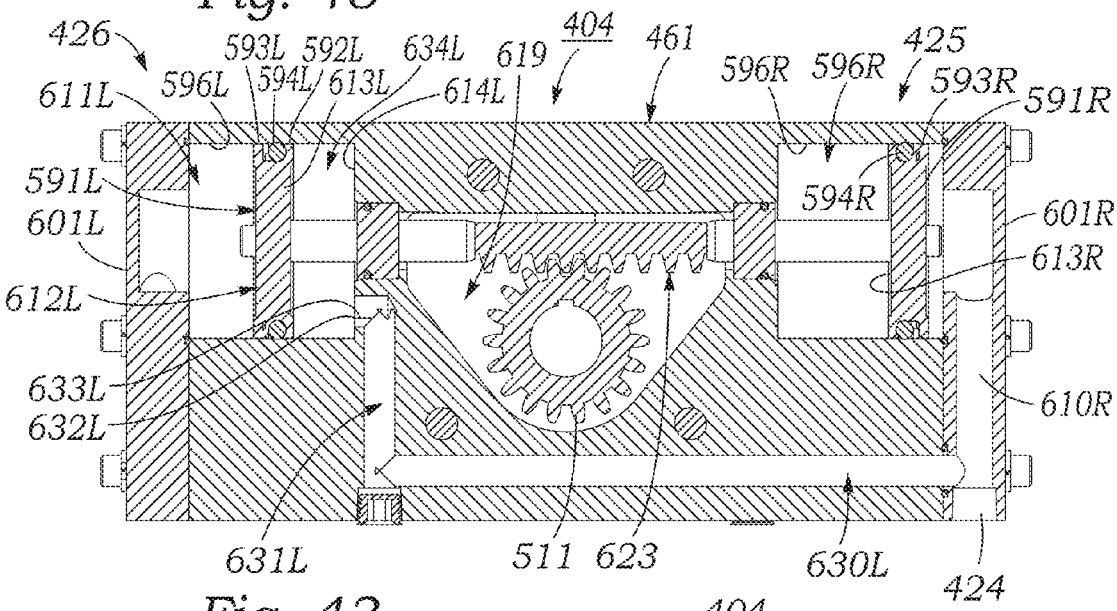
FIG. 45 is an upper longitudinal sectional view of the actuator of FIG. 43, taken in the direction of line 45-45.

Referring now to FIGS. 45-47, it may be seen that each cylinder bore 590L, 590R terminates at an inner end thereof in a flat, transversely disposed web that forms a bulkhead 614L, 614R which is part of unitary housing block 461. Each bulkhead 614L, 614R has through its thickness dimension a central circular cross-section bore 615L, 615R. Each bore 615L, 615R receives conformally therein a cylindrically shaped piston rod bearing bushing 616L, 616R. Each piston rod bearing bushing 616L, 616R holds longitudinally slidably through a central coaxial bore 617L, 617R therethrough a piston rod 618L, 618R which extends coaxially outward from the inner or lower transverse faces 613L, 613R of pistons 591L, 591R, respectively.

As may be seen best by referring to FIGS. 45-47 and 48, the inner axial end of each piston rod 618L, 618R extends inwardly through a piston rod bearing bushing 616L, 616R into an enlarged, triangular cross-section cavity 619 which is disposed through upper and lower outer faces 462, 469 of central block-shaped section 468 of actuator housing 461.

As shown in FIGS. 46 and 47, opposed inner ends 621L, 621R of piston rods 618L, 618R are fastened to opposite ends 622L, 622R of a linear rack gear 623. Rack gear 623 has on a longitudinally disposed rear side 624 thereof gear teeth 625 which mesh with gear teeth 626 in the outer circumferential wall surface 627 of spur gear 511.

From the foregoing description of the construction of actuator 404, it should be clear that when pressurized air is introduced through left-hand air inlet port 423 into bore 590L of left-hand cylinder 425, left-hand piston 591L is forced rightwardly within the bore 590L of left-hand cylinder housing 572L, from a neutral position to a right-hand limit position. It should also be clear that rightward motion of left-hand piston 591L causes left-hand piston rod 618L and rack gear 623 to be forced rightward. Rightward motion of rack gear 623 in turn causes spur gear 511 to be rotated to a clockwise limit position and thus also causes valve rotor shaft 466 and valve rotor 476 to be rotated to a clockwise limit position in which hydraulic valve 403 is in a CLOSED position.

Conversely, when pressurized air is introduced through right-hand air inlet port 424 into bore 590R of right-hand cylinder 425, right-hand piston 591R and rack gear 623 are forced leftwards. Leftward motion of rack gear 623 in turn causes spur gear 511 to be rotated to a counterclockwise limit position and thus also rotate valve rotor shaft 466 and valve rotor 476 to a counterclockwise limit position, as shown in FIG. 46. In this position, hydraulic valve 403 is in an OPEN position.

Figure 44:
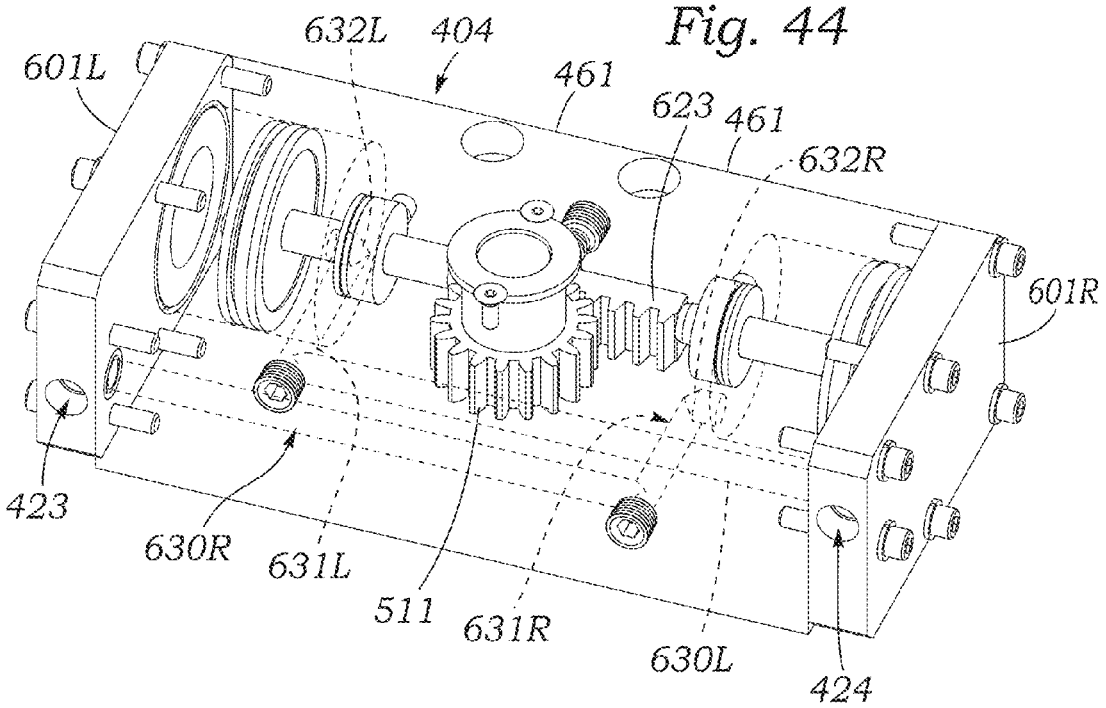
FIG. 44 is an upper broken-away phantom view of the pneumatic actuator of FIG. 43.
Figure 48:
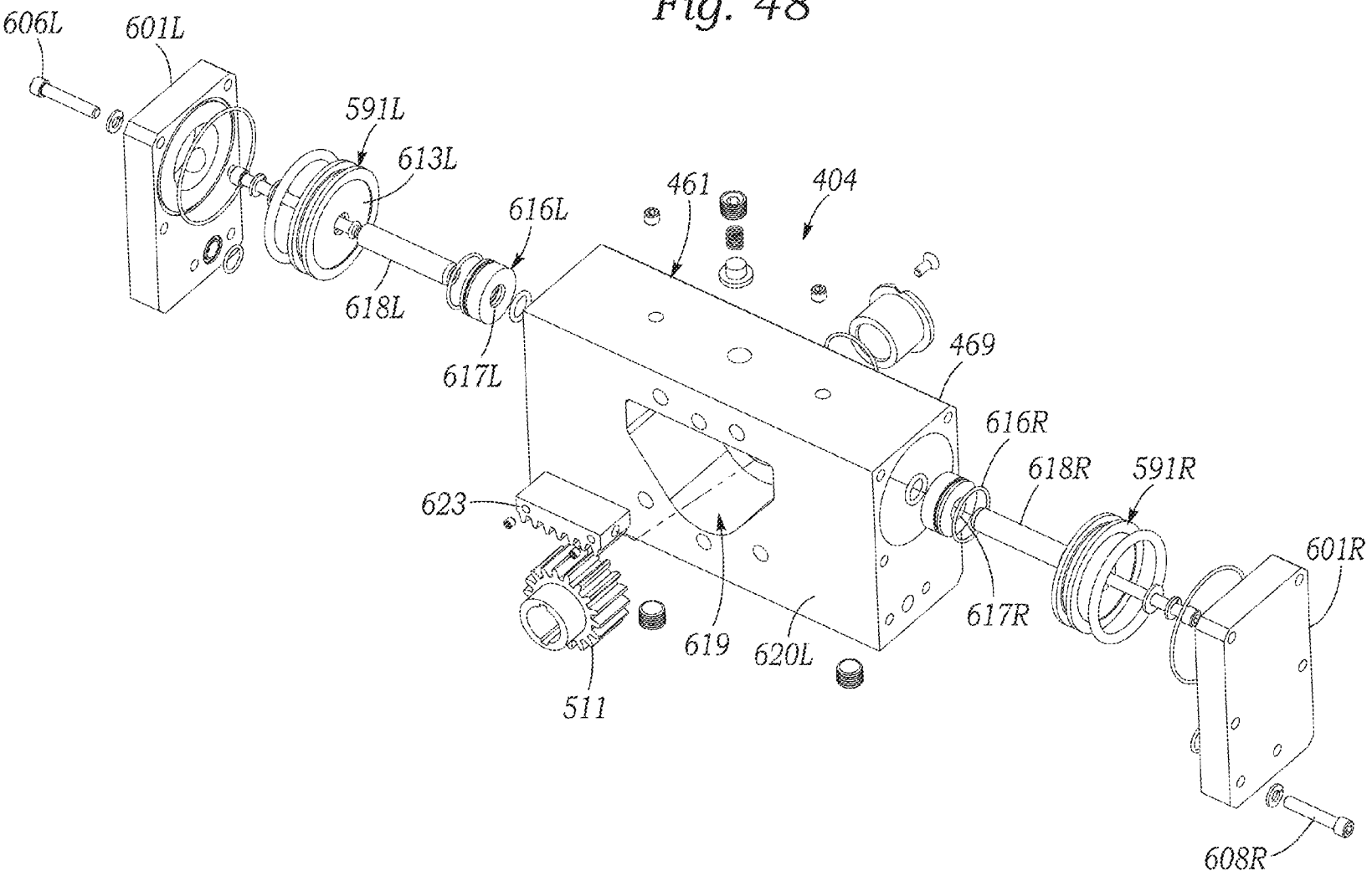
FIG. 48 is an exploded view of the actuator of FIG. 43.

As may be seen best by referring to FIGS. 44, 45, and 47, modified pneumatic actuator 404 includes a novel arrangement of auxiliary conduits for pressurized air which nearly double the force exertable by either piston 591L, 591R from a value of P×A, where P is the pressure of pressurized air introduced into the head space of a cylinder, and A is the area of the piston head.

Thus as shown in FIGS. 44, 45, and 47, there is connected to transversely disposed air passageway 610R that carries pressurized air from air inlet port 424 of right-hand air cylinder 426 to head space 611R of the right-hand air cylinder bore 590R a longitudinally disposed auxiliary conduit 630L for pressurized air. Auxiliary conduit 630L extends leftwards within housing block 461 to a location in approximate transverse alignment with bulkhead 614L of left-hand cylinder 426. Auxiliary conduit 630L has at a lefthand end thereof a shorter transversely disposed right-angle elbow extension 631L. Elbow extension 631L extends inward to a location on a side of cylinder bulkhead 614L opposite that of cylinder bore 590L, and has a short L-shaped nozzle section 632L which penetrates right-hand cylinder bulkhead 614L. An air output orifice 633L of nozzle section 632L communicates with a downstroke part 634L of left-hand cylinder bore 590R, which is located below lower or downstroke face 613L of left-hand piston 591L.

The force exerted on right-hand piston 591R and hence on piston rod 618R and spur gear 511 by air at pressure P in cylinder bore 590L is P×A, where A is the area of the head face 612R of piston 591R. However, the addition of auxiliary air conduit 630L results in a force P×B being exerted simultaneously on the downstroke side of left-hand piston 591L, where B is the area of the downstroke side face 613L of the piston. As may be envisioned by viewing FIGS. 44 and 47, the area of downstroke face 613L of piston 591L is equal to the area of piston head face 612L minus the cross-sectional area of piston rod 618L. Since the ratio between piston rod area and piston face area would typically be less than about one-tenth, the force exerted by rack gear 623 with the addition of auxiliary air conduit 630L is about 90 percent greater than could be produced by pressurizing only the head space 611R of right-hand cylinder 590R.

As shown in FIGS. 44, 45, and 47, the novel construction of modified pneumatic actuator 404 which increase the leftward force exerted on rack gear 623 when pressurizing right-hand cylinder 590R has analogous components which increase rightward force when left-hand cylinder 590L is pressurized.

Thus as shown in FIGS. 44, 45, and 47, there is connected to transversely disposed air inlet passageway 610L that carries pressurized air from air inlet port 423 of left-hand air cylinder 425 to head space 611L of the left-hand air cylinder bore 590L a longitudinally disposed auxiliary conduit 630R for pressurized air. Auxiliary conduit 630R extends rightward within housing block 461 to a location in approximate transverse alignment with bulkhead 614R of right-hand cylinder 426. Auxiliary conduit 630R has a a right-hand end thereof a shorter transversely disposed right-angle elbow extension 631R. Elbow extension 631R extends inward to a location on a side of cylinder bulkhead 614R opposite that of cylinder bore 590R, and has a short L-shaped nozzle section 632R which penetrates right-hand cylinder bulkhead 614R. An air output orifice 633R of nozzle section 632R communicates with a downstroke part 634R of right-hand cylinder bore 590R, which is located below lower or downstroke face 613R of right-hand piston 591R.

The force exerted on left-hand piston 591L and hence on piston rod 618L and spur gear 511 by air at pressure P in cylinder bore 590L is P×A, where A is the area of the head face 612L of piston 591L. However, the addition of auxiliary air conduit 630R results in a force P×B being exerted simultaneously on the downstroke side of right-hand piston 591R, where B is the area of the downstroke side face 613R of the piston. As may be envisioned by viewing FIGS. 44 and 47, the area of downstroke face 613R of piston 591R is equal to the area of piston head face 613R minus the cross-sectional area of piston rod 618R. Since the ratio between piston rod area and piston face area would typically be less than about one-tenth, the force exerted on rack gear 623 with the addition of auxiliary air conduit 630R is about 90 percent greater than could be produced by pressurizing only the head space 611L of left-hand cylinder 590L.

What is claimed is:

1. A modular oil well blow-out preventer (BOP) control apparatus for controlling flow of pressurized hydraulic fluid to hydraulic actuator cylinders of a BOP, said apparatus comprising;

a. at least a first multiple-position rotary hydraulic valve which has a rotor rotatable between a closed position and at least a first open position for controlling flow of pressurized hydraulic fluid between a source of pressurized hydraulic fluid and an hydraulic line connected to said valve and an hydraulic actuator cylinder of a BOP, said valve having protruding from a housing thereof a rotor shaft having a manually operable handle to open and close said valve, b. a linear actuator operably connected to said valve shaft for reversibly opening and closing said valve, said linear actuator including at least a first cylinder which holds therein a piston slidably movable in response to pressurization of said cylinder, c. a force coupling mechanism for converting linear motion of said piston in said cylinder into rotary motion of said valve rotor, said force coupling mechanism including in combination a curved gear fastened coaxially to said rotor shaft of said valve, said curved gear having teeth on an outer convex surface thereof, and a single linear gear which has teeth which mesh with said teeth of said curved gear, said linear gear being reciprocally translatable in response to linear motion of said piston in said first cylinder, said curved gear being a circular gear which is reversibly attached to said rotor shaft to thereby interchangeably engage opposite sides of said curved gear with said linear gear, said linear gear being a rack gear coupled at a first end to a piston rod extendible from said first cylinder, and d. said linear actuator including a second cylinder, said second cylinder having a piston rod extendible therefrom coupled to a second end of said rack gear, said first and second piston rods of said linear actuator extending outwards from first and second opposed ends of said rack gear, and co-linearly aligned along a common action axis, said linear actuator having a central block-shaped central housing section which has a rear wall that receives rotatably therethrough said rotor shaft of said valve, said rotor shaft being received fixedly through the center of said curved gear and extending through a front wall of said central housing section, said first and second pistons of said linear actuator being linearly slidably located within first and second cylinder bores located in first and second cylinder housing sections which extend perpendicularly from upper and lower sides, respectively, of said central housing section of said linear actuator, said linear actuator including a first inlet port for pressurized fluid which communicates with a head space of said first cylinder bore located adjacent to the head of said first piston, and a second inlet port for pressurized fluid which communicates with a head space of said second cylinder bore located adjacent to the head of said second piston, said linear actuator further including a first auxiliary pressurized fluid conduit which communicates with said first inlet port and a downstroke part of said second cylinder bore located adjacent to the skirt side of said second piston.

2. The apparatus of claim 1 wherein said linear actuator further includes a second auxiliary pressurized fluid conduit which communicates with said second inlet port and a downstroke part of said first cylinder bore located adjacent to the skirt side of said first piston.

3. The apparatus of claim 2 wherein said linear actuator is pressurized by air.

4. The apparatus of claim 2 wherein said linear actuator is pressurized by hydraulic fluid.

5. The apparatus of claim 2 wherein said linear actuator is constructed from a single block of material in which are formed said first and second cylinder bores, first and second inlet ports, and first and second auxiliary pressurized fluid conduits.

6. The apparatus of claim 1 wherein said rotor shaft extending from said curved gear through a front wall of said central housing section of said linear actuator and has attached thereto a handle for manual rotation of said valve rotor.

7. The apparatus of claim 1 wherein said hydraulic valve is further defined as being a multiple position hydraulic valve having a pressure inlet port for connection to a source of pressurized hydraulic fluid, a Cylinder 1 opening outlet port, and a return outlet port connectable to a fluid reservoir, said valve having a first, opening configuration effective in conducting pressurized hydraulic fluid from said pressure port through said Cylinder 1 opening port to an opening hydraulic actuator cylinder of a BOP, and hydraulic fluid returned from a closing hydraulic actuator cylinder to a Cylinder 2, closing port through said valve to said return port, a second, closing configuration effective in conducting pressurized hydraulic fluid from said pressure port through said Cylinder 2, closing port to a closing hydraulic actuator cylinder of a BOP, and hydraulic fluid returned from said opening hydraulic actuator cylinder to said Cylinder 1 opening port through said valve to said return port, and a third, neutral configuration effective in blocking both said opening and closing ports.

8. The apparatus of claim 7 further including a pressurized fluid control panel for providing pressurized fluid to said linear actuator in response to a discrete configuration command to cause said linear actuator to configure said hydraulic valve into a selected one of said configurations.

9. The apparatus of claim 8 wherein said pressurized fluid control panel is further defined as comprising in combination;

a. at least a first manually operable opening, pressurized fluid control valve for conducting pressurized fluid from a source of pressurized fluid to a first opening pressure tube connected to a first, upper opening cylinder of a first linear actuator, and b. at least a first, manually operable closing pressurized fluid control valve for conducting pressurized fluid from a source of pressurized fluid to a first closing pressure tube connected to a second, closing lower cylinder of said first linear actuator.

10. The apparatus of claim 9 wherein said pressurized fluid control panel includes at least a second set of manually operable opening and closing pressurized fluid control valves for connecting to a second linear actuator/hydraulic valve assembly.

11. The apparatus of claim 10 wherein said pressurized fluid control panel includes an actuator valve manifold, said actuator valve manifold having at least first and second sets of actuator valve manifold ports for pressure-tight mating with first and second sets of valve air ports of opening and closing actuator control valves, said actuator valve manifold having connected to each port a conduit for fluid pressure-tight connection to separate pressure tubes connected to a separate ones of said cylinders of said linear actuator.

12. The apparatus of claim 11 wherein said pressurized fluid control panel includes a pressurized fluid manifold positioned between said actuator valve manifold and said pressure tubes, said pressurized fluid manifold having an obverse face fastened in sealing contact with a reverse face of said actuator valve manifold, said pressure manifold having internal pressurized fluid conduits having at front ends thereof in said obverse face pressure manifold ports for pressure-tight mating with said actuator valve manifold air ports, and at rear ends thereof fluid pressure-tight connections to said pressure tubes.

13. The apparatus of claim 8 wherein said pressurized fluid is a pressurized gas.

14. The apparatus of claim 8 wherein said pressurized fluid is a pressurized hydraulic fluid.

15. The apparatus of claim 7 wherein said pressure inlet port, said Cylinder 1, opening outlet port, and said Cylinder 2, closing outlet port and said return are located in a valve port interface base plate at the base of said valve housing.

16. The apparatus of claim 15 wherein said four ports penetrate a rear wall of said valve port interface base plate.

17. The apparatus of claim 16 further including an hydraulic manifold, said hydraulic manifold having a first set of four manifold ports connectable in fluid pressure-tight sealing contact with said four ports in said valve port interface base plate of said first valve when said base plate is bolted to said hydraulic manifold, said manifold including a first, pressure conduit connectable to a source of pressurized hydraulic fluid, a second, Cylinder 1, opening conduit connectable to an opening cylinder of a BOP, a third, Cylinder 2, closing conduit connectable to a closing cylinder of a BOP, and a fourth, return conduit connectable to a hydraulic fluid reservoir.

18. The apparatus of claim 17 wherein said hydraulic manifold is further defined as including at least a second set of four manifold ports alignable in fluid pressure-tight sealing contact with corresponding ports of the valve port interface base plate of a second valve and actuator assembly.

19. The apparatus of claim 18 wherein said first and second set of four manifold ports are further defined as being oriented relative to one another so as to facilitate positioning of said first and second valve and actuator assemblies in a close side-by-side arrangement with said axes of said actuator cylinders mutually parallel.

* * * * *